US009797240B2

(12) United States Patent
Tunget

(10) Patent No.: US 9,797,240 B2
(45) Date of Patent: Oct. 24, 2017

(54) APPARATUS AND METHOD OF CONCENTRIC CEMENT BONDING OPERATIONS BEFORE AND AFTER CEMENTATION

(71) Applicant: Bruce Tunget, Aberdeen (GB)

(72) Inventor: Bruce Tunget, Aberdeen (GB)

( * ) Notice: Subject to any disclaimer, the term of this patent is extended or adjusted under 35 U.S.C. 154(b) by 423 days.

(21) Appl. No.: 14/345,909

(22) PCT Filed: Sep. 17, 2012

(86) PCT No.: PCT/US2012/000402

§ 371 (c)(1),
(2) Date: Mar. 19, 2014

(87) PCT Pub. No.: WO2013/043217

PCT Pub. Date: Mar. 28, 2013

(65) Prior Publication Data

US 2015/0034311 A1 Feb. 5, 2015

(30) Foreign Application Priority Data

Sep. 19, 2011 (GB) ..... 1116098.3
Dec. 16, 2011 (GB) ..... 1121742.9
(Continued)

(51) Int. Cl.
*E21B 47/12* (2012.01)
*E21B 7/20* (2006.01)
(Continued)

(52) U.S. Cl.
CPC ..... *E21B 47/12* (2013.01); *E21B 7/20* (2013.01); *E21B 33/13* (2013.01);
(Continued)

(58) Field of Classification Search
CPC ..... E21B 7/20; E21B 47/12; E21B 47/0005; E21B 47/024; E21B 33/13; E21B 33/14; E21B 29/005; E21B 29/06
See application file for complete search history.

(56) References Cited

U.S. PATENT DOCUMENTS 1,677,507 A * 7/1928 Vock ..... E21B 29/005 166/55.7
2,991,834 A * 7/1961 Kennard ..... E21B 29/005 166/216
(Continued)

*Primary Examiner* — Jennifer H Gay

(57) ABSTRACT

Method and apparatus for deploying at least one repeatable signal to empirically measure cement bonding before and after operating a tool string assembly comprising a selectively arrangeable tool assembly of a downhole drive tool usable for operating a downhole placement tool with shaft and axial displacement member extendable and retractable therefrom to radially deploy and operate at least one conduit and downhole coupling tool for placing cement and at least one inner conduit proximally concentrically within a surrounding bore, wherein said drive coupling tool is further usable for transmitting or receiving, through a conductance well element into a memory tool, to measure cement bonding about said surrounding bore before and after concentrically cleaning and coupling cement to at least one conduit and surrounding bore.

42 Claims, 15 Drawing Sheets

(30) Foreign Application Priority Data

Jul. 5, 2012 (GB) ..... 1212008.5
Sep. 14, 2012 (GB) ..... 1216499.2

(51) Int. Cl.
*E21B 47/01* (2012.01)
*E21B 47/024* (2006.01)
*E21B 47/00* (2012.01)
*E21B 33/13* (2006.01)

(52) U.S. Cl.
CPC ..... *E21B 47/0005* (2013.01); *E21B 47/011* (2013.01); *E21B 47/024* (2013.01)

(56) References Cited

U.S. PATENT DOCUMENTS 4,800,537 A * 1/1989 Mount, II ..... E21B 47/0005 181/105
5,101,895 A * 4/1992 Gilbert ..... E21B 23/006 166/55.8
5,131,465 A * 7/1992 Langston ..... E21B 17/1021 102/319
5,566,762 A * 10/1996 Braddick ..... E21B 7/061 166/117.6
6,772,839 B1 * 8/2004 Bond ..... E21B 23/04 166/100
7,380,603 B2 * 6/2008 Jeffrey ..... E21B 23/01 166/285
7,909,118 B2 * 3/2011 Sanfelice ..... E21B 7/061 166/117.6
8,528,630 B2 * 9/2013 Tunget ..... E21B 23/14 166/298
9,010,425 B2 * 4/2015 Larsen ..... E21B 33/13 166/285
9,022,117 B2 * 5/2015 Segura ..... E21B 29/005 166/298
9,175,534 B2 * 11/2015 McAfee ..... E21B 44/00
9,334,712 B2 * 5/2016 Bakken ..... E21B 37/08
2005/0077046 A1 * 4/2005 Simpson ..... E21B 23/00 166/298
2005/0150692 A1 * 7/2005 Ballantyne ..... E21B 7/062 175/61
2005/0263282 A1 * 12/2005 Jeffrey ..... E21B 23/01 166/281
2008/0314591 A1 * 12/2008 Hales ..... E21B 33/12 166/285
2009/0213689 A1 * 8/2009 Tello ..... E21B 47/0005 367/35
2010/0126718 A1 * 5/2010 Lilley ..... E21B 47/0005 166/253.1
2010/0155067 A1 * 6/2010 Tunget ..... E21B 23/14 166/285
2011/0000668 A1 * 1/2011 Tunget ..... E21B 23/14 166/285
2011/0048701 A1 3/2011 Williams et al.
2011/0127035 A1 * 6/2011 Hansen ..... E21B 33/13 166/297
2011/0209872 A1 * 9/2011 McAfee ..... E21B 44/00 166/298
2011/0220357 A1 * 9/2011 Segura ..... E21B 29/005 166/298
2011/0240302 A1 * 10/2011 Coludrovich, III ..... E21B 37/00 166/336
2013/0312963 A1 * 11/2013 Larsen ..... E21B 33/13 166/285
2014/0123779 A1 * 5/2014 Tunget ..... E21B 7/00 73/865.6
2014/0251603 A1 * 9/2014 Raducanu ..... E21B 47/09 166/255.1
2014/0311741 A1 * 10/2014 Tunget ..... E21B 23/14 166/285
2015/0034311 A1 * 2/2015 Tunget ..... E21B 7/20 166/250.14
2015/0053405 A1 * 2/2015 Bakken ..... E21B 33/134 166/285
2015/0152704 A1 * 6/2015 Tunget ..... E21B 33/128 166/254.2
2015/0211314 A1 * 7/2015 McAfee ..... E21B 29/005 166/250.01
2015/0275605 A1 * 10/2015 Bennett ..... E21B 29/002 166/298
2015/0275606 A1 * 10/2015 Segura ..... E21B 29/005 166/298
2016/0138369 A1 * 5/2016 Tunget ..... E21B 37/02 166/311

* cited by examiner

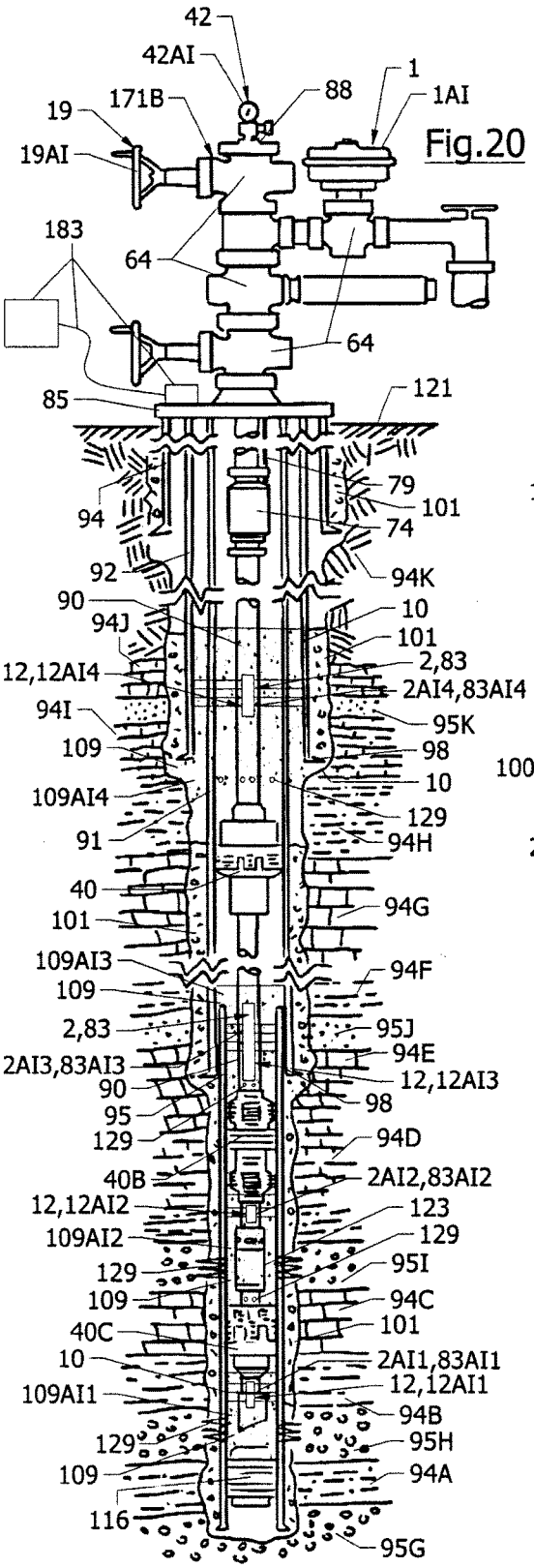
Fig.20
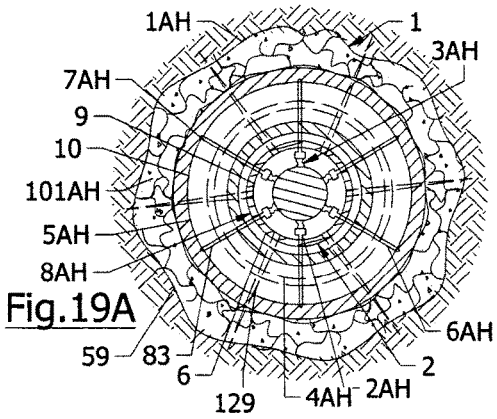
Fig.19A
Fig. 21
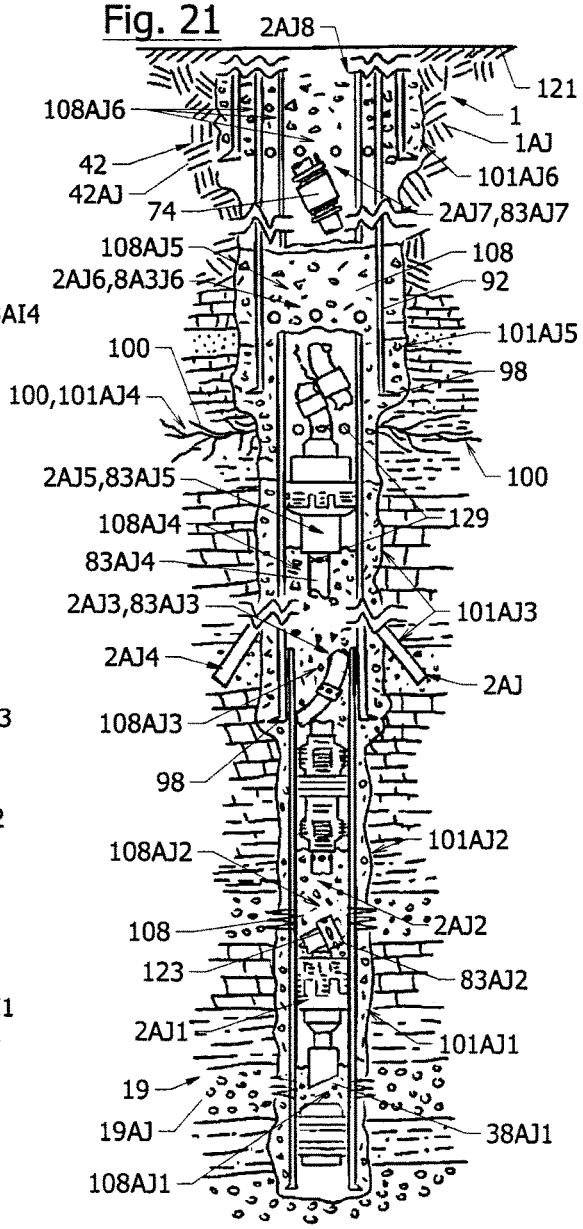

9
101AK
10
90
110
91
83
83AK
19
19AK
3AK
1
1AK
8
3
8AK

187

99
101
8
9
101
91
188
3AK
83
90
110
83AK
7AK
7
10
BB 8
187
17AK 17
110
101
90
91
101AK
188
99
42AK
3AK
12
12AK

7AK
90
83
91
101
99
101AK
2AK
9
110
10

DETAIL BB 189
7AK
2AK
83AK
6
189

DETAIL BC 42
42AK
187
12AK
17
12
17AK
2AK
3
3AK
BC
83
7AK
2
6
6

8,8AL1
59
17,17AL1
2,2AL1
3,3AL1
99
83AL1
1
1AL1
84A
19,19AL1
7,7AL1
83,83AL1
12
101
12AL1
9,9AL1
9
5AL1
91
90,90AL1
90,90AL2
9,9AL2
110
9
84B
2,2AL2
83,83AL2
7,7AL2
1,1AL2
BD
4,4AL
8,8AL2
5,5AL2
10
9
19,19AL2
9,9AL3
6
84C
12,12AL2
3,3AL2
7AL3
BE

DETAIL BD
2AL2
6
101
110
10
83AL2
83
9
91
99
90
3AL2
7, 7AL2

DETAIL BE
2AL3
3,3AL3
91
83
83AL3
9
10
99
101AL
110
6
7,7AL3

221
225
83AM3
189
161
177
83AM2
181
224
182
192
83
83AM1
226
181
222
190
221
162
6
223
182
189

177
161
189
191
6

75
75AN1
177
161
182
181
191
162
83AN
6
75,75AN2
192
177
182
189
191
189
162

8AT1
59
1AT
3AT1
19AT1
2AT1
12AT1
83AT1
42AT
84A
7AT1
9
9
7AT2
8AT2
10
2AT2
7AT3
83AT2
84B
3AT2
9
10
101
7AT3
7AT4
12AT2
42
19AT2
6
19AT3
3AT3
12AT3
8AT3
2AT3
7AT5
84C
19
83AT3
1
12
99

Fig.40
Prior Art
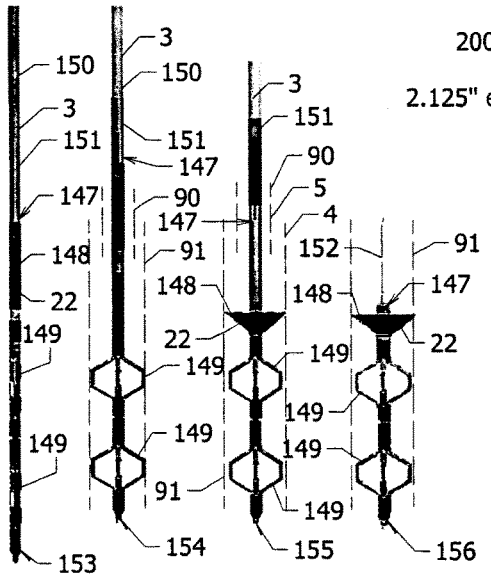
Fig.41A
Prior Art
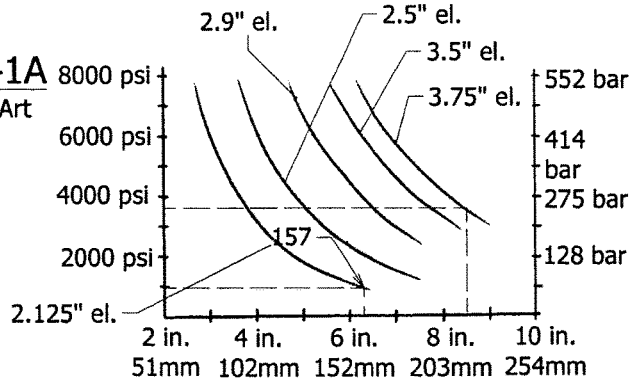
Fig.41
Prior Art
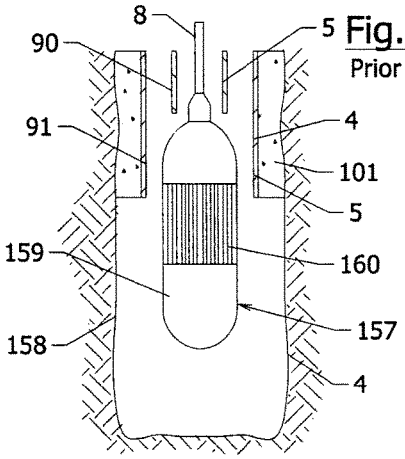
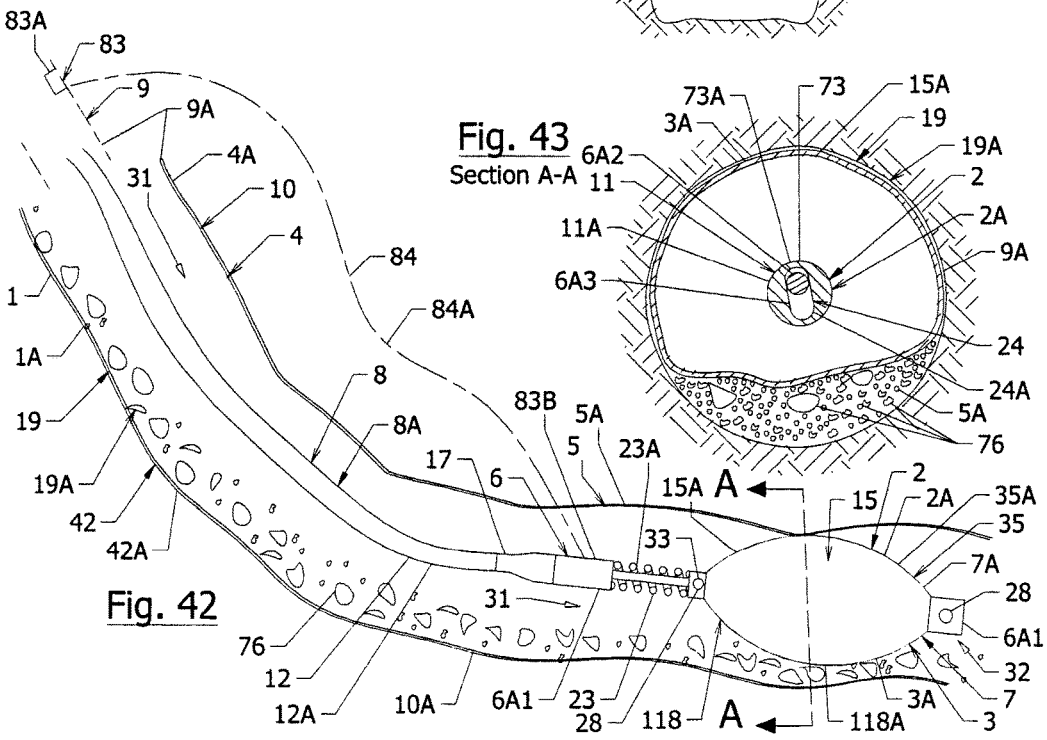
Fig. 43
Section A-A
Fig. 42

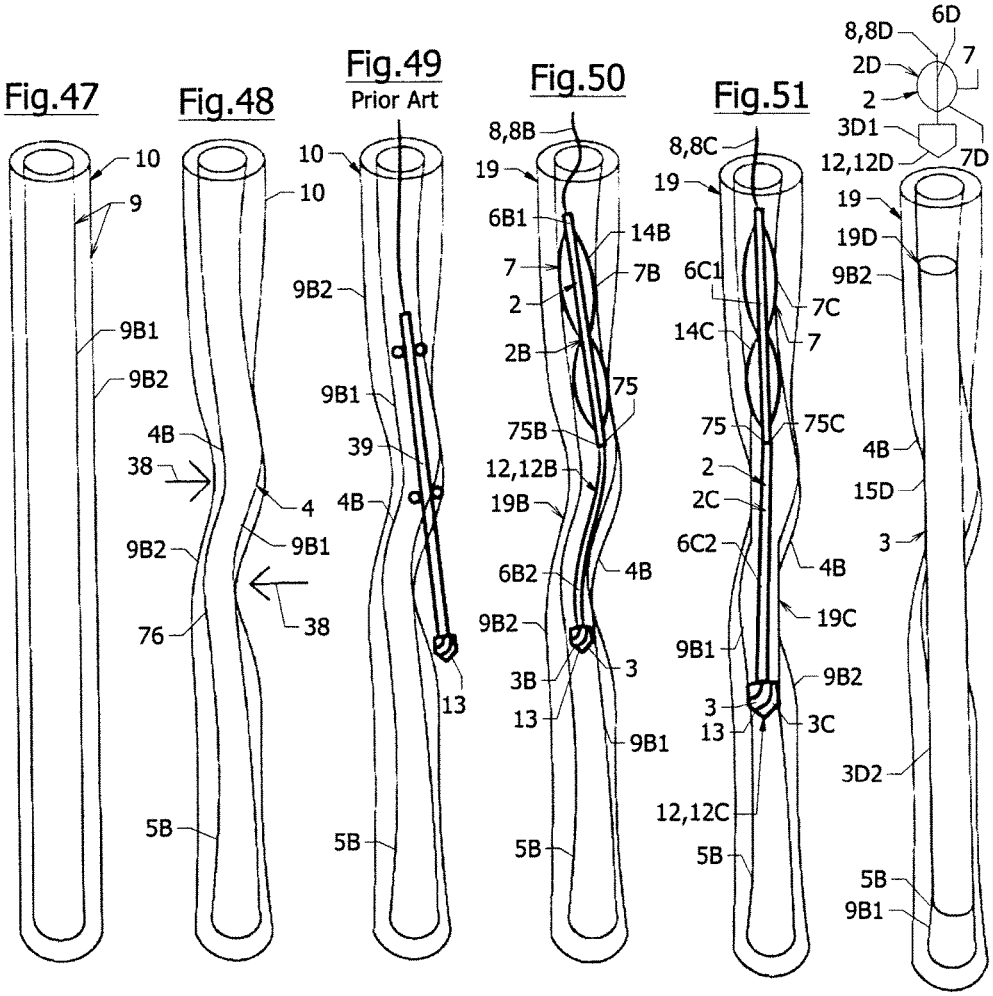
Fig.47
Fig.48
Fig.49
Prior Art
Fig.50
Fig.51
Fig.52
10
9
9B1
9B2
4B
38
4
76
5B
39
13
8,8B
19
6B1
14B
7
7B
2
2B
75
75B
12,12B
19B
6B2
3B
3
9B1
8,8C
6C1
7C
14C
75C
2C
6C2
19C
3C
12,12C
6D
8,8D
2D
3D1
12,12D
7D
19D
15D
3D2
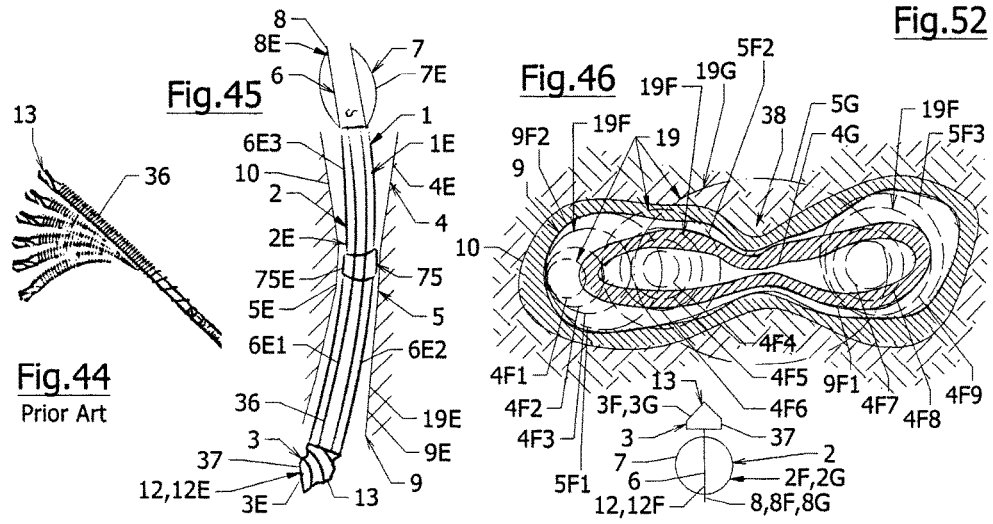
Fig.44
Prior Art
Fig.45
Fig.46
13
36
8
8E
6
7
7E
1
1E
6E3
10
2
4E
4
2E
75E
75
5E
5
6E1
6E2
19E
9E
9
37
12,12E
3E
3
5F2
19F
19G
38
5G
4G
9F2
9
19
5F3
4F1
4F2
4F3
5F1
4F4
4F5
4F6
9F1
4F7
4F8
4F9
3F,3G
12,12F
2F,2G
8,8F,8G

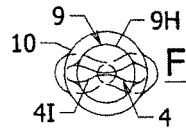
Fig.53
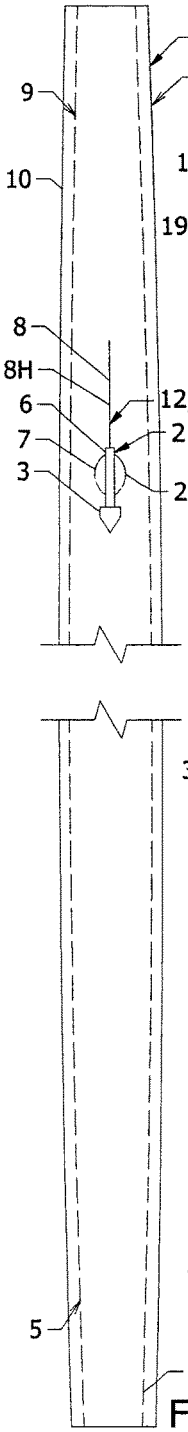
Fig.54
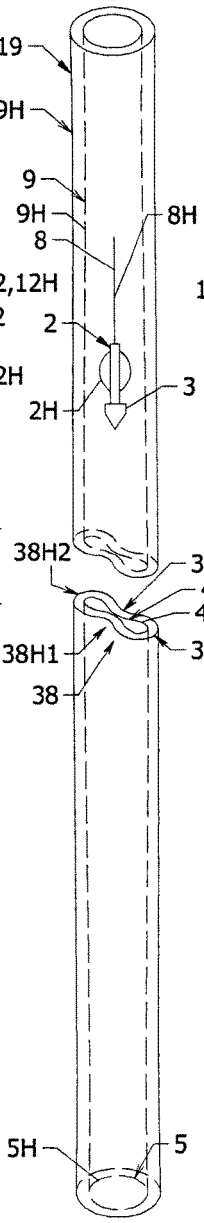
Fig.55
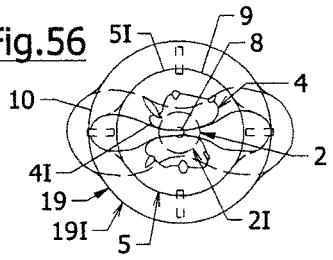
Fig.56
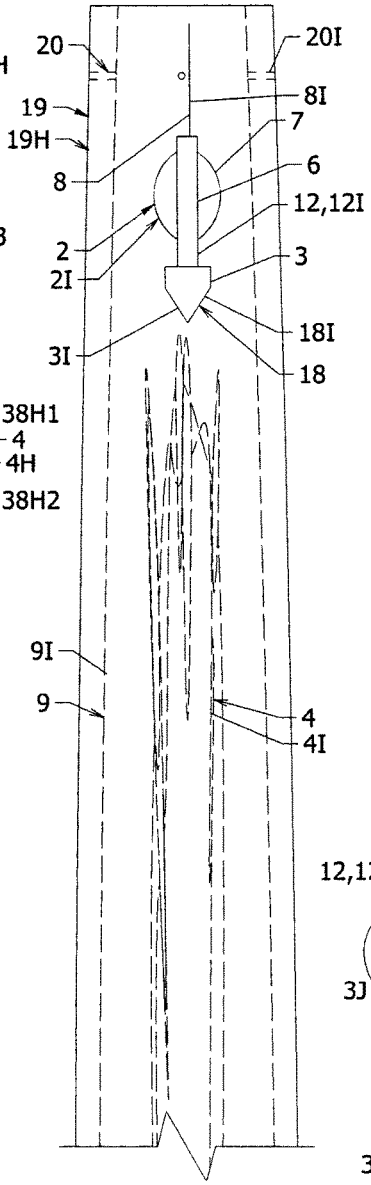
Fig.57
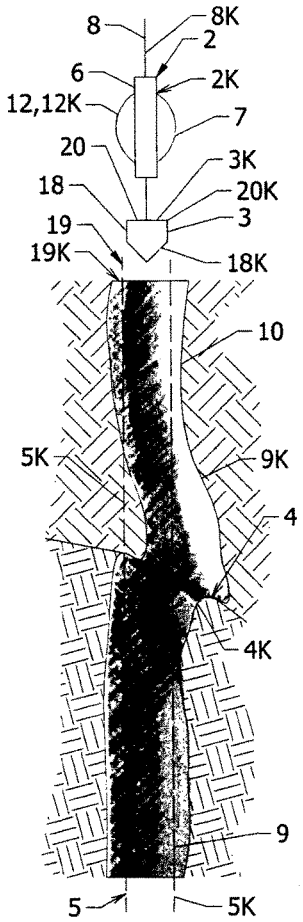
Fig.59
Fig.58
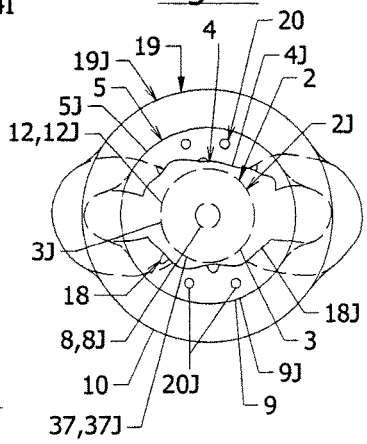

8L1
17
17L3
28
7L4
7L3
21L1
6L2
21
6
3
3L2
10
9
5L
7L2
19
9L1
19L
17L2
2L
17L1
6L1
2
12
4L
7L1
12L
3L1
17
17L5
28
7L7
7L6
21
6
21L2
6L3
3L3
3
7L5
17L4
8
8L1
10
17
17L7
17L6
9L1
6L8
9L2
7L10
3L8
6L7
3L7
3L6
6L6
6L5
3L5
28
7L9
7L8
21L3
6L4
3L4
3
6
119
119
132
131
124
119
125
126
127
133
8
7
6
12,12M
20M
18M3
18M2
3M1
19
18M1
119
3
19M
3M3
3M2
119
6M
6
2
2M
5M
5
4M
4
9,9M
133
10

AM
AM
10
9
2T
2
19
19T

SECTION AM-AM
6T1
6T10
19
19T
25T1
9T2
7
25T2
7T1
25T3
25T4
6T1
9
23T1
6T3
23
23T2
6T4
9T1
31
7
7T2
15
27
11T1
12
11
15T
27T
11T2
6T5
23T3
6T6
23T4
5T
4T
6T7
7
7T3
14T4
26
26T2
6T8
6T10
14T5
6T9
5T
3T 8
9T2
9T1
8T
19
19T
7
7T1
10
10T
9
31
37T1
AN
7
31
7T2
28
11T2
11
37T2
2
2T
5T
4T
7
7T3
4T
5T
3T 12T
25T1
AP
23T1
23T2
6T4
25T5
22T1
22
28
25T6
14T3
14T3
27
27T
15T
7
7T2
25T7
22
22T2
25T8
6T5
23T3
23T4
6T10
AR
7T3
7
6T9
3T

DETAIL AP
14T1
25T2
26T1
25T3
14T2
25T4
23T1

DETAIL AN
37T1
9T2
28
9
14T3
15
15T
11
11T1
28
AT
24

DETAIL AT
9T2
15T
25T13
27T
15T
14T3

25
14
25
29T1
29

DETAIL AR
23T4
24T4
6T7
25T9
14T4
25T10
26T2
25T11
14T5
6T10
6T8
25T12
6T9
6

AU
AU

SECTION AU-AU

DETAIL AV

DETAIL AW

BA
AY

DETAIL AY

DETAIL BA

APPARATUS AND METHOD OF CONCENTRIC CEMENT BONDING OPERATIONS BEFORE AND AFTER CEMENTATION

CROSS-REFERENCE TO RELATED APPLICATIONS

The present application is a U.S. national application that claims the benefit of patent cooperation treaty (PCT) application having PCT Application Number PCT/US2012/000402, entitled "Apparatus And Method of Concentric Cement Bonding Operations Before and After Cementation," filed Sep. 17, 2012, which claims priority to United Kingdom patent application having Patent Application No. GB1216499.2, entitled "Apparatus And Method Of Concentric Cement Bonding Operations Before And After Cementation," filed Sep. 14, 2012, which is a continuation-in-part application that claims priority to: United Kingdom patent application having Patent Application Number GB1116098.3, entitled "Conventional Apparatus Cable Compatible Rig-Less Operable Abandonment Method For Benchmarking, Developing, Testing And Improving New Technology" filed 19Sep., 2011 and later afforded a priority date of 16 Sep. 2010; United Kingdom patent application having Patent Application Number GB1212008.5, entitled "Method And Apparatus For String Access Or Passage Through The Deformed And Dissimilar Contiguous Walls Of A Wellbore," filed 5 Jul. 2012; United Kingdom patent application having Patent Application Number GB1121742.9, published under GB2487274, entitled "A Space Provision System Using Compression Devices For The Reallocation Of Resources To New Technology, Brownfield And Greenfield Developments" filed 16 Dec. 2011, all of which are incorporated herein in their entireties by reference.

FIELD

The present invention relates, generally, to methods and apparatus for placing and measuring cement bonding about conduits of a subterranean well, during abandonment, suspension and side-tracking operations.

The present invention also relates, generally, to forming and urging a tool string to provide placing and measuring of cement bonding through circular or dissimilar contiguous passageway walls of a subterranean wellbore, wherein the dissimilar walls may be formed by frictionally obstructive debris that is within the walls, or at least within a partially restricted circular or deformed circumference thereof, and wherein the tool string is usable to provide concentric cementing and log cement bonding.

The present invention further relates to the economic use of rig and rig-less operations by using benchmarking, developing, testing and improving of said operations in relation to the application of new technology, which can be usable to concentrically cement and log the cement bonding about conduits of a subterranean well, including logging before and after cement placement, to prove said operations and at least one unproven downhole apparatus, within an aged geology and aging well, to reallocate operation of an unproven downhole apparatus to a proven operation within a proximally similarly aged geology of the aging well, another aging well, a new well, or a field of wells, which is conventionally referred to as Brownfield and Greenfield Operations.

BACKGROUND

According to the sum of the EIA and Baker Hughes International Rig Counts, during April 2012, there were approximately 3,500 rotary drilling rigs worldwide, wherein analysis of the EIA data suggests that each rotary drilling rig on average drills 2 wells per month, which further suggests that 7,000 wells may be drilled by rotary drilling rigs worldwide each month. EIA data for the United States also suggests that the average depth of a well in 2008 was around 6,000-ft, wherein as an artisan of the art of drilling hydrocarbon wells, the present inventor suggests that, based on the time necessary to bore and remove rock from a borehole, drilling two wells per month of around 6,000-ft in depth suggests that a large percentage of those 7,000 wells per month are completed with 4½ to 7 inch liners at the lower end of 9⅝ inch casings with 2⅜" to 4½" production tubing.

Furthermore, while the numbers of wells drilled in the United States may have peaked at 8,000 U.S. wells per month around 1982, and dropped as low as 2,000 U.S. wells per month between 1986 and 1996, the average since 1973 is around 3,500 U.S. wells per month. Hence, using the same Rotary Drill Rig Count logic described above, a present average of 7,000 wells per month worldwide, or 84,000 wells per year worldwide, may be representative of an overall worldwide average since 1973, wherein the stock of wells requiring abandonment must also be around 7,000 wells per month worldwide or 84,000 wells per year worldwide, lest the stock of wells to be abandoned increases exponentially. Hence, since abandonment of a well represents an investment without return on capital, the propensity is to postpone abandonment; and hence, on an average, the number of wells requiring abandonment in the future is likely to be more.

Accordingly, the significance of a downhole tool's diameter relative to then number of wells, using small diameter tubing and the number of wells requiring abandonment worldwide, should not be discounted, since the well abandonment market each year will be measured in billions of dollars and pounds sterling worldwide.

It is equally important, from the view of supplying tooling for abandoning said wells, that the diameter of the tooling be kept as small as possible, while having the ability to expand as large as possible to accommodate the differences in tubing sizes worldwide, wherein maintaining an inventory of off-the-shelf tooling suited for the majority of well sizes may be exceptionally costly, unless a minimum of diameter changes is maintained across downhole tools to minimise the stock of tool sizes, and wherein the physical restrictions of working within a smaller diameter limits their functionality.

The present invention purposely provides small diameter tools with significant expansion capabilities to provide the most economical solution for worldwide abandoning, suspending and side-tracking of wells.

Constructing a subterranean well, for producing substantially water, e.g. from solution mined or water cut hydrocarbon wells, or producing substantially hydrocarbons, requires capital investment with an expectation of a return on capital, repaid over the life of the well, followed by the permanent abandonment of all or part of the well, typically referred to as suspension, to delay further cost, once storage or producing zones have reached their economic life or well structural integrity becomes an issue. For the hydrocarbon extraction industry, the producing life of a well is, typically, designed for five (5) to twenty (20) years of production. However, conventional practice is primarily to extend well life as long as possible, even after exceeding its original design life, and, despite any marginal economic losses incurred, to push the cost of final abandonment into the future. For the underground storage industry, wells may be designed for a fifty year life span, but, over time, storage wells may encounter integrity issues that require intervention, maintenance or abandonment.

Embodiments of the present invention can be usable to delay abandonment by using well barrier element placement to intervene in or to maintain a well's structural integrity and to allow additional marginal production from other zones after, e.g., suspending a watered-out reservoir formation, or storage operations, until final cessation of production or storage operations, when the proposed benchmarking, development, testing and improvement of new technology may take place. Various embodiments of the present invention can be further usable to permanently abandon all or a part of produced subterranean or underground storage wells, during the benchmarking, development, testing and improvement of new technology.

As the cost of placing acceptable abandonment barriers to permanently isolate subterranean pressurized liquids and gases comprises an investment without a return on capital, the financially minded continue to seek to reduce the net present cost of abandonment by either delaying it, through marginal production enhancement, or by minimising expenses associated with abandoning the lower portion of a well, sometimes referred to as suspension until final abandonment of a well.

Methods of the present invention can be usable with rig-less intervention operations for minimizing the cost of marginal production enhancement and for abandoning a portion of a well, until a final abandonment campaign can be used to further minimize costs, by using rig-less method embodiments to benchmark, develop, test and improve new technology in a risk-controlled environment and over the life of such an abandonment campaign.

Well abandonment represents actions taken to permanently isolate subterranean pressurized fluids from surface and/or other lower pressured exposed permeable zones, e.g. water tables, for various portions of a well where re-entry is not required, and wherein the portions, being selectively used and/or abandoned, require permanent fluid isolation at depths specified by pressures within the strata and by the pressure bearing ability of the overlying strata to isolate lower strata fluid pressures from the surface or other upper permeable zones. Subterranean pressurized permeable zones, comprising strata formations accessed by a well with a possibility of fluid movement when a pressure differential exists, generally, must be isolated to prevent pollution of other subterranean horizons, such as water tables, or surface and ocean environments.

Various embodiments of the present invention are usable within a pressure controlled working envelope, using coiled strings, lubricators, grease heads or other pressure control equipment engaged to the upper end of a wellhead and valve tree to intervene within the passageways and annuli of a subterranean well extending downward from the wellhead to test and measure permanent isolation of subterranean pressurized fluids, which can be accessed by the passageways without the risk and cost of placing dense kill weight fluids in the well and breaking through surface pressure barriers, thus exposing personnel and the environment to a higher potential for uncontrolled fluid flow, if the dense fluid column killing subterranean pressures is lost through, for example, subterranean fractures.

Performing well intervention and abandonment operations within a pressure contained environment is required for rig-less operations in a subsea environment where risers and lubricators must be engaged to the upper end of a subsea valve tree to remove plugs for accessing the innermost well bore. However, access to annuli within a subsea well is limited, with most wells opening the innermost annulus to the production stream during initial thermal expansion, after which subsea annuli are closed. Many subsea configurations also provide fluid access to the innermost annulus through a manifold placed on the subsea valve tree, which may be engaged with the supporting conduit pipelines, such as a methanol line. The methods of the present invention can be usable from a boat and lubricator arrangements within a pressure controlled environment, e.g. a subsea lubricator and BOP, to rig-lessly test and measure access and abandonment of a well without the need for a riser to sea-level.

Permanent abandonment, generally, is considered to be the placement of a series of permanent bathers, often referred to as plugging and abandoning, in all or part of a well with the intention of never using or re-entering the abandoned portion. Permanent well barriers are, generally, considered well barrier envelopes comprising a series of well barrier elements that, individually or in combination, create an encompassing seal that has the permanent or eternal characteristic of isolating deeper subterranean pressures from polluting shallower formations, e.g. ground water permeable zones, and/or above ground or ocean environments. Various publications, including Oil and Gas UK Issue 9, January 2009 Guidelines for Suspension and Abandonment of Wells, NORSOK Standard D-010 Rev 3, August 2004 and the Well Plugging Primer by the Texas Railroad Commission, incorporated herein in their entirety by reference, define conventional best practice for permanent abandonment of a well and the associated acceptable well barrier elements used to form a plurality of pressure bearing envelops for resisting subterranean pressurized liquids and gasses over geologic time, wherein Article 3 of the Texas Railroad Commission 1919 S.B. 350 rules recites "dry or abandoned wells be plugged in such a way as to confine oil, gas, and water in the strata in which they are found and prevent them from escaping into other strata."

Presently, there are no known conventionally proven comprehensive systems for abandoning wells that provide concentric cementation and cement bonding, other than the systems of the present inventor or systems requiring the use of an over-specified and expensive drilling rig. Unlike any of the existing systems, the present invention comprises a method for first measuring and using conventional apparatuses to rig-lessly abandon wells and to provide a benchmark, after which new rig-less technologies or methods and apparatuses of the cited applications of the present inventor and those of the present invention, may be developed, tested and improved during the rig-less suspension and/or abandonment of onshore and/or offshore, surface and/or subsea, substantially hydrocarbon or substantially water wells, using published conventional best practices for placement of industry acceptable cement-like permanent abandonment well barrier elements.

With an estimated 84,000 wells being drilled every year worldwide, rig-less abandonment is a critical factor in allocating the industries resources to further discovery and production enhancement, instead of abandonment, which is further explained within application publication GB2487274 of the present inventor, which is included herein in its entirety by reference for supportive reasoning.

A need exists for a set of rig-less abandonment tools that can be applicable across a larger percentage of the worldwide wells reaching the end of their productive life, which can minimise the number of off-the-shelf variations of the tool set, allowing the effective disposal of aging well components downhole and providing concentric cementation and cement bond logging before and after said cementation. The wells being abandoned in bulk may also be used for the benchmarking, developing, testing and improving of new technology that can be usable to verify said tool set and other downhole technologies, usable to facilitate a market where the reduction of well abandonment liability allows larger, higher-overhead operating companies to sell marginal well assets to smaller, lower-overhead operating companies by lowering the risk of a residual abandonment liability and including the application of new technologies to increase recoverable reserves, thus preventing usable hydrocarbons from being left within the strata by the lack of sufficient technological innovation.

The embodiments of the present invention provides significant improvements to the oil and gas industry by providing methods and apparatus for a cable conveyable tool string, which can be usable for providing concentric cementing and cement bond logging, before and after cementation, where none has previously existed.

Methods of the present invention is the destruction and permanent well barrier element placement within the lower portion of a well, at the lowest possible cost, by providing disposable cement bond logging apparatus and methods and to provide space above said destruction for benchmarking, developing, testing and improving new technology. Embodiments of the present invention include low cost, simple and robust methods usable to test apparatus and methods.

Various embodiments of the present invention can be usable to measure formation of an enlarged passageway, including the cutting and/or displacing of well conduits, equipment for compression or compaction of installed well conduits and equipment to form or enlarge passageways for placement of a permanent well barrier element. Other embodiments can be used for testing expandable casings, expandable seals or swellable materials within bores and annuli of a well to form pressure bearing passageways that can be usable to form a space after cutting or displacing conduits to place, e.g., logging equipment, to determine any necessary remedial action within a bore or annuli of a well. Still other embodiments can include placing depth sensors in protective housing to measure the formation of space and associated fluid isolation for determining efficiency benchmarks. Such methods can be usable for benchmarking, development, testing and improvement of new rig-less technology during final abandonment of subterranean portions of a well, without incurring unacceptable risk of working above a well barrier that is not tested in direction of flow, while maintaining low cost operations.

In addition, embodiments within the scope of the present disclosure provide a tool string that can be usable across a spectrum of conduit sizes, for example, casing or similar conduits ranging from an outer diameter of 2⅜ inches to 36 inches, for use in wells worldwide.

Embodiments of the present invention provide significant improvements to methods described in UK Patent GB2471760, entitled "Apparatus And Methods Subterranean Downhole Cutting, Displacement And Sealing Operations Using Cable Conveyance" filed Jul. 5, 2010, and UK Patent Application GB1111482.4 published as GB2484166, entitled "Cable Compatible Rig-Less Operatable Annuli Engagable System For Using And Abandoning A Subterranean Well," both of which were filed by the present inventor and each of which is incorporated herein in its entirety by reference. In addition. embodiments of the present invention can be usable with rigs or conventional rig-less arrangements, such as those described in U.S. Pat. No. 7,921,918B2, published the 12th of Apr. 2011, and incorporated herein in its entirety by reference to provide reference, Embodiments of the present invention can be usable to provide concentric cementing and acoustic monitoring after said cementing in an existing bore during any of abandonment, suspension and side-tracking operations, which provides a vast improvement to methods relating primarily or solely to detecting and locating fluid ingress in a well bore, particularly methods using acoustic sensing of individual acoustic signals from a plurality locations along the well bore for analysing them to determine the likelihood of fluid ingress, and using such technology as fibre optic cable or microphones placed along the well bore for detection, Embodiments of the present invention can be usable to communicate through slickline for providing improved detection of leaks, breaches and/or information regarding the characteristics of a cement annulus between a casing in a borehole and the surrounding earth formations in a slickline cement bond logging operation, including the use of acoustic logging tools that produce a pure signal downhole when captured in memory downhole using a time amplitude matrix that stores data points for producing a cement bond log at the well surface Existing methods and systems generally pertain to wireline and coiled string deployment that should not be left in situ, and/or which use the limited force of conventional tools that are unable to, for example, pass passageway restrictions, crush compressible well components or orient explosive devices axially, because components used with these existing methods and systems may be propelled out of the well or otherwise damaged, or stuck within the wellbore, if operated with the same hydraulic and/or explosive forces usable with the embodiments of the present invention. In addition, existing methods and systems relating to wireline conveyable expandable axial displacement spring slips lack many features of the present invention, including the use of devices that can be fashioned to be moveable or to achieve the expanded diameter to collapsed diameter ratio necessary for passage through, e.g., a collapsed conduit bore's walls.

Further, although conventional methods include wireline dumping of cement upon, for example, a restriction or bridge plug, these conventional methods do not include the passage of a downhole device past a restriction, and with regard to methods using deformable members in a downhole device, such methods are not usable in situations encumbered by the deformity of well conduits where it is necessary to pilot such devices into, e.g., a damaged or debris filled well bore.

The majority of the existing methods and systems for passage through a wellbore presume the use of a circular well bore, without significant restriction to deployment of a downhole device, for example, the deployment of a downhole device through a collapsed casing. Generally, conventional methods do not include a practicable cost effective means of deploying or urging the deployment of a downhole device through, for example, the debris of a collapsed casing section, and including the orienting of the collapsed tubing or casing axially downward to either cut or expand a failed well conduit. In addition, existing methods and systems lack interoperability between tools in the deployment string that are necessary to pilot a tool string and to traverse through intermediate debris and/or damage to a lower end of a well bore, without the removal of said debris through the act of well bore circulation.

While various conventional methods and systems for passage through a wellbore exist, it is not known in the industry how said conventional methods and systems may be practicably deployed to provide repeated access and to provide passage to a well's lower end. Embodiments of the present system meet the needs for repeated access and passage to a well's lower end by providing the piloting and selective orientation of a tool string, relative to substantially differing circumferences along an erratic axis of a contiguous passageway's walls, which have been formed by deformation or damage along and/or debris within or on the dissimilar passageway walls.

Other industry needs include a need for apparatus and methods usable for the concentric placement of cement and cement bond logging thereof within, for example, wells that for various reasons may be damaged or otherwise filled with debris, wherein wellbore wall deformation and friction reducing methods and apparatus, that are conventionally usable with coiled tubing and/or drill strings, are not conventionally available to wireline, A need exists for apparatus and methods usable for economically establishing reference benchmark data for the use of new and conventional apparatus, comprising both mechanical and fluid apparatus, which can be usable with a coiled string and measurable with conventional logging measurement devices and shock absorbing housing methods, and including apparatus and methods to provide a basis for developing and improving unconventional abandonment, suspension and side-tracking of a plurality of passageways in a well without using a drilling rig, or to substantially reduce the time spent by a drilling rig during such operations.

A need exists for apparatus and methods usable with new technology that may be benchmarked, developed, tested and improved, such as conventional apparatuses used in unconventional ways, unconventional methods and apparatuses used in unspecified ways, and other unconventional methods and apparatuses.

A need exists for rig-less methods and systems usable with conventional and new apparatuses to eliminate the need to remove installed conduits, thus allowing measurement in all circumstances, including where the installed well equipment and any associated scale or naturally occurring radioactive material are left downhole, thus providing an environment for conventional and new technological benchmarking, development, testing and improvement while meeting published industry best rig-less abandonment practices during formation of permanent well bather elements and indefinite abandoned well integrity A need exists for methods usable to reduce or eliminate all risks associated with the benchmarking, development, testing and improvement of rig-less procedures and tools of a conventional and unconventional nature.

A need exists for methods and apparatus usable to provide a means for a concentrically cemented and cement bond logged isolation within a wellbore and for making it safer from fluid ingress, comprising, for example, the use of rheological controllable fluid members, logging tool members, expandable members, swellable members, placeable conduit members, motorized members, boring members, tractor members, conduit shredding members and milling members, or any new technology, or any other members that may be benchmarked, developed, tested and improved.

A need exists for apparatus and methods that may be safely used and tested within a geological space, confirmed by use of concentric cement placement and cement bond logging methods to confirm the placement of well barrier elements for isolating at least a lower portion of the wellbore. In addition, a need exists for methods usable to benchmark, develop, test and improve access to subterranean boreholes, conduits, annuli and producible zones of a well to perform rig-less well abandonment, thus providing the basis and confidence for industry to benchmark, develop, test and improve various in use methods and apparatuses, in a new manner.

A need exits for apparatus and methods usable to meet published industry best practice for final rig-less well abandonment of wells using conventional off-the-shelf technology, thus saving the cost of using a drilling specification rig, while providing an environment for further saving of costs by incrementally benchmarking, developing, testing and improving various procedures and tooling.

A need exists for apparatus and methods usable to increase the number of wells where lower cost rig-less slickline operations can be usable to place permanent well barrier elements, like cement, where the use of conventional apparatuses and methods would require use of extremely expensive and over specified drilling rigs and equipment to perform remedial work on wells.

A need exists for apparatus and methods usable and combinable with conventional fluid and mechanical apparatus for placing well barrier elements to perform benchmarking, development, testing and improvement of conventional and newly developed rig-less operable methods and apparatus, by testing the isolation of subterranean pressures to provide a safer, lower risk and lower cost testing environment.

Various embodiments also provide very small diameter tools deployable through small diameter tubing and usable to operate within substantially larger diameter surrounding bores within abandonment, suspension and side-tracking operations that cannot be provided by prior art or conventional tooling.

Embodiments of the present invention are usable to address these and other needs.

SUMMARY

The present invention relates, generally, to methods and apparatus for placing and measuring cement bonding about conduits of a subterranean well, during abandonment, suspension and side-tracking operations, and to the economic use of rig and rig-less operations by using benchmarking, developing, testing and improving of said operations in relation to the application of new technology, which can be usable to concentrically cement and log the cement bonding about conduits of a subterranean well, including before and after cement placement, to prove said operations and at least one unproven downhole apparatus, within an aged geology and aging well.

Embodiments of the present invention include the use of methods (1, 1A-1AT, 19, 19A-18AT, 42, 42A-42AT) and apparatus (12, 12A-12AT) for deploying at least one logging signal (84) to empirically measure cement bonding after using an apparatus (12, 12A-12AT) associated with a tool string (8, 8A-8AT) to concentrically dispose at least one inner conduit within a surrounding bore (10) to provide concentric cementation and cement bonding before and after said cementation; and conveying a selectively arrangeable tool string (8) assembly, comprising at least one selectively actuatable downhole drive tool (3, 3A-3AT), at least one downhole placement tool (2, 2A-2AT) having at least one shaft (6) and an axial displacement member (7) extendable and retractable from said shaft, and at least one cutting or displacing tool. In addition, the methods can include the steps of actuating said at least one selectively actuatable downhole drive tool to operate said at least one downhole placement tool to place said at least one cutting or displacing tool within said at least one inner conduit, and actuating said at least one cutting or displacing tool to cut or displace said at least one inner conduit proximally concentrically within said surrounding bore, thereby forming a cut or space in said at least one inner conduit. Further, the methods can include circulating fluid between said at least one inner conduit and said surrounding bore for cleaning and bonding cement thereto after cementation, and transmitting at least one logging signal transmitted through said cut or space to measure about said surrounding bore before cementation and to provide concentric cementation and cement bonding before and after said cementation.

Embodiments of the present invention include other methods usable for urging at least one apparatus (12), associated with a tool string (8), for displacing at least one inner conduit within at least one surrounding bore of a subterranean well to provide concentric cementation and cement bonding both before and after said cementation. Such methods can include the steps of conveying at least one selectively arrangeable tool string (8), through an innermost bore (9) of differing diameters or frictionally resistant walls (4, 5), wherein the selectively arrangeable tool string (8) comprises at least one selectively actuatable downhole drive tool (3), at least one downhole placement tool (2) with at least one shaft (6) and an axial displacement member (7) extendable and retractable from said shaft, and at least one cutting or displacing tool. The methods can include actuating said at least one selectively actuatable downhole drive tool to operate said at least one downhole placement tool to place said at least one cutting or displacing tool within said at least one inner conduit; using said at least one cutting or displacing tool to cut or displace said at least one inner conduit proximally concentrically, within said surrounding conduit, thereby forming a cut or space; and circulating fluid between said at least one inner conduit and said at least one surrounding bore for cleaning and bonding cement thereto after cementation. The methods can further include transmitting at least one logging signal through said cut or through the space to measure about said at least one surrounding bore before cementation and to provide concentric cementation and cement bonding before and after said cementation.

Embodiments of the present invention can include an apparatus (12) that can be usable for urging at least one inner conduit (90-93), within at least one surrounding bore (10) of a subterranean well, to provide concentric cementation and cement bonding both before and after said cementation, wherein the apparatus comprises a selectively arrangeable tool string (8, 8A-8AF), which can be pilotable through an innermost bore (9) of differing diameters or frictionally resistant walls (4, 5).

The selectively arrangeable tool string can comprise at least one selectively actuatable downhole drive tool (3); at least one downhole placement tool (2) operable by the at least one selectively actuatable downhole drive tool, wherein the at least one downhole placement tool comprises at least one shaft (6) and an axial displacement member (7) extendable and retractable from said shaft; and at least one cutting or displacing tool placeable by said at least one downhole placement tool and usable to cut or displace the at least one inner conduit, proximally concentrically within said surrounding bore, to enable fluid circulation between said innermost bore and said surrounding bore for cleaning and bonding cement thereto after cementation, and to enable measurement about said surrounding bore before cementation, using at least one logging signal transmitted through a cut or space formed by cutting or displacing said at least one conduit, to provide concentric cementation and cement bonding before and after said cementation.

Various embodiments selectively arrange said at least one string for collecting data via said signal's storage within a retrievable portion of a downhole memory tool (184, 185) of said tool assembly, a surface memory tool (183) conductively engaged to the upper end of at least one said well elements.

Other embodiments provide cement bonding measurement and concentric cementation within the well bore to provide geologically persistent fluid isolation concentric cementation to provide (214) cement-like (216) bonding (213) across a sufficient axial length (219) of conduits embedded in (215) or filled within and embedded in (217) cementation with stand-off (211) between conduits and support (212) of said cementation at said subterranean depth (218) adjacent to impermeable strata capping rock, prior to performing said cementation for at least one cement equivalent well barrier element to fluidly seal said capping rock, above a producible zone.

Various embodiments use at least one string of said tools selectively arranged to access, hole-open and/or pass through substantially differing internal diameters or frictional resistance walls (4, 5) of at least one inner conduit and/or at least one surrounding bore to a lower end of a subterranean well.

Various other embodiments provide a testing space for proving an operation of at least one unproven downhole apparatus within an aged geology, during the rig-less abandonment of an aging well to, in use, reallocate operation of said at least one unproven downhole apparatus from unproven to proven operation within a proximally similarly aged geology of the aging well, another aging well, a new well, or a field of wells.

Various related embodiments test an unproven downhole rig-less bore hole opening member driven by hydraulics, explosion, electricity and/or a cable that are deployable through said innermost bore of said aging well during abandonment or suspension of a lower end bore of said aging well, such that said rig-less bore hole opening member opens said innermost bore axially along, and radially into the wall of a surrounding bore, wherein debris (76) from said opening of said innermost bore is disposable and compressible within said lower end of said aging well for cementation and cement bond logging axially above said debris, thus providing a testing space with a proximal geology above said cementation that is comparable to at least one portion of a geology of the aging well, a geology of another aging well, a geology of the new well or a geology of the field of wells.

Other related embodiments provide and use a testing space to empirically measure operating parameters of said at least one unproven downhole apparatus to provide empirical data for adapting or proving said at least one unproven downhole apparatus to, in use, reallocate operation of said at least one unproven downhole apparatus from unproven to proven operation within said geologic testing space for use within a similar geologic environment of said aging well, said another aging well, said new well, or said field of said wells.

Still other various related embodiments of the present invention are described within the features of the claims.

BRIEF DESCRIPTION OF THE DRAWINGS

Preferred embodiments of the invention are described below by way of example only with reference to the accompanying drawings, in which:

FIGS. 1 to 3 depict prior art diagrams of different types of drillings rig operations and FIG. 4 shows a prior art normally unmanned offshore platform while

FIGS. 19 and 19A illustrate embodiments usable to access annuli and/or well bore cementation for the coupling of sensor transducers.

FIG. 20 and FIG. 21 depict abandonment of a subterranean well using methods for concentric cementation, cement bonding and benchmarking, developing, testing and improving new technology using various related methods.

FIGS. 22 to 25 illustrate an embodiment for concentric cementation and bond logging said cementation, while

FIGS. 40 to 41 and 41A depict prior art diagrams and a graph of a slickline cement retainer's deployment and usable diameters of conventional inflatable packer downhole devices.

FIGS. 42 and 43 illustrate an embodiment of a wireline, coiled string or jointed pipe tool string embodiment for cementation, bond logging and access or passage through horizontal or inclined subterranean well bore dissimilar contiguous passageway walls, wherein removal of the debris is not necessary.

FIG. 44 depicts a prior art flexible shaft and boring bit, while FIGS. 45 to 59 depict wireline, coiled string or jointed pipe tool string embodiments usable for concentric cementation, bond logging and access or passage through subterranean well bore dissimilar contiguous passageway walls.

FIGS. 60 and 61 show prior art shaped perforating charge downhole devices.

FIG. 62 shows an embodiment of a shaped charge sculpting circumferential engagement apparatus deployable on wireline, coiled string or jointed pipe to provide access or passage through a subterranean well bore's dissimilar contiguous passageway walls so as to provide concentric cementation and bond logging.

FIGS. 63 to 65 depict rotary cable operations apparatuses of the present inventor usable with the present invention, wherein FIG. 64 shows an embodiment usable with said rotary cable tools.

Figure 1:
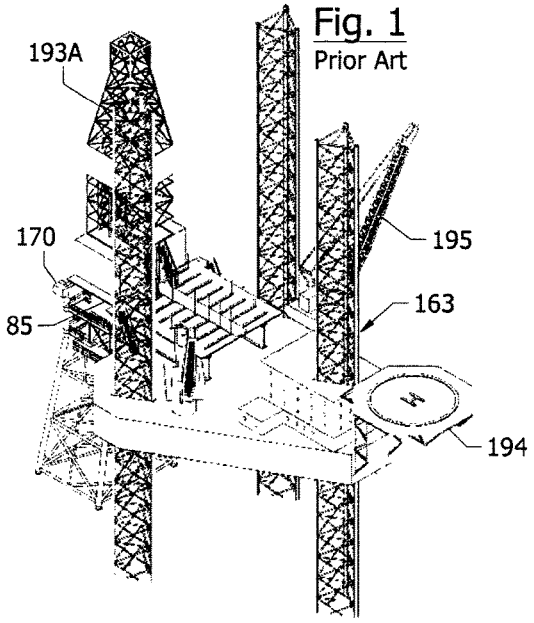
Fig. 1 Prior Art

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein, and that the present invention can be practiced or carried out in various ways. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

It is to be further understood that an interoperability exists between the various described strings, downhole tools and downhole tool members that extends to the surface systems comprising, e.g., rigs, wellheads, valve trees, control and signal processing systems, wherein a string deployed assembly of tools can be selectively arrangeable to provide actuation and a functional synergy between all engaged systems, tools and elements of a well capable of signal conductance and the conversion of mechanical, electrical, explosive and/or hydraulic energy into an associated force, or alternatively to absorb a force and convert it into energy, which in an amalgamation, can be usable to provide the interoperable apparatus (12) and method (1, 19, 42) of the present invention. Actuation of any tool, or function within a string of tools (8), can comprise any manner of interoperability between tools and/or connected surface systems. The selectively arrangeable and selectively actuatable apparatus (12) of the present invention can comprise, e.g., any suitable downhole self-actuating or remotely actuated drive tool (3), a tool, or a tool member that can be usable by the present invention. For example, any of the following can be usable: i) a burst disc comprising, e.g., glass, dissolvable salts, metals, ceramics or plastics; ii) timers comprising, e.g., fuses, clocks or chemical reactions; iii) rotation, tension or compressive forces comprising, e.g., string tension, string weight, sinker bars, jars, string momentum or spudding, rotary speed, rotary torque and/or transducers; iv) fluid pressure comprising, e.g., hydrostatic pressure, differential pressure and/or trapped atmospheric pressure at a subterranean depth; v) temperature comprising, e.g., heating, cooling, super-cooling and/or temperature differentials; vi) chemical reactions comprising, e.g., reagents, swelling, shrinking, explosions, liquefaction, gasification, congealing, and/or dispersing; vii) the transducers comprising, e.g., crystalline materials, ceramics, magnets and/or coils; and viii) signals comprising the transmission of, e.g., electricity, mechanical energy, kinetic energy and/or thermal energy. Interoperability of various connections between apparatus (12), comprising various tools, tool members and strings (8), provide selective arrangement and actuation which can further comprise any type of connector, for example: i) rotary connectors, ii) snap connectors, iii) slip and segmented slip connectors, iv) shear pins connectors, v) springs connectors, vi) joint connectors comprising, e.g., ball joints, knuckle joints, hinge joints and/or flexible material joints, vii) dog or mandrel and their associated receptacle connectors, viii) coupled connectors comprising, e.g., glues, welding and/or spikes, ix) membrane expandable or swellable connectors, and/or x) segmented connectors comprising, e.g., fans, screens and/or baskets. Furthermore, the apparatus (12) of the present invention may be selectively arranged to provide interoperability between surface systems, strings and well elements capable of signal conductance, which can comprise, e.g., i) drilling rig jointed pipe strings, ii) rig-less jointed pipe strings, iii) preferred coiled strings comprising, e.g., coiled tubing strings, electric line strings, slickline strings, iv) tubing, v) casing, vi) cement within the strata, and/or vii) strata about the casing and cement.

It is to be understood that when explaining the various methods (1, 19, 42) embodiments (1A-1A, 19A-19AT, 42A-42AT), an apparatus of at least one string (8) deployed tool string embodiment (8A-8AT), comprising at least a placement tool (2) embodiment (2A-2AT), can be used to place and axially displace (7A-7AT) or pilot tools, including cutting or displacing tools, using a downhole drive tool (3, 3A-3T), wherein the apparatus can be deployable with a string (8), comprising, e.g., slickline, electric line, coiled tubing or jointed pipe, preferably by using a coiled string compatible connector (17). The described arrangement and assembly of tools, which are selectively arrangeable and combinable with any suitable downhole tool at the lower end of the connector (17), can include an amalgamation of tool string embodiments (8A-8AE), with interoperability between the tools, for being usable to urge access or passage through potentially dissimilar (4, 5) contiguous passageway walls (9) of a subterranean wellbore to concentrically place cement and to perform bond logging, both before and after cementation. The measurement before and after placement can comprise disposing a sensor transducer downhole, about cementation, for transmitting a signal through a conductance well element to measure cement bonding or, alternatively, to perform conventional logging or proven cement logging of the primary cementation without inner conduits interference and providing (211-220) of FIG. 15, to ensure cement bond bonding will occur during cementation. Cleaning and cementing circulation to facilitate cement bonding can occur, e.g., about the lower end of the inner bore (9) of a severed or perforated (129) innermost conduit (90, 91, 92, 93) and returned through an intermediate annular passageway (110) of the surrounding bore (10) conduit (91, 92, 93, 94).

FIG. 1, is an isometric view of a prior art jack-up mobile offshore drilling unit (163) with a crane (195), helideck (194) and large scale derrick (193A) over a normally unmanned platform (170) usable to, e.g., support the day-to-day needs of a hundred people while drilling a well kilometers into the subterranean strata. A wellhead (85) would be situated on the normally unmanned platform (170) immediately under the derrick (193A) that has been cantilevered over the platform, once the rig is jacked up. While constructing a well and conducting drilling operations offshore or onshore requires a significant level of resources and associated cost, the abandonment of the same well can require significantly less resources if installed conduits are left within the strata; however, because conventional rig-less methods for meeting various published industry standards for a majority of wells are not suitable, drilling rigs are often used to abandon wells despite their cost.

Embodiments of the present invention for benchmarking, developing, testing and improving new technology are economically viable from a mobile offshore drilling unit (163) and/or other rigs described herein despite their expense if, e.g., such expensive units are being used as an accommodation and/or are idle and the marginal cost of use is low. Additionally, as drilling rigs use electric line and slickline rigs for various tasks, embodiments can be used from a drilling rig where time may be saved. For example, during an abandonment, the embodiment (1AK, 12AK, 19AK) can be used to abandon a subsea well quickly, so that a drilling rig may be demobilized. Thereafter, a boat may be used to access the well, and explosives can be used to severe its upper-end wellhead, thus saving the time of waiting on cement.

Figure 2:
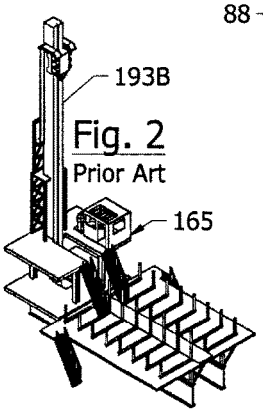
Fig. 2 Prior Art

FIG. 2 is an isometric view of prior art modular Drilling Rig Derrick, Rig Floor and Pipe Rack arrangement (165) without supporting equipment, such as mud pits, pumps, compressors and power generation, with a large hoisting capacity mast (193B) of comparable lifting capacity to a derrick (193A of FIG. 1), usable offshore or onshore. FIG. 2 shows another example of a drilling capable rig, generally over specified for well abandonment, that is difficult to move, erect and operate; hence, it is costly despite a significantly smaller foot print compared full sized drilling rigs (e.g. 163 of FIGS. 1 and 164 of FIG. 3).

Figure 3:
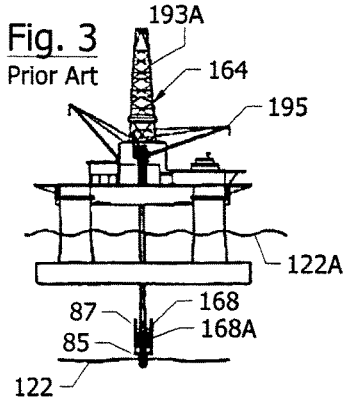
Fig. 3 Prior Art
Figure 26:
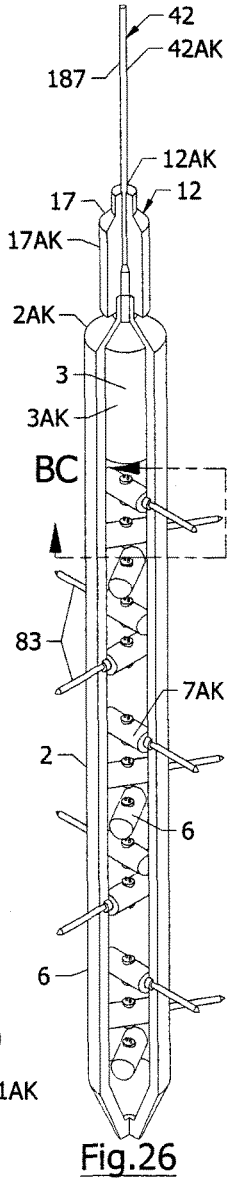

FIG. 3 is an elevation view of prior art Semi-submersible floating Mobile Offshore Drilling Unit (164), with a crane (195) and full size derrick (193A) floating at sea level (122A) over pressure control equipment (168), comprising a subsea blow out preventer (87) engaged to a subsea tree and wellhead (85) at the sea bed (122). Subsea well operations, including abandonment, must account for the hazards and hydrostatic pressure of the ocean fluid column between the seabed (122) and sea level (122A). Additionally, pressure control and the difficulties of operating from a floating vessel and the inherent cost implications may justify, e.g., placing a sacrificial cementing conduit within the well and using an embodiment (e.g. 1AT, 12AT, 19AT of FIG. 35) to abandon a well to consecutively place cement plugs and to avoid waiting on cement or severance of the wellhead, whereby a boat may return and retrieve data from memory tools to determine cement bonding after cement has fully set. Alternatively, the apparatus (12AK) of FIG. 26 and (12T) of FIGS. 73 to 81 may be adapted to put rotary connectors on upper and lower ends for placement between the jointed pipes of a cementing string, wherein flow may occur past the shafts (6) of the axial placement piston members (7AK of FIG. 26) and skates (26T1-26T2 of FIGS. 73 to 81), and wherein membranes (15T of FIGS. 73 to 80) may be sequentially inflated to support cement to allow circulation and placement of cement.

Embodiments of the present invention for benchmarking, developing, testing and improving rig-less subsea operations are possible with pressure control equipment (locatable at 168A), significantly smaller than a drilling rig's subsea equipment (168), but similar to surface equipment (168C and 168D of FIGS. 7 and 9, respectively) adapted for use and deployment subsea, engaged to a subsea tree and wellhead (85), wherein lubricators and wireline are deployed from a boat (201 of FIG. 6) and engaged to the subsea tree and wellhead (85). For rig-less abandonment operations, well barrier elements can be rig-lessly placed through the lubricator (86 of FIGS. 7 and 9) on the boat then lowered and engaged to the subsea tree to perform abandonment operations, after which the wellhead (87) can be severed and recovered to the boat once the ocean floor (122) was isolated from subterranean pressure sources using permanent well barrier elements, e.g. cement.

Figure 4:
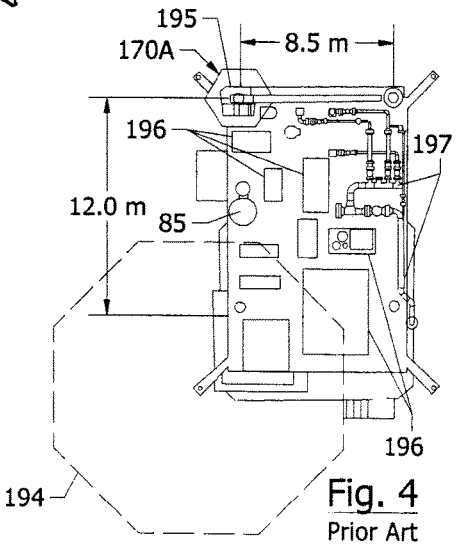
Fig. 4 Prior Art

FIG. 4, a plan view of a prior art normally unmanned wellhead (85) offshore platform (170A), optionally with a helideck (194), shown with dashed lines, for personnel access and a crane (195) for lifting equipment off of a boat (201 of FIG. 6), illustrates the relatively small dimensions of the underlying platform jacket of 8.5 meters by 12 meters. Once various operational production apparatuses (196) and production manifolds and pipework (197) are placed on the platform, there is little remaining room for well intervention and abandonment equipment, hence drilling rigs, despite being over-specified for various required operations as shown in FIG. 1, are sometimes required to provide the necessary space for personnel and equipment. Limited space on such facilities may also prevent the use of rig-less arrangements, such as that shown in FIG. 5, wherein only the lower space requirements of rig-less operations shown in FIGS. 6, 8 and 9 may be possible. Embodiments of the present invention for benchmarking, developing, testing and improving operations are usable with the rig-less operations shown in FIGS. 6, 8 and 9 and, hence, generally economically viable on normally unmanned offshore platforms (170A) during their final abandonment and/or when a well is available and transportation and support costs are within budgetary restrictions.

Figure 5:
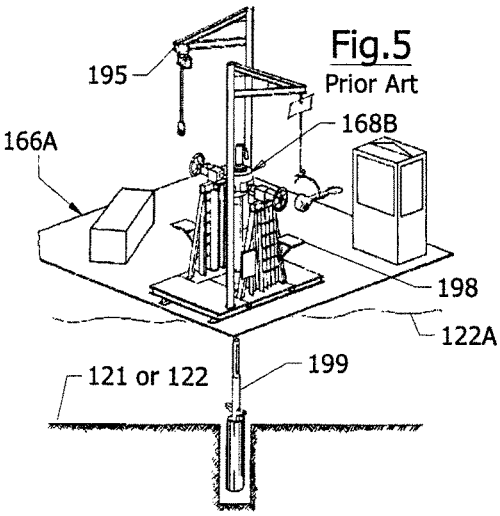
Fig.5 Prior Art

FIG. 5 is an isometric view of a prior art rig-less arrangement (166A), published in U.S. Pat. No. 7,921,918B2, the entirety of which is incorporated herein by reference, with a jib crane (195), pressure control (168B), comprising, e.g., a packing element, and work string (199) or pipe handling (198) equipment. FIG. 5 illustrates a rig-less arrangement designed for operating below ground level (121) or below sea level (122A) and mud line (122). While methods of the present invention are usable with drilling rigs (163, 164 and 165 of FIGS. 1, 3 and 2, respectively) and this rig-less arrangement (166A), the present invention can be usable with rig-less arrangements (166B and 166C of FIGS. 6 and 7, respectively) that are placeable and operable in space-limited environments, wherein this arrangement (166A) may not be viable.

Figure 6:
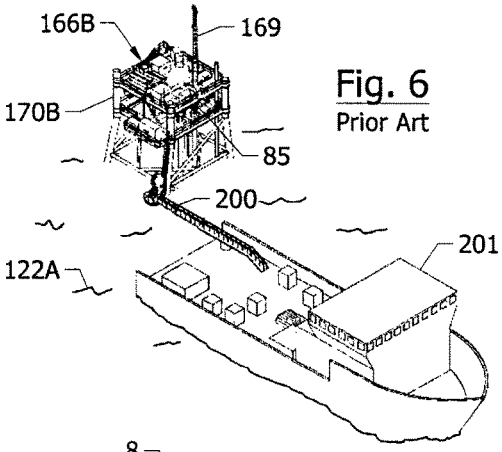
Fig. 6 Prior Art
FIGS. 5 to 7 illustrate different types of prior art rig-less operations.

FIG. 6, an isometric view of a prior art rig-less arrangement (166B) and offshore access system (200) from a boat (201) floating on the ocean surface (122A), illustrates a normally unmanned platform (170B) with a mast (169) for deploying wellhead (85) engaged pressure control equipment (168D of FIG. 9) and cable tool operations, usable when benchmarking, developing, testing and improving new technology.

Figure 7:
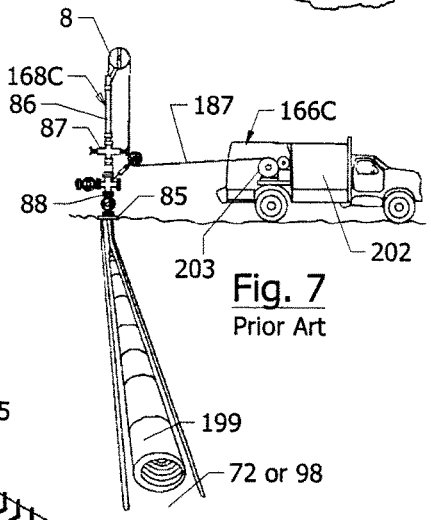
Fig. 7 Prior Art

FIG. 7 is an elevation view of an onshore prior art rig-less arrangement (166C) usable with the embodiments of the present invention to lower the cost and space requirements of abandonment. FIG. 7 depicts a truck (202) with a wireline winch (203) deploying a coiled string (187), comprised of, e.g., coiled wire or coiled tubing, passing through various sheaves and entering a lubricator (86) engaged to blow out preventers (87) further engaged to a valve tree (88) and wellhead (85). A work string (199) is deployed with rotary (72) and/or snap (98) connections at its lower end usable with methods and conventional apparatuses of the present invention when benchmarking, developing, testing and improving new technology.

Figure 8:
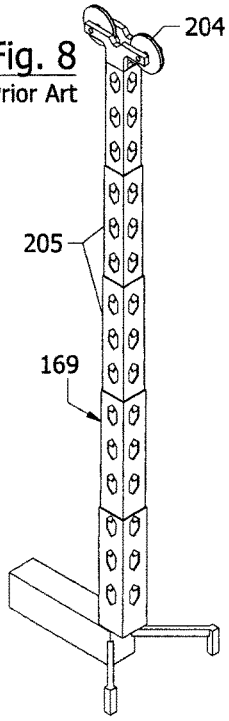
Fig. 8 Prior Art
FIGS. 8 to 9 illustrate prior art equipment usable to perform rig-less operations.
Figure 9:
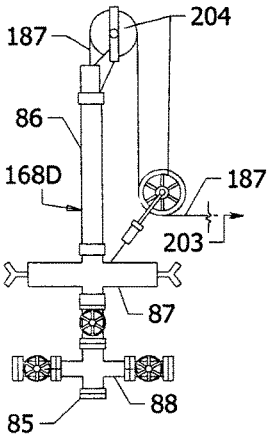
Fig. 9 Prior Art

FIGS. 8 and 9, isometric and elevation views of a prior art mobile wireline mast (169) wireline blow out preventers (BOPs) and lubricator arrangement (168D), respectively, illustrate telescoping mast sections (205) above a base with sheaves (204) at the upper end for cables from a winch is usable to hoist pressure control equipment (168D) for engagement with a wellhead (85). The mast (169) serves a similar function to a derrick (193A of FIGS. 1 and 3, and 193B of FIG. 2), albeit with a significantly reduced lifting capacity suited primarily for lifting pressure control equipment and hoisting a lubricator (86) disconnected and reconnected to a blowout preventer (87) and valve tree (88), so as to engage apparatuses to a coiled string (187) threaded through the lubricator and operated with a winch (203). The pressure in a well is controlled, during intervention or abandonment, by closing the valve tree (88) and BOPs (87) when the lubricator is disconnected for placement and removal of apparatuses from within, after which the lubricator is reconnected and the valve tree and BOPs are opened for deployment on the coiled string (187), sealed at a stuffing box located at the upper end of the lubricator (86), whereby the apparatus may be deployed through the pressure controlled envelope of a well through the wellhead (85) and plurality of installed conduits engaged to and extending downward from the wellhead.

Working within the pressure controlled well bather envelope is advantageous during, e.g., water shut-off, because a kill-weight fluid does not need to be placed within the well to control subterranean pressures, as is typically the case when using the rotary capabilities of drilling rigs. Conversely, embodiments of the present invention enable data collection and improvement usable with associated abandonment methods and conventional apparatuses when performing such rig-less abandonment to benchmark, develop, test and improve new technology applicable to, e.g., electric wireline motors or rotary cable tool methods and apparatuses, deployable through minimalistic pressure control equipment (168D) on a coiled string (187), which consequently removes the need for a kill weight fluid column and the associated equipment necessary to maintain said fluid column holding back, or killing, subterranean pressures. Additionally, skin damage to producible zones is not incurred if the well is not killed with heavy fluids that invade the permeable pore spaces, or skin, of a reservoir during suspension, intervention and abandonment work that is performed through pressure control equipment.

Figure 10:
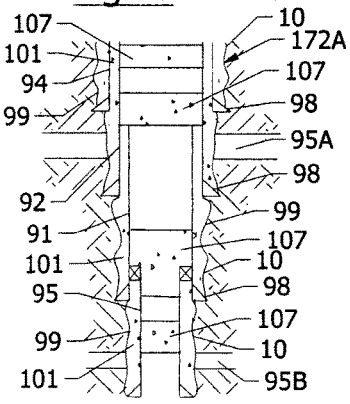
Fig.10 Prior Art
FIG. 10 shows a typical prior art drilling rig well abandonment for comparison to the rig-less abandonment issues and published conventional minimum industry requirements shown in FIGS. 11-15.

FIG. 10, a diagrammatic elevation cross section view through the well and subterranean strata of a prior art Drilling Rig Permanent Well Abandonment (172A), depicts the production tubing removed from the conductor (94), intermediate (92), production (91) and liner (95) well casings cemented to the various diameter cemented strata bores (99), between the lower casing shoes (98) and various subterranean depths, within which cement (107) plugs are placed across the casing (91, 92, 95) cemented (101) within the various associated surrounding well bores (10) to isolate hydrocarbon (95B) and water (95A) producible zones or formation layers within the strata. A portion of the production casing (91) is shown, cut and removed for placement of two of the plugs. As the gauge or diameter of the original strata bore (99) varies between and axially along casing sections, the top of cement behind casing and above a casing shoe (98) is often unknown when, for example, during construction, a casing bond log was not performed and circulating pressures were used to estimate the top of cement. Additionally, due to testing, thermal cycling, overburden stresses and pressures within a well during its operating life cycle, the cement bond behind the casing may have been lost even if it was initially present, thus providing a leak path for subterranean pressurized fluids. Various methods of the present invention are usable to collect data for the emulated removal of the innermost conduits by cutting and compressing conduits and apparatuses for placement of well barrier elements above their compressed remains; after which benchmarking, developing, testing and improving new technology may safely occur with the data of successful work used to replace subsequent compressing and placing of well barrier elements, and wherein any new technology failures may be covered by subsequent compressing and placing of well bather elements.

Figure 15:
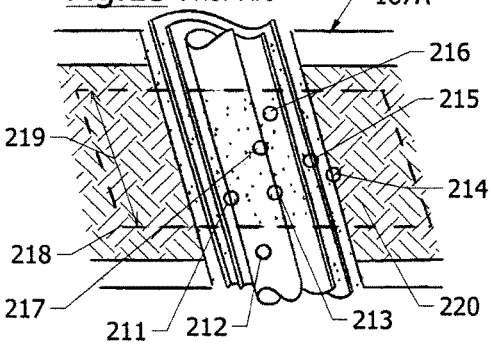
Fig.15 Prior Art
Figure 14:
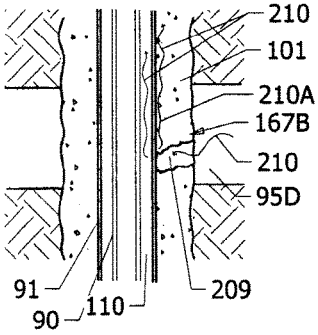
Fig.14 Prior Art

As shown in FIGS. 14 and 15, conduits may be left within a well during abandonment, provided a permanent barrier element, e.g., cement, is placed across the entire strata bore (99). In many cases, the subterranean depths and/or existence of a cement bond behind the various casings is unknown, and a drilling rig must be used to first remove the production tubing to access the production annulus to perform cement bond logging. Conversely, various methods and apparatuses of the present invention can be usable for benchmarking, developing, testing and improving new technology access to these annuli in rig-less operations so that logging may occur to determine the extent of cement bonding behind installed conduits, thus removing the need for a drilling rig.

Figure 11:
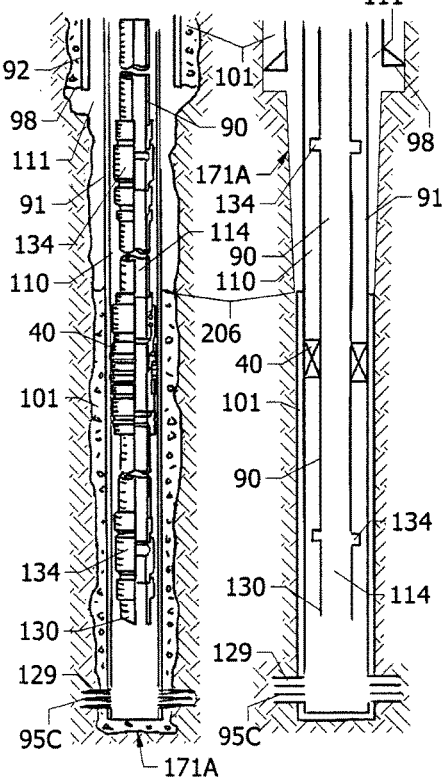
Fig.11 Prior Art
Figure 12:
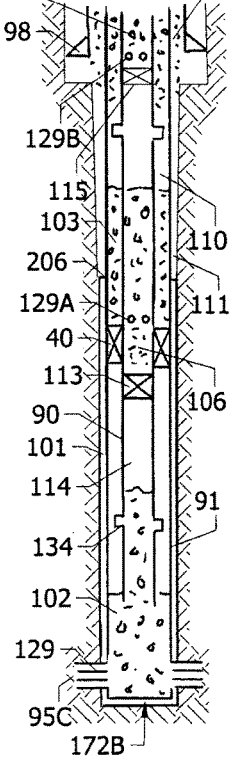
Fig.12 Prior Art

Referring now to FIGS. 11 and 12, a diagrammatic elevation subterranean strata sliced view of before (171A) and after (172B) conventional rig-less permanent abandonment is shown, respectively, wherein the left portion of FIG. 11 shows a half slice through the subterranean strata and well casings, with a quarter section of the completion removed, and the right side of FIG. 11 showing a simplified diagrammatical depiction of the left side, illustrating intermediate casing (92) cemented (101) to a casing shoe (98) with the production casing (91) cemented (101) and penetrated (129) by perforating guns to expose a producible zone (95C). The production conduit or tubing (90) with nipple profiles or receptacles (134) above and below a production packer (40) is engaged to the production casing (91) with a wireline entry guide (130) at its lower end to allow coiled string intervention operations with the perforating gun penetrations (129) within the producible zone (95C).

Conventional rig-less abandonment operations, using installed conduits (90) for placement of cement (102, 103, 104) within the innermost passageway (114), production annulus (110) and intermediate casing annulus (111) suffer from an inability to effectively circulate or support placed cement, wherein cement contamination (105, 106) may occur. In this example abandonment, shown in FIG. 12, cement was bull-headed through the penetrations (129) into the permeable producible zone (95C) until the forces of injection were too high and the cement locked up leaving cement (102) within the tubing (90). A plug (113) was then placed in the tubing (90) below the packer (40), and penetrations (129A) were made to place cement (103) in the innermost bore (114) and production annulus (110). A second plug (115) was set, using coiled string deployment, then the tubing (90) and production (91) conduits were penetrated (129B) to allow cement (104) to be placed in the innermost passageway (114), production annulus (110) and intermediate annulus (111).

As logging of the cement bonds behind the casings (91, 92) is generally not conventionally possible without removal of the tubing and/or other internal conduits, neither the integrity of the cement behind casing or the top of the cement (206) could be confirmed, as required by various published industry standards. While the bullheading of cement to the producible zone (95C) may have been effectively placed, lighter hydrocarbons may subsequently gravitate upwards and cause channels within the cement (102), thus preventing it from being considered a permanent barrier. Cement below the packer (40) and above the plug (113) is likely to have been contaminated (106), albeit such small volumes are unlikely to have caused pressure bearing integrity issues, but placement of cement (103) above the top of cement (206) behind the production casing (91) does not constitute an industry acceptable permanent barrier, because the annuli (111) is uncemented at that point (206). Also, cement (104) placed through penetrations (129) may not have entered the intermediate casing annulus (111) and/or the volumes of fluid below the unsupported cement (104) may be sufficient to cause contamination of the cement (105) as it falls through a lighter fluid.

The inability to confirm the existence of cement, in the locations necessary to form a permanent barrier capable of isolating subterranean pressures from the above ground, ocean environments and/or subterranean water tables for an indefinite period of time is a serious issue to which conventional rig-less abandonment often does not have answers. Even when conventional coiled tubing is used to form a circulation pathway for better placement of cement during prior art rig-less abandonment operations, in conventional practice there are no means for rig-lessly placing logging tools to confirm the existence of a cement bond nor are there any cable compatible prior art conduit milling solutions capable of removing conduits and poor quality cement to expose the subterranean strata, so as to place good quality cement.

Embodiments of the present invention are usable to address the issues of logging cementation in a pressure controlled environment using coiled string operations in an economic manner currently unavailable to practitioners, wherein wells may both be abandoned using a minimum of new technology while using the same or associated wells, e.g., in an abandonment campaign, for the benchmarking, developing, testing and improving new technology in a risk controlled manner.

Figure 13:
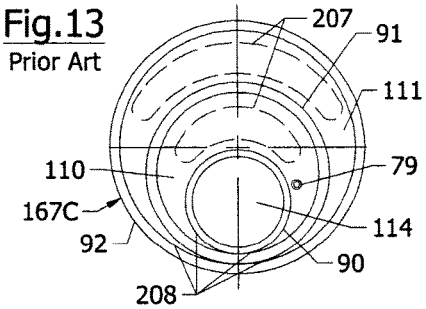
Fig.13 Prior Art

FIG. 13, a plan view of a prior art concept of fluid flow within an eccentric offset conduits arrangement (167C), illustrates, e.g., a production tubing conduit (90) within a production casing conduit (91) within an intermediate casing conduit (92), with a control line (79) within the production annulus (110), wherein the tubing (90) and production casing (91) are eccentric to the centre of the intermediate casing (92). If eccentric conduits are not separated when, e.g., penetrating the conduits and circulating down the innermost production passageway (114) and returning through either the production conduit annulus (110) or intermediate conduit annulus (111), a channel (207) of higher velocity flow will occur through the lowest fluid friction areas that will reduce to a near zero flow rate through the higher friction areas (208) where conduits touch or are closely spaced. Because rig-less abandonment generally uses installed conduits to circulate a permanent well barrier, e.g. cement, into a well, the effect of zero flow in high frictional areas (208) may prevent cleaning of conduits to create a wettable surface and/or placement and bonding of a fluidly circulatable and settable permanent well barrier element, e.g. cement, which may result in a leak path over time, even if the arrangement holds pressure from above initially, as lighter fluids and/or subterranean pressures find their way to the surface, by eroding contaminated or poorly bonded barriers. Another serious leak path issue for rig-less abandonment includes control lines (79) and cables in conventionally inaccessible annuli that may not fill with cement due to, e.g., capillary frictional resistance. As conventional rig-less approaches are not capable of addressing either the eccentricity of conduits or the presence of control lines, drilling rigs are often used to abandon wells.

FIG. 14, a diagrammatic elevation view of the prior art concept of degradation of a well barrier (167B), illustrates poor bonding resulting in a micro annulus (210A) between cement and a conduit or missing (209) cement (101), providing a potential leak path for fluids (210) of a producible zone (95D) that may corrode the casing conduit (91) over time and make their way to the production annulus (110) or travel upwards in the unfilled inner bore, or between the casing (91) and cement (101), if a poor cement bond exists, where they may escape to pollute a surface or ocean environment, potentially causing hazardous conditions for inhabitants. For this reason, conduits and other apparatuses, e.g. mechanical packers and plugs, are not considered permanent barriers as they will corrode over time. Additionally surfaces of conduits and equipment must be clean and wettable to provide a good bond, thus preventing corrosion, and providing a permanent well bather element that retains its pressure bearing capacity indefinitely.

As embodiments of the present invention can be usable to first collect data when rig-lessly abandoning a lower portion of the well by using, e.g., conventional technology, the upper sections of the well, with the problems described above with reference to FIGS. 13 and 14, may be safely used for the benchmarking, developing, testing and improving new technology associated with mitigating the described risks.

FIG. 15 is a diagrammatic elevation view of conventional published industry acceptable minimum rig-less abandonment requirements (167A), showing a paraphrased representation of the Oil and Gas UK Issue 9, January 2009 Guidelines for Suspension and Abandonment of Wells, FIG. 1 entitled 'Permanent Barrier schematic "Restoring the Cap Rock" used within the publication to describe "minimum industry best practices."

Published industry best practice for rig-less placement of a permanent barrier specifies a minimum height of good cement (219), of at least 100 feet, that must be placed at a depth (218) determined by formation impermeability and strength with primary cementation behind casing in place. Pipe circumferential stand-off (211) is required to prevent the channeling (207 of FIG. 13) of high fluid frictional areas (208 of FIG. 13) resulting in poor cleaning, bonding and/or missing cement (209 of FIG. 14). Axial downward cement support (212) is required to prevent cement movement, slumping and gas migration while setting, and with clean water wet surfaces to provide a good bond (213), thus preventing poor bonding and micro annuli (210A of FIG. 14) and leak paths (210 of FIG. 14). Once these minimum requirements are met, the published references generally conclude that a rig-less operation will provide "well barrier elements" of a permanent sealing abandonment plug (216), with the innermost conduits sealed with cement in cement (217) and the casing and tubing embedded in cement (215). Provided that both the existence and sealing bond of primary cementation (214) adjacent to a formation that is impermeable and of adequate strength is present, the resulting cement will contain future pressures (220). While "cement" is specified, the Oil and Gas UK Guidelines also provide for alternative permanent well barrier elements provided they provide an equivalent function to cement.

Meeting industry rig-less abandonment best practice therefore requires logging of the primary well cementation behind casing to ensure its presence and bond followed by cleaning of well conduits to ensure they have wettable surfaces for cement bonding and embedding tubing and casings within cement, by providing offset where necessary over a sufficient portion of the well, opposite an impermeable and strong formation capable of replacing the cap rock.

Unfortunately, while current practice emphasizes the need to design for future abandonment of a well, this was not always the case and few existing wells were designed with rig-less abandonment in mind. For example, production packers may be placed where future abandonment plugs should be placed and the primary cementation may never have been logged. As a result, conventional rig-less abandonment practices are generally unsuited for meeting industry well abandonment best practices, resulting in the use of over specified drilling rigs.

However, embodiments of the present invention are usable to collect data and improve rig-less abandonment of all of or a portion of a subterranean well's annuli and producible zones while meeting published industry best practices such as those described in the referenced Oil and Gas UK Guidelines, NORSOK and Texas Railroad Commission Standards. Meeting industry best practices for abandoning wells requires accessing the annuli of a well in a rig-less manner to perform logging of primary cementation, then remedying any poor primary cementation and placing good cement plugs and/or other suitable permanent abandonment seals within a well.

Referring now to FIGS. 16 to 21 and 36 to 39, these Figures depict a method (42) for providing common initial benchmarking steps for the associated method (1) for concentric cementation and cement bonding, wherein subsequent benchmarking, development, testing and improvement of new technology may also occur, as shown in various diagrammatic process illustrations and cross sectional slices through a well's components and subterranean strata. The Figures illustrates methods (1AF-1AJ, 1AP-1AS, 42AF-42AJ, 42AF-42AJ) and apparatus embodiments usable for concentric cementation and empirically measuring the bonding of cementation about the surrounding bore (10), which are usable for benchmarking, developing, testing and improving new technology during the rig-less abandonment of a well's producible zones, subterranean bores, conduits and annuli through a wellhead (85) engaged to a plurality of conduits comprising: conductor casings (94), intermediate casings (92), a secondary intermediate casing (93) and production casing (91), cemented (101) at their lower ends forming casing shoes (98) within various diameter subterranean strata bores (99), with an innermost conduit or production tubing (90) engaged to the wellhead within the production casing (91) and secured at its lower end with a production packer (40). A liner (95) and liner top packer (40A) can be present in various well configurations, with the liner or casings penetrated (129) by perforating guns or other conventional apparatuses to allow production (34P) from a conduit lined producible zone (95F). Embodiments of the present invention can be usable with a well head (85) that is placeable, e.g., at the mudline (122) if below sea level (122A) or at ground level (121), with production (34P) occurring through the production tubing (90) from an open-hole producible zone (95E). Production (34P) can be controllable with a valve tree (88, 89) using surface valves (64) and/or with a subsurface safety valve (74) and control line (79) engaged to the tubing (90) with clamps below the wellhead (85).

A circulatable (31C) fluid column (31) may be circulated axially downward or upward through the tubing (90) and return or enter, respectively, e.g., through the annulus between the production casing (91) and tubing (90), using, e.g., a sliding side door (123), and through a lower end of the tubing and/or penetrations in the tubing (90) to take fluid circulated returns or to pump a circulatable fluid via an annulus opening (96), annulus opening valve (97) and/or valve tree (88). Circulation of the circulatable fluid column (31C) in any of the annuli may also occur through openings between annuli passageways entering and exiting wellhead annuli openings (96). The circulatable fluid column (31C) may be stagnate, circulated through passageways, or injected into a permeable reservoir (95E, 95F) or fractures (100) in the strata if the pressure exerted by the fluid column is sufficient. The circulatable fluid column (31C) can be usable to place well element barriers, e.g. cement or gradated particle mixtures, or to clean well components to provide a wettable surface (213 of FIG. 15) and/or place rheology controllable and annuli placeable fluid members during rig-less abandonment operations.

Conventional logging generally occurs within the innermost passageway (114) and is unable to determine the state of primary cementation about the casings (91, 92, 93 and 94) because logging tools within the production conduit (90) cannot contact the casings or accurately pass signals through intermediate conduits and annuli to measure cement bonding. Methods (1, 42) and interoperable apparatus (12) of a tool (2, 3, 83, 184, 185) string (8) assembly of the present invention are usable to couple sensor transducers to casings and transmit signals or to remove intervening conduits to access casings to determine whether cement bonding exists. Various embodiments of the present invention use methods of the present inventor, e.g. an annular piston, that are usable to access bores and annuli for placement of logging tool members to confirm primary cementation adjacent to conduits (214 of FIG. 15). Signals may, e.g., be broadcast from the logging tool with reflected signals collected by a different portion of the logging tool, or signals (84, 173A, 173B) may be passed between axially distal points along a well bore using tools coupled to the surrounding bore of a signal conductance well element or between the wellhead, surface or subsea location and a downhole point in the well bore using transmitters and receivers. Using embodiments (1) of the present invention, measurement signals can be coupled with the circumference of the conduit walls to provide sonic, acoustic or various other signals forms or ultrasonic waves for measuring, e.g., the response time of signals passing through bonded (216 of FIG. 15) and un-bonded (209 of FIG. 13, 210A of FIG. 14) conduit cementation to measure the degree of bonding and/or cementation. The process may be visualized as ringing or pinging a glass and measuring the sound, vibration or mechanical wave transmitted through a signal conductance well element, received and analysed against the original signal to determine if the glass is free standing within a liquid or tightly cemented in place.

The present method (42) for benchmarking, testing, developing and proving new technologies is useful for cement bond logging because, e.g., conventional acoustic bond logs measure the loss of acoustic energy, as it propagates through casing, or the impedance to a logging signal's transmission, wherein a number of factors may affect the measurement, including the aged geology about the surrounding bore. This loss of energy is related to the fraction of the casing perimeter covered by, e.g., cement or a cement equivalent material.

Conventionally, acoustic signal cement logs are used to evaluate cement-like bonding behind casing, wherein various commercial materials and/or natural strata formations, e.g. shale, may be suitable if they are bonded to the casing. Two general conventional classes of sonic logging tools exist: i) sonic casing bond logs (CBLs) and variable-density log (VDL) or segmented bond tool (SBT), and ii) ultrasonic imaging tool (USIT). Off-the-shelf USIT logging tools generally provide a high-resolution 360 degree scan of the condition of the casing-to-cement bond, while conventional CBL/VDL logging tools generally provide an average volumetric assessment of the cement in the casing-to-formation annular space. SBT is a combination of CBL, VDL and pad sonic devices that provides a low-resolution map of the cement condition behind casing, whereby the use of pads can be similar to the present inventions spiked arrangements of FIGS. 22-34 and FIGS. 83 88, wherein the impedance measurement of signals, passed between phased deployed spike couplings, radially deployed knifed-edge couplings and/or skate couplings, can be used to measure cement bonding. Alternatively, CBL/VDL or USIT arrangements can be usable by the present invention in, e.g., the arrangement of FIG. 35 or as part of a skated arrangement like that of FIGS. 82 to 88.

While many factors may affect the response of cement-like bond-logging tool signals, the factors are generally broken into three categories, comprising: i) factors that are controllable during running the logging tool, ii) factors that are controllable during cementation, and iii) factors that are constraints imposed by the wellbore or formation about the outermost surrounding bore.

With regard to controllable factors during logging, a microannulus is conventionally defined as a very small (approximately 0.01 to 0.1 mm) annular gap between a casing and a cement sheath. All conventional cement logs are sensitive to microannuli to varying degrees, wherein microannuli may be caused by temperature, drilling mud-cake deposits, pipe coatings, and/or geologic constraining forces. A common practice is to place approximately 1,000 to 1,500 psi pressure on a casing to close a microannulus during conventional logging, wherein the gap forming microannuli affects ultrasonic tools much less than the CBL/VDL and SBT (pads) when the gap contains liquid. The opposite occurs when the gap is filled with gas.

Generally, conventional logging tools are run or moved along the surrounding bore portion being measured and then removed from the wellbore without damage to the casing. As the casing is of no further use and represents a risk of leakage about its walls, whereby they may need to be perforated to be repaired during abandonment, there are few issues with damaging the surrounding bore's casing wall. Hence, the present invention may penetrate the surrounding bore wall without significant consequence, provided that it is done so through, e.g., a slickline well control lubricator and BOP. Accordingly, the present invention provides significant improvements over conventional and prior art logging tools by cutting and coupling to conduits within the wellbore because said coupling is less sensitive to a microannulus. Additionally, while microannuli may not represent a risk during the initial phases of well life, said microannuli can represent a leak path, and if they have not been closed over the life of a well by a sealing material, e.g. barite sag of the drilling mud used to bore the well, the microannuli can represent a serious concern, particularly if not sealed. Hence, the present invention offers significant improvements by, e.g., permanently disposing a logging tool downhole to measure cementation after placement to ensure microannuli have been sealed.

With regard to controllable factors during logging and cementation, it is difficult to predict the exact cement-like bond status behind casing if conduits are eccentralized, as described in FIG. 13. The most likely outcome is that there is no cement at the low side where the distance between casing and formation face is small (208 of FIG. 13). Direct casing contact with the formation is indicated by the presence of galaxy patterns on the USIT log, and the CBL/VDL and SBT (pads) logs may detect fast formation arrivals. Conventional practice can be adapted to, e.g., account for geologic persistent sealing of shale formations about a conduit. Hence, benchmarking, testing, developing and proving the present invention's logging tools, at an aged geology, through comparison to conventional practice is important for proving the present invention.

The conventional practice is to centralize conventional USIT and CBL/VDL tools, while the SBT pads, with their articulated arms, are relatively unaffected by centralization, albeit the CBL/VDL part of the tools is affected negatively. Additionally, centralizers attached to the conventional logging tools must allow for smooth and even tool movement, wherein as the number of centralizers increases, the risk of jerky, erratic tool movement and acoustic noise, within the logging signal, increases.

Furthermore, while microannuli represent a risk to conventional logging tool cement bond logging measurements, the existence of a large annulus and/or eccentric annulus (110, 111 of FIG. 13), filled with liquid or gas, prevents any meaningful data during acoustic logging because tools cannot be centralized relative to the surrounding bore and acoustic energy cannot be propagated through said large annuli, sufficiently, to provide a reliable log measurement.

Accordingly, the present invention provides significant improvement over prior art and conventional logging by, for example, centralizing a logging tool and at least one inner conduit within the surrounding bore, and penetratingly coupling the logging to the inner conduits and surrounding bore can provide a direct logging signal transmission path with a measurable and/or controllable impedance, as a spike or a knife coupling engagement may be designed to, e.g., minimize coupling to the inner conduits with an arrowhead or spear-like penetrating shape, ahead of a smaller diameter shaft that couples only to the bore that the arrowhead or spear point penetrates, with fluid about the smaller diameter shaft that is within the larger penetration made by the larger diameter arrowhead or spear point.

Formations with very high velocity and short transit time are called "fast formations." Acoustic signals from anhydrites, low porosity limestone, and dolomites often reach the conventional logging receiver ahead of the pipe signal. While signal amplitudes may be high, they may not be as high as a free pipe value and conventional logs may still be usable, but impaired. Fast formations affect the CBL/VDLs and SBT logs but do not affect USIT interpretation because the measurement principle is different. If there are fast-formation signals present, it is assumed that the CBL/VDL cannot be interpreted, though the arrival of the fast-formation signals suggests that the cement-to-formation bond is present.

The present invention provides significant benefit over prior art through the use of benchmarking, testing, developing and improving in fast formation aged geologies, wherein data may still be calibrated via conventional logging and penetrating couplers, e.g. like the example spikes and knife blade arrangements illustrated herein, may be used to penetrate casing conduits, cement, and strata with a wellbore to isolate strata from the measurement by, e.g., using a cushioned arrowhead or a spear point smaller than a defined length of shaft, wherein the signal wave, being transferred between the spike or knife, physically arrives at the casing conduit before it arrives at the cushioned arrowhead or spear within the strata.

Cement bond evaluation generally relies on a contrast in the acoustic properties of the cement and liquid. The higher the contrast between liquid and hardened cement, the easier the log is to interpret. The acoustic properties of set lightweight cement are close to those of cement slurry, making them difficult to distinguish. Lightweight slurries may also use hollow ceramic microspheres, nitrogen, and other low-specific-gravity materials to achieve a light density while providing good compressive strength. These cements are commonly expensive and used in areas of weak formations, which eliminates them from use in many well abandonments, but may be useful in some instances. Additionally, rheological fluid and cementation slurries of the cited inventions of the present invention may, like some lighter weight cements, be acceptable for abandoning portions of a well, albeit undetectably so using conventional logging tools. Accordingly benchmarking, testing, developing and improving such rheological fluid cementing technologies may provide further measurable significant improvements in well abandonment.

An important consideration in cement bond logging of abandonment cementation is the length of time to wait for cement slurry solidification before running the bond log across, e.g., squeezed cement perforations (FIG. 19A) when cement has been cleared from the well bore with a packer.

If the bond log is run before the cement is fully set, a pessimistic interpretation will result, possibly followed by an unnecessary further squeeze operation.

The hardening time of cement slurries depends on their type and formulation, the downhole temperature profile and pressure conditions, and the degree of contamination. Increasing levels of contamination from, e.g. drilling mud or water, lengthen hardening time, lower the ultimate compressive strength, and reduce cement impedance value, hindering cement log interpretation.

During most drilling rig well abandonments, the cement near the top of the cement column may not develop the same compressive strength as cement near the bottom of the well. The U.S. Environmental Protection Agency (EPA), charged with protecting potable-water sources in the U.S., recommends letting the cement cure for 72 hours before logging; however, to reach maximum compressive strength, the curing of the cement may require 7 to 10 days.

Accordingly, the present invention provides significant improvement upon rig abandonments by using a substantially lower cost set of resources, which are substantially easier and quicker to rig up and rig down, to provide sufficient hardening time and thus eliminate the need for an expensive rig to unnecessarily sit idle while waiting on cement (WOC).

Various industry tests have been carried out on the permanent sealing properties of collapsed formations around a well casing. Presently, various successful tests have been carried out on certain shale formations, wherein the collapse of said shale was impermeable, long term, non-shrinking, ductile, chemically resistance and wettable, i.e. equivalent to conventional cement. For a shale to qualify as a permanent barrier, you must prove the formation has collapsed all around the casing over a sufficient interval, e.g., 50 m, and has a high enough formation strength to avoid upward fracture propagation. Generally, logging signal measurements must correspond with the stiffness of the annular material, wherein the acoustic impedance of annular material must be "calibrated" for the response required for a shale annular barrier. The ability to empirically measure and qualify a shale as a permanent barrier could significantly affect well abandonment worldwide, especially with regard to shale gas deposits and the risks of contaminating ground water formations or other permeable formations.

Accordingly, the method and apparatus of the present invention, usable for performing, benchmarking, testing, developing and proving of both well abandonment apparatus, logging tools and logging signals relative to an aging geology, may significantly affect cement bond logging operations worldwide.

Dependent on the result of the logging measurements, various associated rig-less abandonment members are usable to place temporary or permanent well barrier elements within the well at the appropriate subterranean depths (218-219) to meet industry best practices (211-220 of FIG. 15) and to avoid potential future leak paths (210 of FIG. 14, 208 of FIG. 13) and/or to simulate a rig abandonment (172A of FIG. 10) by placing cement plugs (107 of FIG. 10) across casings (91, 92 and 95 of FIG. 10). Additionally, embodiments described herein can be cable string compatible and can be usable with either the rig-less arrangement of FIG. 5 or the minimalistic pressure controlled arrangements of FIGS. 6 to 9, to meet published best practices (211-220 of FIG. 15) for permanently abandoning a subterranean well in a rig-less manner.

Various methods (1) and placement tools (2), e.g. those shown in FIG. 20, are usable with various associated methods and members, e.g. those shown in FIG. 21, comprising, e.g., rheology controllable and annuli placeable fluids and swellable expandable mesh membrane members, which can be usable to temporarily restore sufficient fluid pressure integrity by bridging across fluid leaks to use the circulatable fluid column (31C) to provide sufficient cement (219 of FIG. 15) at suitable permanent barrier depths (218 of FIG. 15) to contain future pressures (220 of FIG. 15). Annular separating members can be usable to provide circumferential standoff (211 of FIG. 15) for cleanable water wettable surfaces, which provide good bonding (213 of FIG. 15) during circulation of the fluid column (31C) and embedding of the conduits in cement (215 and 217 of FIG. 15), so as to provide a sealing permanent abandonment plug (216 of FIG. 15) according to published industry guidelines.

Various associated methods and members, e.g., axially slideable annular blockage bypass, annulus guiding, annulus boring access and boring bit engagable conduit members, can be deployable with placement tools (2) usable to embed casing (91, 92, 93, 94, 95) and tubing (90) in cement (215 of FIG. 15) with the tubing and casings being filled and surrounded providing, cement in cement (217 of FIG. 15) conduits, using a bypassing arrangement around blockages in an annular space, e.g. a production packer, and by boring into annuli to create a logging space and fluid circulation path usable with logging tool members and the circulatable fluid column in bores and annuli of the well, at selected depths (218 of FIG. 15), to provide sufficient cement (219 of FIG. 15) adjacent to a primary cement barrier bonded between the outer casings (91, 92, 93 and 94) and an impermeable formation of sufficient strength to contain future pressures (220 of FIG. 15), thus providing a sealing permanent well barrier element (216 of FIG. 15) according to published industry guidelines.

Other various associated methods and members, e.g., annular piston, jarring, circumferential shredding and milling and axial movable screw or tractor members, can be usable with placement tool (2) strings (8) to simulate a rig abandonment (172A of FIG. 10) by compressing, milling and/or shredding of conduits within casings (91, 92 and 95 of FIG. 10) to remove the conduits within a barrier's height (219 of FIG. 15) at the necessary barrier depth (218 of FIG. 15), across from a strong impermeable formation (220 of FIG. 15), to provide permanent abandonment cement plugs (216 of FIG. 15) across casings (91, 92 and 95 of FIG. 10) according to published industry guidelines.

Still other various associated methods and members, e.g., rheology controllable and annuli placeable fluids and annular piston members can be usable for supporting well bather elements, e.g. cement, to avoid settable barrier movement, slumping and/or gas migration, while setting (212 of FIG. 15), to provide a good bond and to ensure sufficient cement (219 of FIG. 15) at a depth (218 of FIG. 15) adjacent to an impermeable strong formation (220 of FIG. 15) to provide permanent abandonment cement plugs (216 of FIG. 15) according to published industry guidelines.

Figure 16:
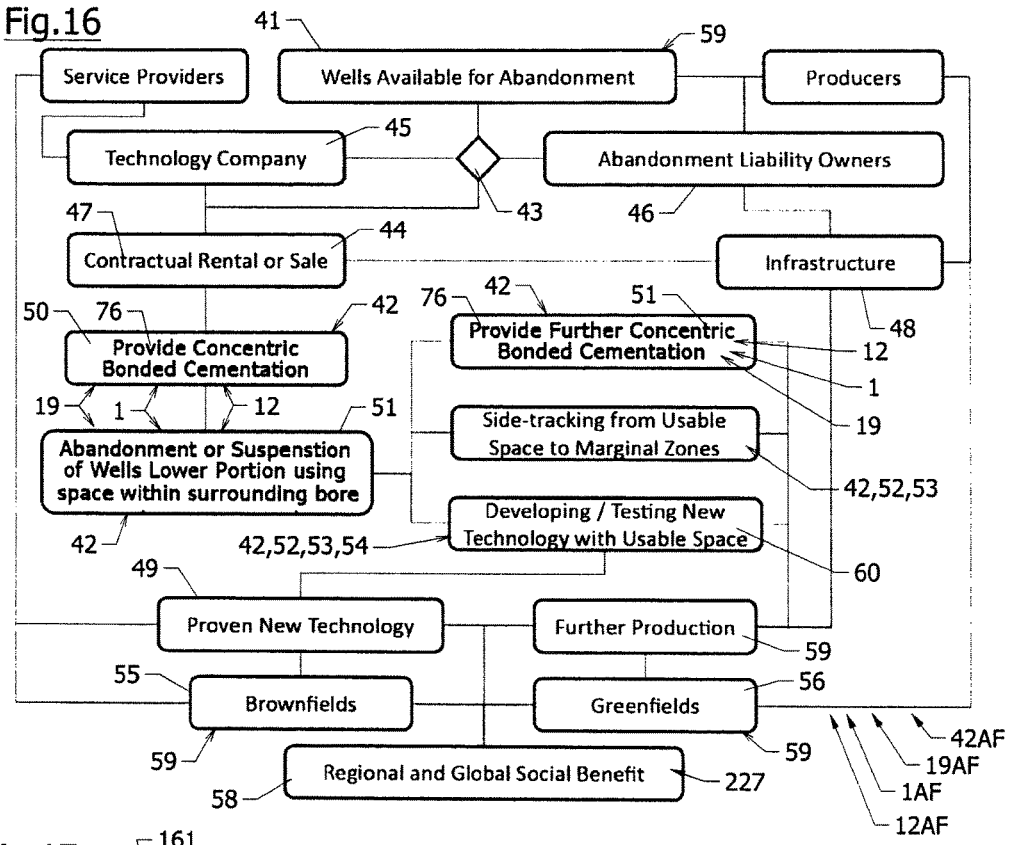
FIG. 16 depicts an embodiment of a testing space system usable with other embodiments of the present invention.

Referring now to FIG. 16, the Figure depicts a flow chart of an embodiment (42AF) of a testing space system (42), usable with embodiments (1AF, 19AF) of method (1, 19) and embodiments (12AF) of apparatus (12) comprising a tool string deployed placement tool (2) embodiment (2AF) of the present invention, showing the identification of wells available for abandonment (41) and consummation of an agreement (43) representing, for example, a contractual rental or sale agreement (44) between a technology (45) and abandonment liability owner (46) for space usage rights (47), and optionally infrastructure usage rights (48), for the purposes of forming a geologic testing space for proving the operation of an unproven downhole apparatus (49, 50) and/or providing further production (57) through, e.g., side-tracking within an aged geology, during the rig-less abandonment of an aging well.

A space provision system can be usable to compress well apparatus and debris (76) with a compression device (50) for forming a usable geologic space for placement of an abandonment plug (51), to satisfy an abandonment liability and provide integrity for developing new technology (49), for example further space formation devices (50), to reduce the resources required for abandonment, or side-tracking drilling (52) and milling assemblies (53) or hydrodynamic bearings (54) to, for example, more effectively exploit Brownfields (55) and Greenfields (56) with less resources, to the benefit an embodiment (227) of the regional and global private and public benefit (58).

Empirical measurements (60) may be taken with logging tools or a transponder may be placed in a protective shock absorbent housing (66 of FIG. 22) to provide empirical data to design, redesign, test and field prove new technology (49) in the development of Greenfield (56) and Brownfield (55) wells (59). Various technologies described in the present invention and in the following: UK Patent numbers GB2465478, GB2466376, GB2475626, GB2471385, GB2471760, GB2476381, GB2479432, GB2486592; and UK patent application publication numbers GB2479043 GB2483675, GB2484166, GB2486591, GB2486592, GB2487274; and UK patent application numbers GB1116098.3, GB1203649.7, entitled "High Pressure Large Bore Well Conduit System," filed 1 Mar. 2012, and GB1212008.5, as well as the associated PCT patent applications, may be tested in part and further developed with the present testing space provision system. While new technology of the present invention is emphasised, virtually any downhole technology that will fit through the bore of the well (59) may be tested and field proven, subject to the resources available. Hence, the present testing space formation system can be further usable to create a market for testing and field proving the new technology, wherein said usable space becomes a tradable product.

The resource cost of drilling rig (193A of FIGS. 1 and 3 and 193B of FIG. 2) and even some rig-less operations (166A, 166B and 166C of FIGS. 5, 6 and 7, respectively) is, generally, such that a usable space for testing and field proving of downhole tools, deployable within the realistic environments provided during the abandonment of wells (59) and with significantly less resource intensive rig-less jointed pipe (166A of FIG. 5) and coiled string operations, represents a significant improvement in the development of new technology and hence is marketable. For example, a company owning the usage right for the usable space formed during the abandonment may offer to test and field prove technologies in exchange for a participating ownership in such technologies or for monetary gain.

Given the relatively low capital investments required for rig-less abandonment, the present space provision system represents a new technology requiring minimalistic resources, and the lack of competitive forces in the present oligopolistic service provider market. Well abandonment represents a significant resource cost to liability owners and an opportunity for new technology companies to compete with the goliath service providers who domination the market. Alternatively, the ownership of minimalistic resources and the opportunity to test new technologies with one of said goliath service providers will force competition in a relatively uncompetitive oligopolistic market, compared to the 1970's and early 1980's. Particularly, 75% of said oligopolistic market is controlled by four service providers, as reported by the Wall Street Journal on the 19th of Oct. 2010. According to economic theory, oligopolistic market places produce until marginal revenue is equal to marginal cost to receive a portion of the economic rent allocated to public's benefit within a purely competitive marketplace. Oligopolistic service providers naturally seek to maintain high entry barriers into a market place dominated by technology by controlling said technology development. In all cases, the proving of new technology to increase competition and the use of fewer resources provides significant benefit to all regions and our global society (58) facing peak oil and dramatic liquid hydrocarbon price increases, because said resources may be reallocated to Brownfield (55) and Greenfield (56) developments, particularly new and/or side-tracked wells (59), needed to limit said dramatic liquid hydrocarbon price increases associated with peak oil.

Figure 17:
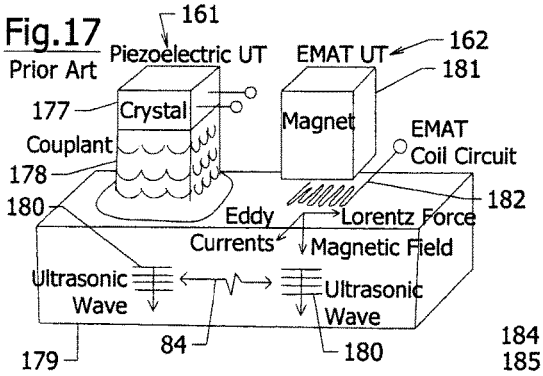
Fig.17 Prior Art
FIG. 17 shows an explanation of prior art piezoelectric and electromagnetic sensor transducer arrangements for providing signals within well conduits or strings.
Figure 18:
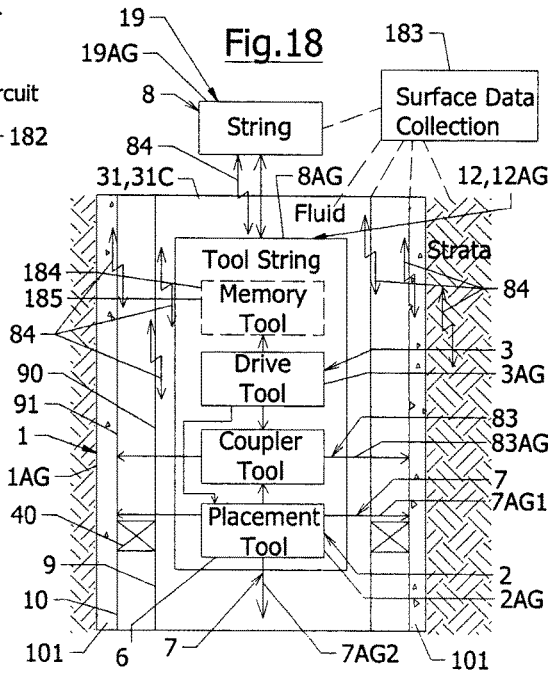
FIG. 18 is a diagrammatic representation of a preferred embodiment of the present invention.

Referring now to FIGS. 17 and 18, the Figures show an isometric view and diagrammatic view, respectively, of a comparison between piezoelectric (161) and electromagnetic acoustic transducers (EMAT, 162) sensor transponders and the method (1, 19) embodiments (1AG, 19AG) and apparatus (12) embodiments (12AG) of the present invention comprising an embodiment (2AG) of a tool string deployed placement tool (2), usable with various other embodiments of the present invention, for the coupling of a signal source to at least one conductance well element, comprising a deployment string (8, 8AG) and using at least one inner conduit (90) for deployment of a fluid column (31) that may be circulated (31C), if severed or perforated, to concentrically cement within one of the many surrounding bores (10), comprising a cement casing bore or strata bore depending on the existence of cement bonding. A sensor (161, 162) may be coupled to the surrounding bore (10), through the innermost bore (9), via a coupler tool (83, 83AG), to provide a repeatable signal (84) for empirically measuring cement bond logging before and after placement about said surrounding bore and conduits within.

Generally, a gauge (161, 162), or gage (161, 162), is conventionally defined as a device for determining or measuring a relative physical property which includes, for example, a sensor device (161, 162) that senses either the absolute value or the relative change in a physical quantity, wherein a transducer (161, 162) is a special form of sensor that converts an input signal (84) into an output signal (84) of a different form comprising, for example, a microphone which converts acoustic sound waves into electrical signals. As any form of gauge, sensor, transducer or microphone (161, 162) is usable with the present invention, the terms are used interchangeably, herein. A member of a coupler tool (e.g. 83 of FIGS. 18 to 21), placeable with a placement tool (2 of FIGS. 18 to 21), can be usable to couple the gauge/sensor/transducer/microphone to a signal conductor or conductance well element (e.g. 8, 31 and 90 to 94 of FIGS. 36 to 39) to send a signal powered by a drive tool (3 of FIGS. 18 to 21), for operating the placement tool (2) and coupler tool (83) during data collection.

Data collection may comprise placing a signal (84) through a conductance well element (179) from a sensor (e.g. 161) to an associated sensor (162), which stores the signal as a memory tool, wherein any form of downhole measurement can be usable for cement bond logging, and/or using or providing a geologic testing space, and/or proving the operation of an unproven downhole apparatus (49, 50 of FIG. 16), and/or providing further information for adaptation of method or apparatus to increase production (57 of FIG. 16) through, e.g., side-tracking within an aged geology, during a rig-less abandonment of an aging well.

Any form of sensor transponder can be usable with embodiments herein, with acoustic sensors being conventionally prevalent for liquid and mechanical waves, including: i) transducer or hydrophone pressure sensors or transducers; ii) capacitive condenser transducers fabricated of silicon diaphragms that convert the acoustic pressure of an acoustic waveform; iii) fibre-optic transducers, which are preferable where capacitive measurements are impossible; iv) interferometer and reflective plate diaphragms; v) piezoelectric transducers using a piezoelectric crystal as a direct converter of mechanical stress to electric charge and/or piezoceramics, which may be preferred in various instances for their higher frequencies; vii) electret transducer using a permanently electrically polarized crystalline dielectric material; and viii) electromagnetic acoustic transducers.

Any type of gauge, sensor transducer or microphone can be usable by the present invention to measure and/or detect a huge variety of conditions including, for example: temperature, pressure, level, humidity, speed, motion, distance, light and/or the presence/absence of a condition or material, e.g. cement bonding. There are many versions of each type, which may use different sensing principles and/or may be designed to operate within different downhole environmental ranges.

Without restriction, any combination and/or type of gauge, sensor, transducer, or microphone, which is suitable for receiving or transmitting a signal downhole and made of any type of material suitable for downhole operations or engagement to an above strata or below sea level signal conductance well element, within a well bore and comprising, for example, a tool string, production tubing, casing, a column of fluid contained and/or the strata within or about the well bore and associated strata or fluid surrounding a well bore, can be usable by the present invention to transmit and receive signal data that is analysed to empirically measure a feature or condition within a well bore. All downhole data, which can affect past or future cement placement, cement bonding, well bore abandonment, well bore suspension or well bore side-tracking for efficiently using existing technology or proving the operation of new technology, is preferable.

Sensors may comprise, for example, a piezoelectric sensor (161) comprising a device that uses the piezoelectric effect to measure pressure, acceleration, strain or force by converting them to an electrical charge. In addition, sensors can comprise a piezoelectric transducer (161) comprising a device which transforms one type of energy to another by taking advantage of the piezoelectric properties of certain crystals (177) or other materials coupled via a couplant (178) or a conductance well element (179) to place an ultrasonic wave (180) therein. An associated sensor or transponder (e.g. 162) can receive the signal and empirically measure the received signal against the placed signal to determine a control message that is being passed by the signal (84) and/or the properties of the material being empirically measured, if said material properties are not already known, e.g. when transmitting through a known string carrying a tool assembly. When a piezoelectric material (177) is subjected to stress or force, transferred from the conductance well element (179) by the couplant (178), it generates an electrical potential or voltage proportional to the magnitude of the force, which makes a piezoelectric sensor or transducer ideal as a converter between mechanical energy or force and an electrical signal. The relatively high sensitivity of piezoelectric material (177) makes it useful in applications requiring the precise sensing of motion or force.

Alternatively, an electromagnetic acoustic transducer (162), conventionally termed EMAT, is a transducer for non-contact sound generation and reception using electromagnetic mechanisms, generally used as an ultrasonic (180) non-destructive testing (NDT) method, which does not require contact or a couplant (178). This is due to the sound being directly generated within the material adjacent to the transducer, which generally comprises a magnet (181) and EMAT coil circuit (182) that produce a magnetic field, with eddy currents and a Lorentz force within the conductance well element (179). Compared to a piezoelectric transducer, the electromagnetic acoustic transducer (162) is more versatile and has a generally lower cost; however, its power requirements are significant, whereby alternating current power is conventionally preferred, but direct current types do exist.

A signal (84) generally comprises, for example, acoustic or longitudinal mechanical waves created by alternate compression and expansion of solids, liquids or gases at certain frequencies, wherein longitudinal mechanical waves oscillate in the direction of wave propagation.

Any type or variation of signal type or wave form transmitted in any amplitude or wave height, frequency or number of waves or cycles per period of time, wavelength or length of the wave from crest to crest, phase or the starting point of each wave cycle, can be usable with the present invention. Signals that have a time domain or change with time or have a spectrum of frequencies and/or Fourier signals without overlap in either the time-domain or the frequency-domain, using any signal processing algorithms that use any number of mathematical operations to perform operations slowly or quickly and repeatedly on a set of data, can be usable by the present invention. Any signal (84) architecture and/or processor optimized specifically for jitter and skew of a signal or a signal's spread spectrum and frequency domain, wherein time and frequency domain measurements may not be compliments of each other in practice, can be usable by the present invention. Signal (84) transmission and reception between a plurality of sensors or transducers, which can occur in any order or sequence between constant, random and/or sequenced sensor or transducer locations using various amplitudes, frequencies, wavelengths or phasing, can be usable by the present invention.

Various technologies (183 of FIG. 18) can be usable with the present invention for generating, transmitting, collecting and processing downhole signals and associated data using wired and/or wireless telemetry through various well conducive well elements comprising, for example, an electric line cable, slickline cable, drill pipe, a fluid column, tubing, casing and/or the strata. Wireless wellbore data communications and sensing systems are usable to communicate signals through, e.g., a rotary string or the production tubing using, e.g., signal stress waves transmitted and received between downhole and surface (183) and/or a memory tool (184) which can be placed downhole for subsequent transmissions or as a memory tool (185) ultimately retrieved to surface. Information may be transmitted at any programmed interval, which may be programmed before tools are placed downhole or programmed via command signals and internal logic circuits.

A downhole wireless measurement and data collection system may comprise, for example, tools used to place wireless transmissions into a conductor or receive a signal and place it into, for example, a memory tool. They may also include a drive tool such as a battery, power generation turbine, power management system and/or microprocessor control system for operating the sending, receiving, measuring and storing of data. An associated surface data collection system located proximally to the wellhead may comprise a detection and transmission module and a surface supervisory control and acquisition box engaged the string, well fluid column and/or well casings for data acquisition and processing.

A drive tool (3) may drive a placement tool (2) for placing the sensor member (161, 162) of a coupling tool (83), coupled to a signal (84) conductor (179). For example, a wired or wireless gauge hardware coupling tool, creating acoustic signals from electrical pulses generated by the electronics drive tool system after the sensor member is placed and coupled, can be usable to digitize information. The acoustic waves may be engaged, for example, via a penetrating spike through the production tubing, used as a signal conductor to surface, to minimize energy losses via its tight fit between the acoustic generator placing tool and the production tubing. The mechanical waves traveling up the tubing to the surface are, generally, immune to losses related to tubing couplings, threads and fluids within the annulus, provided that the tubing is continuous and concentric within the surrounding bore of the casing.

Various electronic members of a control or drive tool (3) can be usable for process control, data acquisition, data processing, data encoding, command decoding and operational interfaces, wherein power generation and/or power saver modes may be present to conserve power while in the wellbore.

Various electronics members can be usable to sample and digitize information from the gauge members of a signal placement tool at specific time intervals, which can be programmed before a drive tool is deployed inside the wellbore. The data can be processed and encoded for transmission to minimize the number of bits of data required to be sent to the surface. A microprocessor may generate the electrical pulses used to drive the acoustic generator member of the signal placement tool to produce the information related cement bonding and other information, for example, pressure and temperature data obtained inside the wellbore. Once information is transmitted to memory or surface, the microprocessor member may place the tool in a power saver mode until it is awoken to perform the data acquisition tasks, again using a timer or signal commands from the surface, wherein, for example, an acoustic detector wakes the processor for data acquisition and processing.

Using any manner of algorithms, signals may be converted from time or space domain to the frequency domain, usually through the use of a Fourier transform, wherein the Fourier transform(s), and its various derivatives form an important part of the art and science of signal processing, which describe a decomposition of a function in terms of a sum of sinusoidal functions (basis functions) of different frequencies that can be recombined to obtain the original function.

Preferably, a surface system (183 of FIG. 18) provides data acquisition, processing, storage and display capabilities for the data received from inside the wellbore to provide the ability to test, develop, improve and benchmark various methods and apparatuses that are used. Surface data detection sensors may acquire or send transmissions through a well element capable of signal conductance, for example, the string deploying a tool assembly, tubing or casing gauge modules, attached at wellhead level, the fluid within the surrounding bore, the ocean or strata to detect and transform an acoustic wave into digital electrical pulses that can be transferred, e.g., via a surface cable or a sensor placed in the ocean from a crane or walkaway VSP logging boat arrangement to a data processing module. The sensors can also convert electrical pulses into acoustic commands transmitted downhole. The surface processing module may provide data acquisition, processing, display and interfaces to, for example, a pump controller or computer. The data received from an acquisition module may be conditioned and preprocessed to eliminate noise after which the data is processed in the time domain to obtain the actual parameter values gathered by the sensors inside the wellbore. A computer may interface with the surface-processing module to obtain the downhole information and put it into graphical and/or tabulated form to, for example, determine cement bonding if cement bonding is present.

The efficiency of the system may be affected by various factors including: i) the strength of the data signal that can be produced, wherein the higher the energy applied by a drive tool, the longer the distance will be between the transmitter and receiver transducers; ii) the attenuation of a continuous transmission path, wherein an inner conduit's contact with the surrounding bore of a casing or the casings bonding to cement over extended lengths affect the wellbore signal path, and wherein, for example, parted tubing prevents the signal from reaching surface; iii) allowable signal-to-noise level for data acquisition, wherein downhole drive tool power level can be designed to, for example, assure an acoustic signal will have a level high enough to be detected by the surface or receiving downhole hardware, and wherein the noise environment of the well or signal-to-noise ratio (SNR) can be maintained above a certain level for signal packets to be correctly decoded by the surface system after any filtering. The at least one tool string (8) of the present invention can be configured to consider these factors. For example: i) a series of sensors placed within each cementation may relay signals between coupler tools (83) to minimise the distances that signals travel; ii) couplers may be driven like spikes through multiple casings to allow communication through more than on signal conductance well element; iii) and electric line may be used with a lower cost EMAT sensor (162) to supply sufficient power, after which an electric wireline fusible link may be broken to retrieve a memory tool (185).

Additionally, two-way communications using asynchronization to request a sensor reading from data stored in downhole memory (184) may significantly reduce power consumption, since sensor readings are taken only when required. Various other possible surface generated commands include changing communication parameters, such as transmission frequency, which is useful because each well has a unique acoustic profile and ambient noise environment or modifying the transmission frequency which may, in use, allow communication, even in a dynamic noise environment, for example when crushing conduits to create space for concentric cement placement. Selecting a transmission frequency also allows multiple gauges to be deployed in a well with a single surface transceiver for an entire gauge set.

A power generating downhole drive tool (3, 3AG) can be connected to a battery and a wireless gauge member of a coupler tool (83, 83AG) to increase power and system reliability, wherein a solid state generator may obtain energy from, for example, fluid flows within the wellbore during circulation or movement of a packable piston when crushing a conduit and/or wellbore vibration during an operation.

The at least one placement tool (2) embodiment (2AG), having a placement tool shaft (6) and deployable through the innermost bore (9) using a string (8) embodiment (8AG), can be usable to place a coupling tool through the walls of at least one inner conduit (90) to engage the surrounding bore (10) of the production casing (91) and/or to axially displace well bore components concentrically, using an axial displacement tool (7) embodiment (7AG1) or axially downward, e.g., the production packer (40) and tubing (91), using an axial displacement tool (7) embodiment (7AG2).

Accordingly, without restriction any empirical measurement system usable downhole with transmission conductance well elements, which may be implemented through preferred methods (1, 19) or through associated testing methods (42), using other coupling means, can be used by the present invention.

Figure 19:
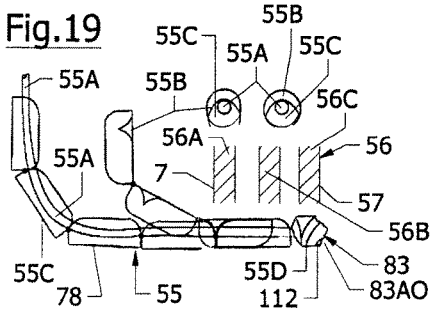
Figure 22:
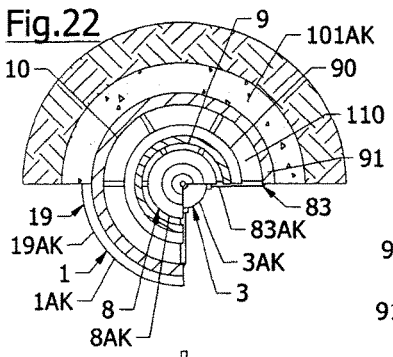

FIG. 19 illustrates a diagrammatic elevation view of an embodiment (83A0) of a coupling tool (83) usable with a pinning member arrangement (55), with only a portion of the well (59) bore (10) elevation radial, cross-section shown below an upper right-hand, transverse side-view, elevation cross-section of the diameters of the pinning shaft member (55A, 55B, 55C), in differing left-hand side and right-hand pinning shaft configurations, as shown in the upper right. A flexible shaft (55A) and boring bit (55D) may be used to bore through various casing (56) conduits (56A, 56B, 56C), e.g. corresponding to 90, 91, 92 of FIGS. 36 to 39, with the flexible shaft (55A) usable as a spine for a linked pinning conduit (55C) arrangement (55), that may be combined with a securing and/or stiffening partial conduit member (56B) to anchor conduits (56A, 56B and 56C) together. Such coupling pinning member arrangements can be usable in, e.g., (2X) of FIG. 82 or other placing sensors for concentric cementing and cement bond logging operations, wherein, e.g., sensor transducers may be engaged to (55B) or (55C) to transmit signals through (56A, 56B, 56C) in a manner similar to that depicted in FIG. 19A.

Referring now to FIG. 19A, the Figure shows a plan view of a cross-sectional slice through a wellbore within a subterranean well (59) of a method (1) embodiment (1AH) of an embodiment (2AH) of a tool string (8AH) placement tool (2). The depicted tool string (8AH) can comprise a placement tool (2) that can be placed through an innermost bore (9) and axially disposed via a shaft (6AH), and the tool string can further comprise an axial displacement member (7AH) that is extendable and retractable form said shaft (6AH). The axial displacement member (7AH) can be further usable to couple a coupling tool (83), e.g. (83A0) of FIG. 19 or (83AK) of FIGS. 22 to 27, 83AL1 or 83AL2 of FIG. 28, to the surrounding bore (10) through a dissimilar contiguous passageway (9) formed by any form of well conditions (4AH) that can inhibit penetration from the innermost bore (9) to the desired bore (5AH), for which the surrounding bore (10) can be used as a conductance well element. A drive tool (3AH) can be engaged to the couplers (83) to pass a signal through the surrounding bore (10) to a receiver placed axially above and within the wellbore or at the surface, which is analysed to determine if concentric cement (101AH) bonding between the strata bore and casing is present. In this instance, cement bonding is not present and radially extending perforations (129) are placed through the wellbore to squeeze cement to repair the fractured or otherwise porous cement (101AH). If the drive tool (3AH) and coupler tool (83, 83AH) are disposed within or below the cement used to repair, then the signals may be passed through the repair to determine its effectiveness.

Additionally, the drive and coupler tools may be permanently disposed of downhole to pass signals from within or below cement placed about or within the surrounding bore during or after the squeezing of the cement or other methods of repairing or placing the cement bonds necessary for fluid isolation through the strata bore. Concentric cementation may be placed by axially displacing the conduit of the innermost bore (9) and any debris or interference (4AH) axially downward to provide a concentric cement plug (108AJ1-108AJ6 of FIG. 21) within the repaired bonded surrounding bore or concentric cement (109AI1-109AI4 of FIG. 20), about the innermost bore conduit and intervening wellbore element (4AH) and within the surrounding bore (10), through cleaning of the respective bores to provide a wettable surface for cement bonding using, e.g. the circulatable fluid column and/or rotary cable tools and brushes.

FIG. 20 depicts a diagrammatic elevation view of a slice through the subterranean strata with break lines representing removed portions and showing embodiments (1AI, 19AI, 42AI) of methods (1, 19, 42) and embodiments (12AI1-12AI4) of an apparatus (12) using embodiments (2AI1-2AI4, 83AI1-83AI4) of tool string deployed placement (2) and coupler (83) tools that can be usable to concentrically cement (109AI1-109AI4) and empirically measure cement bonding within a hydrocarbon well completion during rigless abandonment (171B), associated with FIG. 21 using alternative embodiments (2AJ1-2AJ7, 83AI1-83AI7) of the present invention to provide alternative concentric cementing (108AJ1-108AJ7 shown in FIG. 21) and associated cement bond empirical measurements for the same well. FIG. 20 depicts a valve tree (88) with production valves (64) engaged to a wellhead (85) engaged with conductor (94), intermediate casing (92), production casing (91), perforating gun penetrated (129) liner (95) and production tubing (90) controlled by a safety valve (74) via a control line (79) extending axially downward through pressure and fluid permeable strata formations (95G-95K) and relatively impermeable strata formations (94A-94K). The primary factor affecting all abandonment design of any subterranean well (171B) is the subterranean strata (94A-94K and 95G-95K), which may vary significantly from one well to the next, even within the same producing region, potentially causing the abandonment design and usable member embodiments to vary. Various types of production packers (40, 40B, 40C) can be used to segregate producible zones used, e.g., to control water production, wherein a bottom plug (116) was used to isolate a water wet producible zone (95G) encountered during construction of the well.

Figures 28, 29, 30, 31, 32, 33, 34, 35:
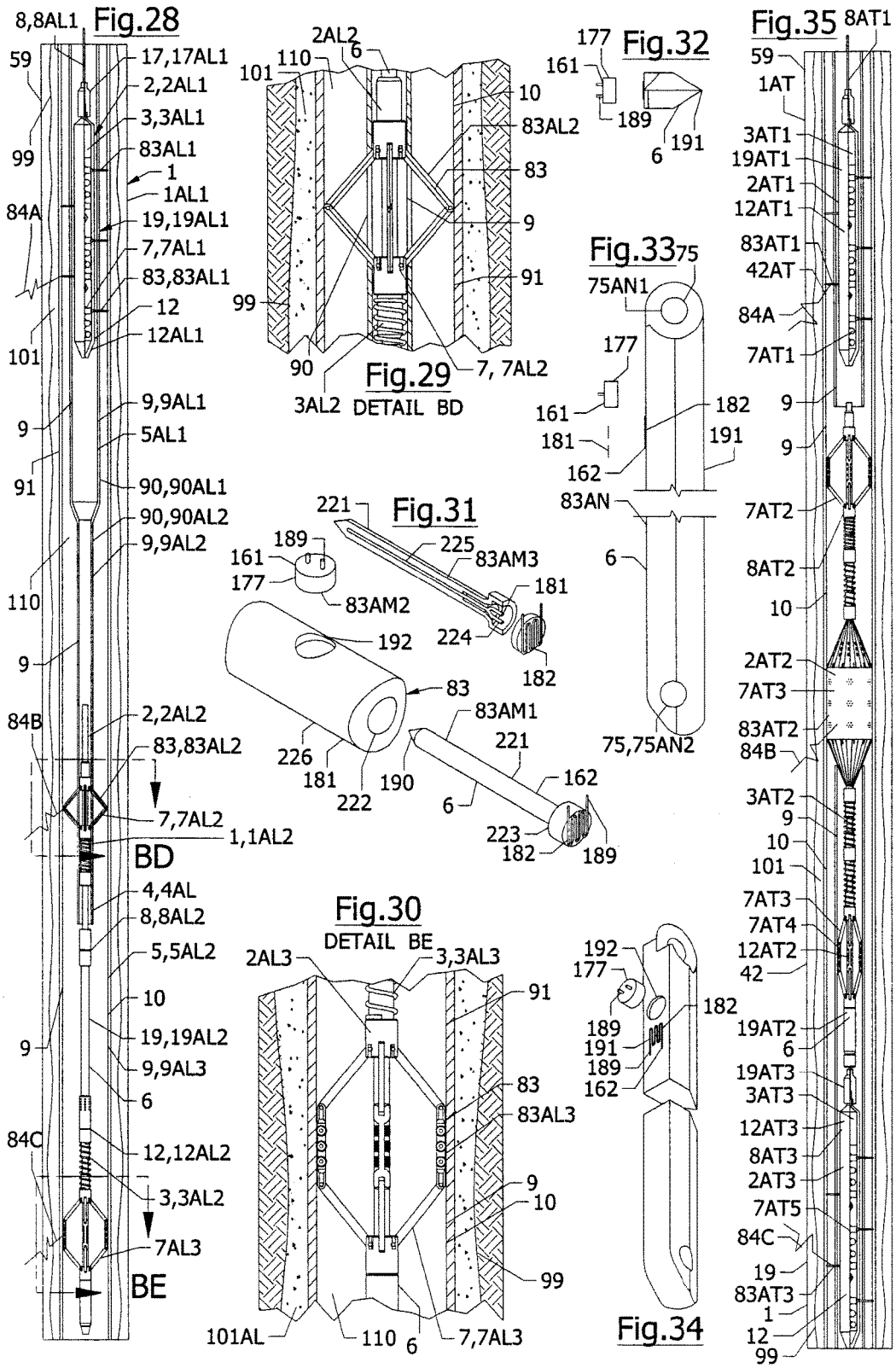
FIGS. 28 to 30 illustrate an embodiment for concentric cementation and bond logging within substantially differing well bore diameters.
FIGS. 31 and 32 to 34 illustrate coupling tools members using piezoelectric and electromagnetic sensor transducer arrangements suitable for the embodiments of FIGS. 22 to 30.
FIG. 35 shows the versatility of using various tooling embodiments to form an embodiment for cementation and bond logging.

Placement tool embodiments (2AI1-2AI4) can be used to concentrically, axially and radially displace or place at least one inner conduit (e.g. 90, 91, 92, 93), to allow concentric cleaning and cementation, while a coupling tool (83AI1-83AI4) can be placed in contact with a surrounding wall to empirically measure the bonding of cement (101) behind casings (91-94), using, e.g., (2AH, 83AH) of FIG. 19, (2AK, 83AK) of FIGS. 22 to 26, (2AL1-2AL2, 83AL1-83AL2) of FIGS. 28 to 30, 83AM of FIGS. 31 and 83AN of FIG. 32 for production (34). Signals carrying empirically measured downhole conditions may be passed between coupling tools, wherein a memory portion can be retrieved to surface or passed through a conducive well element (e.g. 91, 92, 93, 94) that is coupled to the wellhead (85) and a surface system (183) and used to store and analyse received downhole data for comparing cement bonding data to previously established benchmarks and to analyse other data useful for proving unproven technology.

FIG. 21 is a diagrammatic elevation cross section view through the strata with break lines representing removed portions and showing embodiments of a method (1, 19, 42) embodiment (1AJ, 19AJ, 42AJ) for providing concentric cementation (108AJ1-108AJ6), similar to that of a drilling rig (107 of FIG. 10) and using tool string conveyed placement tools (2AJ1-2AJ7) and deployed coupling tools (83AJ1-83AJ7) coupled with well elements and cement and permanently disposed downhole to empirically measure downhole conditions for the purpose of confirming cement bonding before and after placement. In addition, FIG. 21 depicts method (42) embodiments (42AI of FIGS. 20 and 42AJ) for benchmarking, developing, testing and improving new technology that can be usable with a set (2AJ) of tool strings selectively arranged to pass any debris, e.g. scale, or deformities of the innermost bore to place members, including axially slideable annular blockage bypass (2AJ1, 2AJ5), axial conduit shredding (2AJ2), jarring (2AJ3), annulus boring access (2AJ4), circumferential milling (2AJ6), annular piston (2AJ7) and abrasive particle cutting (2AJ8) members, which can be usable for permanent rig-less abandonment of the well, as shown in FIG. 20, depicting suspension and marginal production recovered prior to final well abandonment. The members of FIG. 21 are also usable in FIG. 20 when, e.g., cement bonding is not present behind casing and inner conduits, or placed tools (e.g. 2AI1-2AI4 of FIG. 20), need to be removed by, e.g. crushing, to place concentric cement behind casing by, e.g., perforating and squeezing cement or by, e.g., milling and removing the casing and damaged cement, to place concentric cement bonded to the strata bore. A coupling tool may be engaged to the surrounding bore and permanently displaced downhole to provide a signal through signal conductive well elements or strata to confirm bonding through empirical measurement of cementation prior to the final removal of the wellhead.

Figures 82, 83, 84, 85, 86, 87, 88, 89, 90, 91, 92, 93, 94, 95:
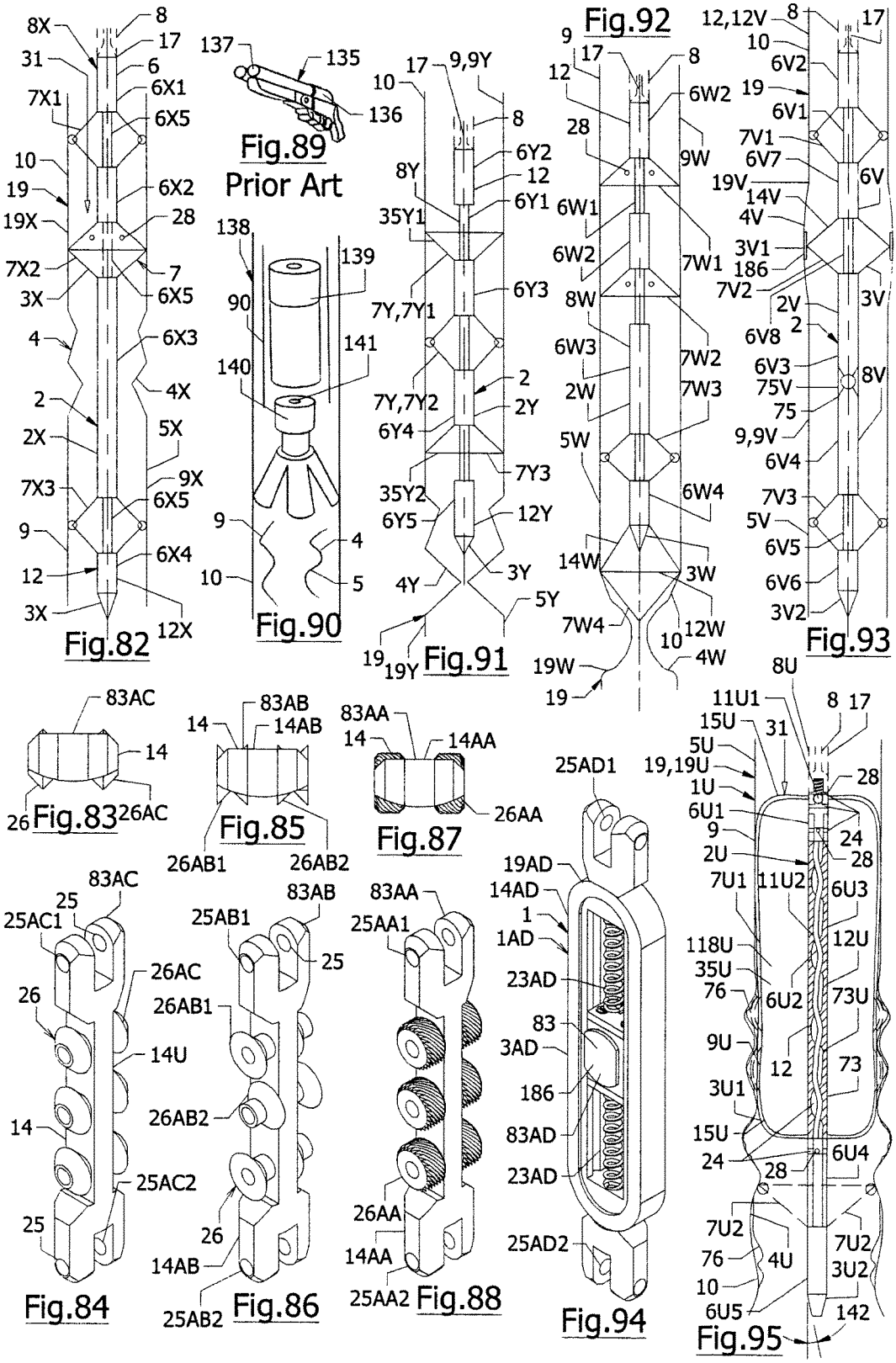
Fig.89 Prior Art
FIG. 82 shows a reduced friction embodiment of the present invention usable for access or passage through subterranean well bore dissimilar contiguous passageway walls to provide bonding of concentric cementation.
FIGS. 83 to 88 illustrate various wheeled skate embodiments of the present invention usable with a placement tool.
FIG. 89 shows a prior art shot gun and FIG. 90 depicts an explosive compression piston of the present inventor.
FIGS. 91 to 96 depict various tool string embodiments of the present invention usable for access or passage through subterranean well bore dissimilar contiguous passageway walls to provide cementation and cement bonding.

An axially slideable annular blockage bypass member of a placement tool (2AJ1) and associated coupler tool (83AJ1) are shown placed with, e.g., an adaptation of 2V of FIG. 93, used to bypass the lower packer (40C of FIG. 20) and to place a cement well barrier element (108AJ1) to abandon the lower portion by cementing within bonded cement (101AJ1), between casing opposite a strong impermeable formation (94C of FIG. 20). Thereafter, an axial conduit shredding member of a placement tool (2AJ2), e.g. an adaptation of 2X of FIG. 82, can be used to remove conduits around the sliding side door (123) which was allowed to fall downward and on top of which a cement barrier (108AJ2) was placed by bullheading the circulatable fluid column into the permeable producible zone (95H of FIG. 20) to abandon the well, with concentric cementation within a bonded cement portion (101AJ2) of the well.

Because the liner (95 of FIG. 20) top represents a potential leak path, a jarring member placement tool (2AJ3), e.g. an adaptation of 2Y of FIG. 92, can be usable against a jarrable surface, such as a piston or rheological controllable member, to compress equipment and place a well element barrier (108AJ3) to further isolate and permanently abandon the lower portion of bonded cement (101AJ2) behind the casing of the well, before suspending the abandonment and side-tracking with an annulus boring access member placement tool (2AJ4), e.g. 2X of FIG. 82, to provide marginal production from a formation (95J of FIG. 20) that may not have been initially completed, because it presented a risk to the more favourable producible zones (95H and 951 of FIG. 20). After producing the side-tracked formation (95J of FIG. 20), the side-tracked portions with bonded concentric cementation (101AJ3) are abandoned by penetrating the conduits and placing an axially slideable annular blockage bypass member with a placement (2AJ5) over the penetrations to further place a well barrier element, comprising concentric bonded cement (108AJ4), using circulation to place cement within the annulus and inner bore.

During the previous abandonment, suspension and side-tracking operations, hazardous well substances, e.g. LSA scale, were injected and abandoned into a fracture (100), formed for disposal purposes, that now comprise damaged cement (101AJ4) of the well that must be abandoned to protect a permeable ground water producible zone (95K). A circumferential milling member and placement tool (2AJ6) was usable to remove the tubing (90) and production casing (91), leaving the intermediate casing (92) for conducting a signal to surface so that a cement well barrier element (108AJ5) could be bull-headed into the fractures (100), thus abandoning the portion of the well (101AJ5) adjacent to the water table producible zone. Subsequently, an annular piston member and placement tool (2AJ7), e.g. 2T of FIGS. 33 to 80, and methods were used to compress the conduits and safety valve (74) downward so that a cement barrier (108AJ6) could be placed to abandon the uppermost portion of bonded cement (101AJ6) of the well. Thereafter, a boring pinning member (55 of FIG. 19), deployed with a placement tool, e.g. 2X of FIG. 82, and an abrasive particle cutting member, deployed with a placement tool (2AJ8), were used to remove the wellhead in one piece with a crane, so that the ground surface (121) could be returned to its original state.

As a plurality of wireline rig-up and rig-downs of, e.g., (168C) of FIG. 7 are substantially faster than other well intervention methods (193A of FIGS. 1 and 3, 166A of FIG. 5) empirical measurements using a surface system (183 of FIG. 20) may be taken between each cementation (108AJ1-108AJ7) over a period of time to allow cement curing and bonding prior to removing the wellhead.

While the rig-less abandonment method (1) embodiments (1AI of FIGS. 20 and 1AJ) comprised numerous steps and members and an increased time to implement, when compared to a drilling rig abandonment, the overall cost of the abandonment is, in practice, significantly less than that of a rig (163, 164, 165 of FIGS. 1, 2 and 3, respectively). This is because the work involves a limited amount of equipment and personnel, e.g. the rig-less abandonments (166A, 166B or 166C) of FIGS. 5, 6 and 7, respectively, are generally available at a significantly lower cost per unit of time, and they are usable with the present invention to meet the published minimum industry recommended guidelines (211-220 of FIG. 15).

Embodiments of the present invention thereby provide methods (1) and interoperable apparatus (12) of a tool (2, 3, 83, 184, 185) string (8) for concentric cementation and empirically measurable cement bonding and methods (42) for benchmarking, developing, testing and improving new rig-less abandonment technology, as demonstrated in FIGS. 20 to 21 and FIGS. 36 to 39, to rig-lessly access annuli to use and/or abandon a well with better economics than are possible with conventional drilling rig operations, said system being usable with minimal supporting facilities and within a limited space and/or within environmentally sensitive areas, such as offshore or the arctic, to suspend, side-track and/or abandon wells rig-lessly placing a permanent bather according to published industry minimum requirements.

FIGS. 20 to 21 and 36 to 39 illustrate various cable (187) compatible tool string tension and/or electric cable and fluid columns (31) that can be circulatable (31C) to operate cementation methods (1) and apparatus using various placement tool (2) embodiments (2AI1-2AI4, 2AJ1-2AJ7), which can be usable for concentric cementation (108AJ1-108AJ8, 109AI1-109AI4) and cement bonding empirical measurements using signals and coupler tools (83AI1-83AI4, 83AJ1-83AJ8), also operable with conventional members, said members usable with coiled tubing and/or jointed conduit strings, in various other configurations of conventional rig and rig-less operable arrangements. Rig-less abandonment and rotary cable tools of the present inventor can be usable as new technology members. Additionally, rig-less arrangements for jointed pipe (166A of FIG. 5) can be usable to prove various unproven full size or scaled down well construction apparatus within the geologic environment in which they are intended to operate.

In each of the method (42) embodiments (42AI-42AJ and 42AP-42AQ) of FIGS. 20 to 21 and 36 to 39, a common approach is used to establish the initial basis benchmark data for subsequent benchmarking, development, testing and improvement of new technology using a ten step process. The first step of the common approach process is to use a placement tool (2), e.g. 2AK and 83AK of FIGS. 22 to 27, to concentrically place the tubing through axial displacement, within the surrounding bore, and to place a coupler tool (83) that can be usable to send acoustic signals within the production casing between a lower end and an upper end using an associated coupling tool to receive said signal and to analyse it for estimating whether the signal passed through solid casing and cementation or whether it passed through solid casing and a surrounding fluid pathway, thus indicating the absence of cement bonding.

The second step of the common approach process to establish the initial basis benchmark data for subsequent benchmarking, development, testing and improvement of new technology, comprises using conventional apparatus for separating tubing above the previously placed coupler tool comprising without restriction any means of separating the tubing at a desired depth, e.g. explosives, chemical, knives, abrasion, vibration, shock, etc. . . . that is used to provide a space for placement of a conventional expandable or inflatable packer, or alternatively, for example, a conventional expandable or inflatable packer can be used to expand within the tubing and to part it at a coupling connection or a weakened section.

The third step of the common approach process comprises placing any conventional expandable or inflatable packer that is capable of being sized to fit through the tubing conduit, which was separated in the first step, and expanding said packer against a surrounding and/or peripheral conduit to form a piston or packable downhole apparatus. Any conventional packer, forming a piston, will have a pressure relief one-way valve to release pressure from below to above the packer or, alternatively, any form of pressure relief from below is usable without limitation.

The fourth step of the common approach process comprises ensuring a seal between the packer and surrounding conduit by, e.g., placing any conventional viscous fluid, conventional gradated particle mix, drilling mud, gunk, swellable particles, cross-linked polymer, or without restriction, any other conventional means of forming a differential pressure actuated piston packable downhole apparatus.

The fifth step of the common approach process comprises applying pressure above the differential pressure actuated piston packer by using any fluid medium, e.g. weighted drilling mud, pressurized sea water, gas, or other pressurized or weighted conventional fluid medium, without restriction.

The sixth step of the common approach process comprises holding pressure, weight or other forces exerted by the fluid medium on top of the conventional expandable or inflatable packer, preferably with a pressure relief one-way valve upward or the injection of fluids below into the surrounding strata with said differential pressure actuated piston packable downhole apparatus, wherein the tubing and the previously placed coupler tool moving downward with pressure relief upward or the fluid injection downward and compression of well components downward to crush, to helical buckle or to otherwise compress the separated tubing or conduit and associated compressible well components below, thus forming a space above that is unobstructed by said tubing or conduit and associated compressible well components.

The seventh step of the common approach process comprises conventionally logging the space provided to empirically measure cement bonding behind the production casing.

The eighth step of the common approach process comprises comparing the conventional empirical logging data with the empirical coupler tool (83) sent data, and any theoretical data relating to the signal's well bore elements or strata, to benchmark cement bond logging and/or other downhole data retrieved or commands sent downhole.

The ninth step of the common approach process comprises pumping a cement-like material, preferably heavier than the fluid medium, through the upper end of the separated tubing or conduit, allowing it to fall through the space and onto the differential pressure actuated piston packable downhole apparatus used to crush, to helical buckle or to otherwise compress the separated tubing or conduit and associated compressible well components, which support said cement-like material for establishing a permanent well barrier element to isolate, e.g., the uppermost producible zone in the well.

The tenth step is of the common approach process comprises continuing to measure signals sent from below the upper end of the cementation, as sent in step 9, to measure the primary barriers about any surrounding conduits and the permanent well barrier elements formed in the previous steps to provide isolation and improvements to method or apparatus for subsequent benchmarking, development, testing and improvement of new technology above the measured permanent well barrier element. FIGS. 21 and 36, 37, 38, 39, describe methods (1, 19, 42) and conventional members usable to access and/or abandon an entire well during data collection and procedural improvement, which are interchangeable with other associated methods and members described throughout the specification, which demonstrate that the adaptable methods and conventional member sets of the present invention, can be usable to address the variability of the subterranean strata and design characteristics of substantially hydrocarbon and substantially waters wells when accessing, using and/or abandoning at least a portion of a subterranean well's producible zones and annuli, such that benchmarking, developing, testing and improving of new technology can occur concurrently, wherein successful placement of well barrier elements with rig-less abandonment new technology may be used and failed placement of well barriers with rig-less abandonment new technology may be isolated using the method embodiments.

Accordingly, common approach to establish the initial basis benchmark data for subsequent benchmarking, development, testing and improvement of new technology of the present method (42) also forms part of cementation and bond logging through empirical measurement, both before and after said cementation recited in the claimed method (1).

Figure 23:
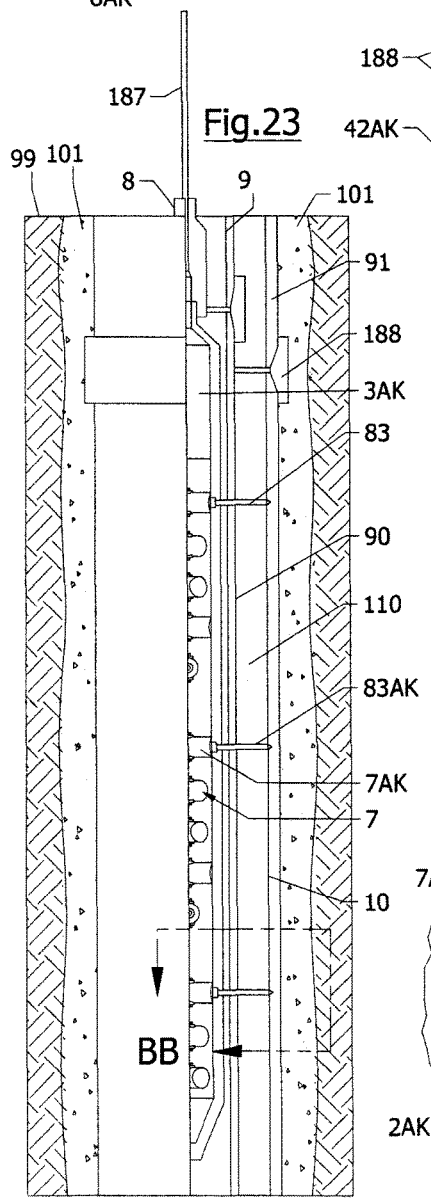
Figure 25:
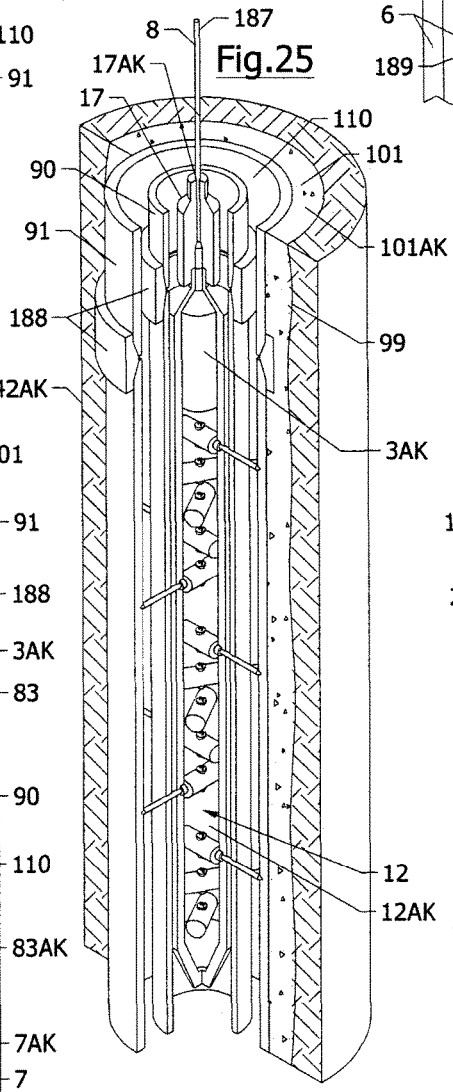
Figure 24:
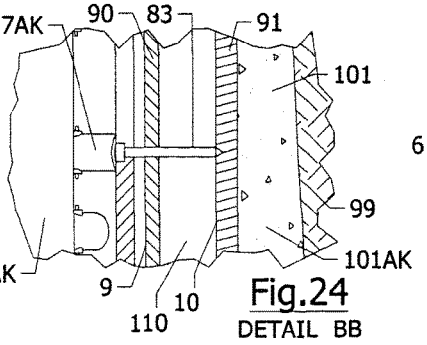
Figure 27:
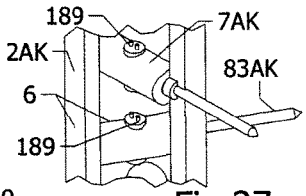
FIGS. 26 and 27 depict the tool used.

Referring now to FIGS. 22, 23, 24, 25, 26 and 27, the Figures depict a plan view, elevation view with detail line BB, magnified view within line BB, isometric of FIG. 23, isometric view of only the tool string of FIG. 25 with detail line BC and magnified view within line BC, respectively, which shows a slice through a subterranean well and a one-quarter slice removed from portions of the tool string for a method (1, 19) embodiment (1AK, 19AK) and apparatus (12) embodiment (12AK) for deployment through the innermost passageway (9) using a tool string (8) embodiment (8AK) assembly. The string tool (8) embodiment (8AK) assembly comprises a placement tool (2) embodiment (2AK) shaft (6) that houses an axial displacement tool (7) embodiment (7AK), also comprising a piston shaft (6) that drives a coupler tool (83) embodiment (83AK) through the innermost bore (9) of the inner conduit coupled (188) tubing joints (90) to couple the tool to the surrounding bore (10) of the coupled (188) casing joints (91), which can be cemented (101, 101AK) within the strata bore (99) using circulation through the innermost bore (9) of the inner conduit (90) and annular space between the inner conduit and surrounding bore (10, 91), e.g., hydraulic force and/or an explosive initiated by the drive tool (3) embodiment (3AK) connected to the axial displacement tool (7AK) via associated connections (189) to forcibly couple a spike like coupler tool (83AK) to the conductance well element (91).

A coiled string (187), comprising, e.g., electric wireline or slickline engaged to the drive tool (3AK) to power a sensor transducer (e.g. 162 of FIG. 17) arranged, e.g., like the coupling tool (83AM) of FIG. 31, can be usable to transmit through the coupling tool (83AK) and conductance well element (91 and/or 187), wherein power may be supplied from the drive tool (3AK) for slickline or from surface through the controlling drive tool for electric wireline operations, comprising, e.g., a mono core or braided line arrangement.

The driving of the coupler (83AK) in a phasing arrangement similar to perforating guns can maximise the length of the axial displacement tool (7AK) and coupling tool (83AK), wherein operation of the axial displacement tool (7AK) and circumferential deployment of the couplings tools (83AK) is used to displace the axis of and to concentrically place the inner conduit (90) for concentric cementation. At the same time, the coupling of the apparatus (12AK) to the surrounding wall can occur for signal transmissions usable to empirically measure the cement bonding before cleaning and cementation of the bores, within the surrounding bore, to provide a clean and wettable surface for cement bonding. The tool is also usable for permanent disposal within the cementation to send signals and to empirically measure the cementation of the wellbore for cement bonding and its fluid isolation properties.

The coiled string connector (17) embodiment (17AK) may comprise various designs comprising, e.g., a fusible link if electric wireline is used, wherein a memory member may be placed above the fusible link for retrieval and electric wireline chargeable battery power, provided within the drive tool (3AK), to send signals after fusing the connector for retrieval. To minimise power drain on the battery a second tool string with receiving couplings and memory may be placed axially above to shorten the transmission distance through either the inner conduit (90) or casing (91), wherein command signals may be passed between the two coupling tools to further increase the efficiency of the empirical data collection.

A series of relatively low cost EMAT sensors (162 of FIG. 17) may be placed downhole and operated with, e.g. electric monocore or braided wireline, using a series of apparatuses (12AK) placed to allow perforation of the innermost bore (9) and fluid column circulation through the wellhead innermost bore about or through ports or passageway within the apparatus (12AK) and surrounding production annulus (110) to clean the well and to place cement-like material for sealing it. Additionally, e.g., a retrievable piezoelectric sensor transducer usable for more precise readings may be placed on the wellhead as a primary or secondary reception data collection point. Furthermore, the inner conduit (90) may be severed and the coupling tool (83AK) displaced into a lower end of the wellbore (10) to allow conventional logging tools to calibrate and/or confirm the empirical measurements received from the coupling tool or to repair cementation (101AK) that lacks bonding to the casing (91). The coupling may be designed to allow flexure in the coupling tool (83AK), so as to maintain contact during the axial downward displacement and to provide further measurement signals after conventional logging confirmation and/or repair of cementation is found to lack bonding with the casing or strata bore (99).

Accordingly, perforating inner conduits with, for example, a spike (83AK) or cutting blade (83AL1 of FIG. 28), to couple a signal transmitting drive tool (3AK), and EMAT sensor transducer to a surrounding bore (10), to generate an ultrasonic testing wave through a conductance well bore element (8, 90, 91, 99, 101), can be usable to empirically measure cement bonding and may also be economically usable to mitigate the problems (207, 208, 209, 210, 210A), shown in FIGS. 13 and 14, and to provide the properties (211-220) shown in FIG. 15, without either removing or axially displacing wellbore components axially downward to provide a space, but whereby it is still possible to axially displace wellbore components axially downward (1T, 12AT, 19AT, 42AT of FIG. 35) to mitigate the problem of control lines (79 FIG. 13) or to repair damaged primary cementation (101) and/or to provide a method (42) embodiment (42AK) to benchmark, develop, test and improve new technology through comparison to proven conventional logging tool measurements.

FIGS. 28, 29 and 30 illustrate an elevation view with lines BD and BE, a magnified detail view within line BD and a magnified detail view within line BE, respectively, of a slice through the subterranean strata and well bore (59) and with a one-quarter slice removed from portions of the tool string and showing method (1, 19) embodiments (1AL1, 1AL2, 19AL1, 19AL2) tool string (8) embodiments (8AL1, 8AL2) and apparatus (12) embodiments (12AL1, 12AL2) for deployment through the innermost bore (9, 9AL1-9AL3) passageway for forming substantially differing dissimilar contiguous passageways (4, 4AL, 5, 5AL1, 5AL2) pilotable by a tool string (8) embodiment (8AL) assembly. The tool string (8) embodiments (8AL1, 8AL2) assembly comprises a connector (17, 17AL1) and placement tool (2) embodiments (2AL1, 2AL2) that are formed with shaft (6) housings and an axial displacement tool (7) embodiments (7AK1, 7AK2) for placing coupler tool (83) embodiments (83AL1, 83AL2) through the inner conduit (90), which can comprise a larger diameter tubing (90AL1) swedged down to a substantially small diameter tubing (90AL2) and which ends at a lower end to open to a substantially larger innermost bore (9AL3), comprising casing and the surrounding bore (10) cemented (101, 101AL) within the strata bore (99).

The upper apparatus (12AL1) can be similar to that of FIGS. 22 to 27. The lower apparatus (12AL2) can comprise a placement tool (2AL2) with an upper axial displacement tool (7AL2) within a small tubing, e.g. 2⅜ inch outside diameter, that can be positioned within a large casing, e.g. 9⅝ inch outside diameter, leaving a large annular passageway (110) to bridge between the innermost bore (9) and the surrounding bore (10). While telescopic versions of the spike-like coupling tools of the above coupling tool (83AL1) may have been used to bridge the gap, in this instance pivotal knife shaft coupler tools (83AL2), shown placed with an axial displacement member (7AL) of the placement tool (2AL2), similar to (83AN) of FIGS. 32 to 34, were operated to perforate the small tubing innermost bore (9) to engage the surrounding bore (10). While a conventional actuation drive tool, similar to that used in FIG. 40, may have been used to displace and concentrically place the axis of the tubing (90) and to couple the coupling tool through penetration and engagement of the surrounding bore to, in use, facilitate cleaning and cementation favourable to cement bonding, a spring drive tool (3AL2) can be used to maintain engagement and centralization for cement to flow about the apparatus (12AL1-12AL) and/or placement tool (2L1-2AL2) and/or cementing flows may pass through ports and internal passageway within the tool (2AL1) about, e.g., a piston axial placement member (7AL1). The lower coupling tool (83AL3) can be placed with the axial displacement tool (7AL3) and drive tool (3AL3), and the placement tool (2AL3) is usable with, e.g., a sensor transducer arrangement similar to (83AD) of FIG. 94.

Accordingly, the apparatus (12) and method (1, 19) are usable to place a coupler tool (83AL1) which is usable to send a signal (84A) and/or receive signals (84B, 84C) from other coupler tools (83AL2, 83AL3) or surface, while coupler tool (83AL2) is usable to send a signal (84B) and/or receive signals (84A, 84C) from other coupler tools (83AL1, 83AL3) or surface and coupler tool (83AL3) is usable to send a signal (84C) and/or receive signals (84A, 84B) from other coupler tools (83AL1, 83AL2) or surface, to provide a series of data collection points and empirical measurements through a dissimilar contiguous passageway bore (9AL1, 9AL2, 9AL3) of substantially differing diameters and axially frictional resistance for deployment to provide concentric cementation and bonding of said cementation, to provide fluid isolation within the strata bore (99) for a large spectrum of wells with a minimum of off-the-shelf tooling requirements.

Referring to FIGS. 31 and 32, 33 and 34, the Figures depict an isometric view of a coupler tool (83) embodiment (83AM1, 83AM2, 83AM3) and a plan view, elevation view and isometric view from the back upward of a coupler tool (83) embodiment (83AN), with a break line indicating a removed portion, respectively. The Figures illustrate either the placement of a piezoelectric crystal (177), shown above and to the left of a crystal coupling receptacle (192), or an EMAT coil circuit (182) and magnet (181) arrangements, wherein an embodiment (83AM) comprises a piston (223) and spike (221, 83AM2 or 83AM3) shaft (6) and perforating (190) arrangement, shown to the right of the piston. A solid spike (83AM1) can be disposable within a magnetic (181) housing (226) or alternatively a magnet (181) shaped tuning fork (224) and embedded within a spike (83AM3) to form a transducer coupler (83AM3) that can be actuated, via the coil circuit, to transmit or receive an acoustic signal or mechanical wave transferred to the solid shaft (83AM1) or hollow shaft (83AM3), coupled to the spike (221), which through coupling with, e.g., the production casing (91 of FIGS. 20-21 and 36-39), via actuation through a piston chamber (222) by using hydraulics and/or explosives to transmit or receive command or logging signals via, e.g., the piezoelectric crystal (177) embodiment (82AM2). An embodiment (83AN) can comprise a joint (75) pivotal embodiment (75AN1, 75AN2) with a knife-like cutting blade (191) shaft (6) arrangement that can be usable with a piezoelectric crystal (177) and/or EMAT coil circuit (182) connection (189) to send and/or receive command or logging signals, wherein by varying the length of the shaft (6) and including, e.g., the shown knife edge (191) or a cutting wheel, which may be extended or retracted from a substantially larger well bore diameter than the innermost diameter required to place the apparatus tool string (8) and coupler (83AN).

Coupling spikes, or other couplers, may use functionally shaped controllably deformable materials, e.g. a lead metallic or swellable material, on the outside of the coupler to better pass on, e.g., acoustic signals, and springs, knuckle joints, hinges, ball joints or any other flexural component aids can make and keep contact with a conductance well element like the surrounding bore. Alternatively, e.g., couplers may be interoperable with a drive tool and functionally arranged to aid in the creation of an acoustic signal that can be similar to a door knocker, wherein a drive tool can transform energy into a force to drive a jointed and levered object that creates an acoustic signal on impact and returns to a pre-impact disposition using a spring.

Various other arrangements involving magnets, coils, firing heads, pistons, springs and/or motors are also possible, wherein, e.g., the boring assembly of FIG. 19 may be interoperable with an explosive firing head usable to sever a spring retractable flexible shaft (55A of FIG. 19), which can be used to bore a hole, via a motor drive tool and piston force of fluid pushing the boring bit, to leave a coupler (83A0) and pinning assembly (55A-55C of FIG. 19) assembly between conductance well elements (56A-56C of FIG. 19). The flexible shaft (55A) can be an electrifiable coil between magnets (55B and/or 55C) to form an EMAT transducer that can be selectively actuated by individual link to selectively transmit selected conduits (55A-55C of FIG. 19); wherein the coupler arrangement can use and convert mechanical, electrical, explosive and hydraulic energies in the retrieval of the motor and operation of the coupler.

Piezoelectric crystal (161), EMAT (162) and/or tuning fork (224) transducer may transform or convert electricity imparted to its crystal, electromagnetic energy imparted between a coil and magnet and/or kinetic energy imparted to its fork, respectively, into a force or a mechanical wave conductance well element, e.g. the surrounding bore, through a coupling, e.g., an adhesive applied to the crystal, for engagement of the coil or shaft of a spike (221) or tuning fork (224), or a knife edge or a cutting wheel, to the surrounding bore and/or conductance wellbore element to transmit the force as an acoustic signal. The acoustic signal can be used to, e.g., transmit data or a command signal to or from a downhole tool, wherein the data may comprise any downhole measurement, but preferably the measurement of the outer casing, to determine if the casing is standing within a fluid, has a fluid path along its circumference, or is bonded to cement by, e.g. measuring the acoustic impedance to the acoustic mechanical wave passing through the casing, cement and strata comprising the surrounding. A spike or tuning fork (224, 83AM3) arrangement may, e.g., be vibrated, by a magnetic arrangement downhole, to pass an acoustic mechanical wave to the shaft (225) and/or spike (221), which is coupled to the casing and/or cement and/or strata, and which is in turn picked up by a second transducer downhole and/or at surface for converting the mechanical wave into an electrical pattern that can be storable within, e.g. a computer's memory, for processing and analysis, to determine whether the electrical pattern measurement stored in memory is consistent with bonding of the cement to, e.g., the production casing (91 of FIGS. 20-21 and 36-39).

For example, a piezoelectric crystal (177), and/or magnet (181) and coil circuit (182) or tuning fork (224) and coupling shaft (225) or any other signalling transducer arrangement using any form of coupling arrangement, e.g. (83AA-83AC of FIG. 83 to 88 or 83AD of FIG. 94), can be connectable (189) to any signal generator to transmit a logging signal, e.g. an acoustic mechanical wave, to the surrounding bore and/or a conductance wellbore element that is received by another transducer at another point or distal end of a well element capable of signal conductance, or conductance well element. An acoustic wave may be converted into an electrical logging signal which is analysed and/or stored for later analysis. The piezoelectric crystal (177) and coil circuit (182) can be connectable (189) to the associated signal sending, receiving and storing components forming part of a drive tool (3) and/or surface system (183) via any manner of connector and processor, signal and/or signal command, wherein embodiments (83AM) and (83AN) are examples of possible sensor transducer arrangements, and wherein any suitable downhole sensor transducer arrangement is usable by the present invention.

Conventional practice is to use piezoelectric crystal (177), magnets (181) and coil circuits (182), because of their non-destructive creation of acoustic waves, for testing of the casing's cement bonding, because the pressure integrity of the casing is critical to well life; however, at the end of well life, during well abandonment, damage to inner conduits or tubing and casing is not necessarily a critical factor. Accordingly, any type of coupler, any type of wave form, and/or type of cement bond testing arrangement can be usable with the present invention.

FIG. 35 is an elevation cross section view of a slice through a wellbore (59) with a one-quarter section of portions of the apparatus (12) embodiments (12AT1-12AT3) removed using signal method (1) embodiment (1AT) tool string (8) embodiments (8AT1-8AT3) deploying placement tool (2) embodiments (2AT1-2AT3) using deployment method (19) embodiments (19AT1-19AT3) and testing space method (42) embodiments (42AT) to provide concentric cementation and cement bonding of said cementation, before and after placement within the surrounding bore (10). A first tool string (8AT3) deployed a placement tool (2AT3) to place and couple a coupler tool (83AT3), e.g. (2AK) of FIG. 26, to the surrounding bore (10) to measure cementation (101) behind casing; and then, the inner conduit was severed, e.g., a conventional cutting tool and the tool string (8AT3) was displaced axially downward using a placement tool (2AT2) deployed using a tool string, e.g. (8T) of FIGS. 73-81, to provide a usable logging space, for conventionally proven technology, also usable to benchmark the apparatus (12AT3) performance. The performance of the displacing apparatus (12AT2) may also be measured and can comprise a tool string (8AT2) and coupling tool (83AT2) piston-like hole opener usable to crush the inner conduit axially below and to couple the placement tool (2AT2) to the surrounding bore (10) to send signals from sensor transponders, which are engaged and radially placed by the axial displacement tool (7AT2) to form a piston-like drive tool (3AT), before, during and after said displacement. After displacement and conventional logging of the space, a further apparatus (12AT1) tool string (8AT1) can be usable to concentrically place the inner conduit for cleaning and concentric cementation and cement bonding of said cementation through its drive (3AT1), placement (2AT1) and coupling (83AT1) tools, thus minimising the necessary displacement and crushing of the severed tubing by embedding the remaining tubing concentrically within a circulatable portion of the well (59).

Interoperability of the apparatus (12AT) tools provide selectively arrangeable tool strings (8AT1-8AT3) that provide, e.g., a placement tool (2AT2) using piloting (7AT2, 7AT4) and packer (7AT3) axial displacement members for guidance and coupling to surrounding bore, which can operate as hydraulic piston drive tool (3AT2) for displacing an inner conduit and a previous placement tool (2AT3). after which a second placing tool (2AT1) may be used. Both tools (2AT1, 2AT3) can axially displace the inner conduit using members (7AT1, 7AT5) to fire spikes and to cut the inner conduit to centralize for cleaning and cementation about or through the upper placement tool (2AT1), with the intermediate placement tool (2AT2) used for supporting cement circulated about the severed upper end of the inner conduit innermost bore (9), while the coupling of a logging device to the surrounding bore may be used to send signals (84A-84C), usable to measure cement bonding, thus providing measurable cementation and cement bonding above and below a usable testing space both before and after said cementation.

Interoperability of the apparatus (12AT1, 12AT2 or 12AT3) with various other apparatus of the present invention to provide cementation and bonding of said cementation can be usable with deformed or debris-filled inner conduits and/or surrounding bores, e.g. those shown in FIGS. 45-59, 74-76, 82, 91-93 and 96-102, wherein the need for cementation and cement bonding may result from the age, deterioration, and/or forces of well construction, well operation and/or the external forces on the well exerted by the strata and/or fluid pressures from strata which have damaged the well and formed a dissimilar contiguous passageway. Isolating the strata and pressures within the strata through cementation and bonding of cementation is particularly critical within a damaged bore to protect both downhole and surface environments, wherein appropriately scaled variations of an apparatus (e.g. 12AT1, 12AT3 or 12AL of FIGS. 28-30) are pilotable within passageways opened by various other embodiments while a packer apparatus (12AT2) of a circumferential adaptable variation can be usable for both axially compressing debris within the passageway to provide a bridge plug for supporting cementation, with a second apparatus (12AT2) usable as a pilotable packer disposed axially above placed cement and a bridge plug to squeeze cement into perforations and repair unbounded cementation behind deformed conduits and/or the surrounding bore.

Accordingly, the apparatus (12) and methods (1, 19, 42) are usable to place coupler tool (83AT1), which can be usable to send a signal (84A) and/or to receive signals (84B, 84C) from other coupler tools (83AT2, 83AT3) or surface, while coupler tool (83AT2) is usable to send a signal (84B) and/or receive signals (84A, 84C) from other coupler tools (83AT1, 83AT3) or surface, and coupler tool (83AT3) is usable to send a signal (84C) and/or receive signals (84A, 84B) from other coupler tools (83AT1, 83AT2) or surface. Conventional logging may be used to confirm the need for repairs to the cementation (101) by, e.g., squeezing cement before further cement placement to avoid complicating the problem with cement placed within unbounded cementation, wherein sizing of the tooling is consistent with minimizing the number of off-the-self tool string components by minimizing the diameter of the tool string (8AT2) and maximizing its expandability. Spike-like couplings tools strings (8AT1, 8AT3) may also be standardized for the various tubing sizes, wherein smaller diameter alternatives (8AL2 of FIGS. 28 to 30) are usable for wells with small tubing inside large casing. Small diameters of a coupling tool (83AT1, 83AT3) can be placed through the pilotable diameter of a large deformed conduit and a coupling tool (83AT2) can be used as a debris compression tool and a bridge plug to provide and support cementation through a dissimilar continuous passageway, while a second coupling tool (83AT2) can be used to squeeze and provide cementation and to measure cement bonding both before and after cementation.

Figure 36:
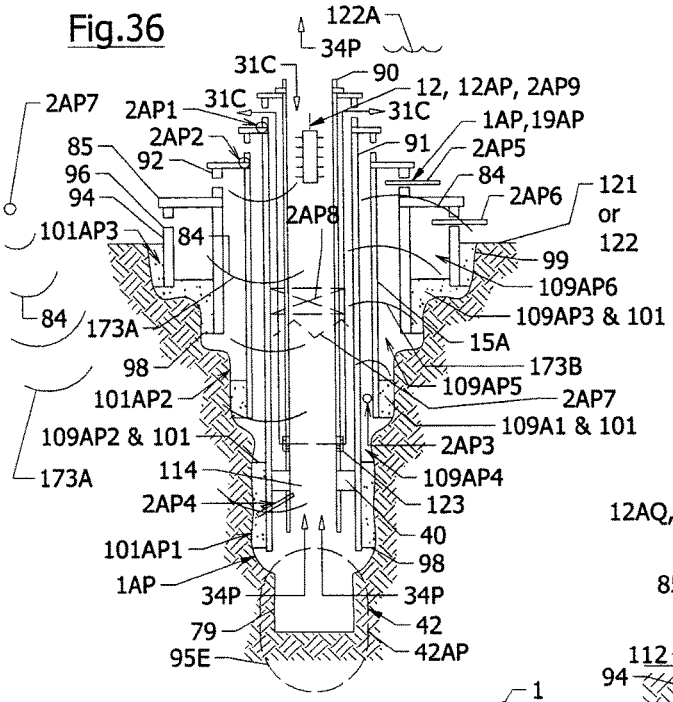
FIGS. 36 to 39 depict various method embodiments of the present invention for benchmarking, developing, testing and improving cementation and bond logging in addition to other new technology when using and/or abandoning substantially hydrocarbon or substantially water wells.

FIG. 36 depicts an elevation cross section view of logging tool members method (1, 19, 42) embodiments (1AP, 19AP, 42AP) for concentric cementation and cement bonding before and after said cementation, wherein benchmarking, developing, testing and improving new technology can be usable with apparatus (12) embodiments (12AP). The apparatus embodiments can be associated with placement tool (2) embodiments (2AP1-2AP9) that can be usable with an associated member set initially comprising conventional logging tool signals (2AP1-2AP3), receivers (2AP4-2AP6), and severing (2AP7) and annular conduit crushing piston packer (2AP8) members followed by apparatus of the present inventor (2P9), shown in FIGS. 17 to 35 and FIGS. 40 to 104, e.g. with (2AP9) being similar to (2AK) of FIGS. 22 to 27, within a plurality of passageways below a wellhead (85). FIG. 36 shows signals (84) deployed axially upward (173A) or downward (173B), e.g., through wires or acoustically through the walls of the conduits and/or through fluid pulses within the fluids in the annuli, to measure the installed well barrier elements comprising cementation without embedded conduits (108) or preferably circulated cementation with embedded conduits (109AP1-109AP3) to determine the requirement for new well barrier elements (109AP4-109AP6), within existing cementation (101AP1-101AP3) and behind casing of the well axially below the wellhead (85). Signal transmitters (2AP1-2AP3 and 2AP7) and/or receivers (2AP4-2AP6) are engagable with conduits or annulus fluids through embodiment penetrations (2AP3, 2AP4) or through annulus wellhead openings (96). AP signals may be sent from the wellhead (85) or from and an external transmitter (2AP7), which functions in a similar manner to a VSP logging tool, and used to calibrate seismic data, but also usable to see the existence of primary cementation adjacent to the strata bore (99).

Various methods of the present invention are usable to place logging tool member transmitters or receivers within a well with, e.g., the annulus conduit crushing piston (2AP8) methods of the present inventor, usable to crush the tubing (90). A conventional chemical, explosive, mechanical or other rig-less cable conveyable tool can be used to severe the tubing (90) for placement of any conventional packer able to pass through the tubing internal diameter and to expand to the production casing (91), e.g. an inflatable, whereby a sensor or transponder may be placed in a housing or protection provided, such as that described in patent applications GB1015428.4, GB1116098.3 and GB1212008.5 of the present inventor. The sensor or transponder housing, comprising circular or arched walls embedded within the wall and substantially coincidental to a diameter of the packer (2AP8) and conduit (91) or apparatus, e.g., an annulus conduit crushing piston disposed within and contacting the walls of casing extended upward to the wellhead, may be used to receive and/or send signals between a downhole location subjected to, e.g., compression and jarring forces similar to conductor driving and the wellhead where data may be gathered for benchmarking. The sensor and/or transponder may be separated from compression and jarring forces by at least one shock absorbing frame, spring, movable bearing arrangement, gelatinous material or protective stabiliser providing, in use, continuous ultrasonic or electrical contact with the conduit wall extending to the wellhead conductor for transmission of a signal through said conduit wall, while inhibiting stresses transmitted to said sensor or transponder, from, e.g., crushing of conduits below a annulus conduit crushing piston, which can be usable to expose the production casing for logging of primary cementation behind, placement of a well barrier element, and/or benchmarking, developing, testing and improving new technology.

Figure 37:
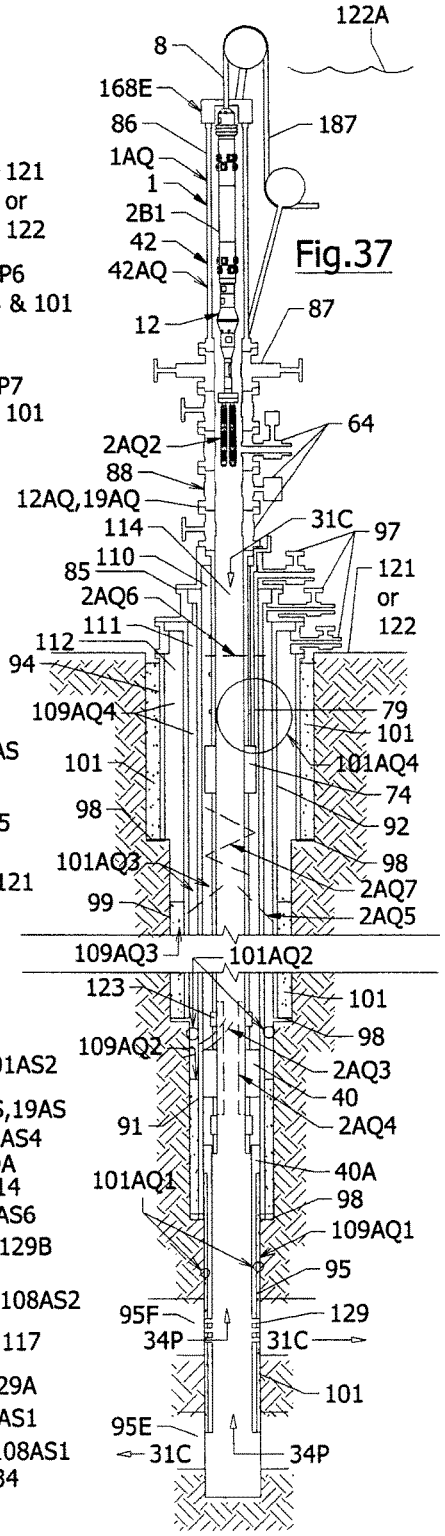

FIG. 37 is an elevation cross section view, with break lines representing removed portions of the subterranean well and strata, depicting embodiments of a method (1, 19, 42) embodiments (1AQ, 19AQ, 42AQ) for concentric cementation and cement bonding before and after said cementation, wherein benchmarking, developing, testing and improving new technology can be usable with apparatus (12) embodiments and associated placement tools (2AQ) substitutable for various tools. These various tools can comprise, e.g., conventional motorized annulus access apparatuses, e.g., perforating guns or other conventional wall cutters, conventional explosive severance or new technology circumferential shredding and milling (2AQ2, 2AQ5), conventional perforating charges or new technology annulus boring access (2AQ3), conventional straddle or a new technology axial slidable straddle (2AQ4) placed across perforations above and below a packer (40), conventional abrasive particle cutting (2AQ6) and an conventional annular piston (2AQ7) members comprising, e.g., inflatable packers capable of passing through smaller tubing internal diameters and inflating against, e.g., the production casing (91), which can be deployable within a pressure controlled rig-less well environment (168E). The Figure shows members (2AQ1, 2AQ2) within the lubricator (86) engaged to the BOPs (87) and valve tree (88), engaged to the wellhead (85), which can be deployable axially downward within the well using a coiled string (187) preferably followed by embodiments of the present invention, as shown in FIGS. 17 to 36 and FIGS. 40 to 104, e.g. with (2AP9) being similar to (2AK) of FIGS. 22 to 27 and usable to place sensor transducers to empirically measure cement bonding and/or well operations before and after cementation. Using methods of the present invention, conventional apparatuses can be usable to perform the necessary rig-less abandonment and cement bond logging before cementation, albeit in a less efficient manner, while benchmarking, developing, testing and improving a new technology method and apparatus is progressed until the technology is proven. Once one new technology method or apparatus has been proven, the new one can be substituted for the less efficient, e.g., conventional apparatus member.

Conventionally, cement may be bull-headed into the perforating gun penetrated producible zone (95F) and open hole (95E) reservoirs by injecting fluid, of the circulatable fluid column (31C), into the penetrations (129) of the liner (95) and open hole (95E) to abandon place cementation as a plug (108) without embedded well components, Alternatively, the circulatable fluid column can be used to clean and cement (109AQ1), with embedded conduits of the well preventing further production (34P), wherein logging through the innermost bore (114) can determine sufficient primary cement (101AQ1, 101) exists behind the liner (95) to isolate the reservoirs.

However, there is a risk of losing injection when conventionally bullheading cement, and an axially slideable annular blockage bypass member can be usable to bullhead cement with a significantly reduced risk of losing injection with the tubing full of cement. Additionally, the inability of conventional rig-less abandonment methods and apparatuses to access annuli, to perform logging and to determine primary cement existence and bonding behind casing, make it impossible to meet the published minimum industry guidelines for rig-less abandonment after placement of the initial bull-headed plug, thus forcing the use of an over specified drilling rig. The method (1AQ) can be usable to collect data and improve the rig-less abandonment of all or a portion of a well through a pressure controlled (8, 9, 10), coiled string (187) arrangement onshore and below ground level (121) or offshore and below mudline (122), beneath the ocean's surface (122A) on, e.g., a subsea wellhead (85 of FIG. 3) or offshore platform (170A and 170B of FIGS. 4 and 6), without resorting to conventional methods requiring a drilling rig (163-165 of FIGS. 1-3).

As wells are, generally, permanently abandoned from the bottom up, prior to performing operations at the upper end, an explosive severance (2AQ3) and a conventional inflatable packer, with conventional cross linked polymers above it, should it puncture, can be usable to crush compressible well components and form a space unobstructed by said components to access the annulus. Alternatively, a new technology annulus boring member (2AQ3) can be usable to access the annulus (111) and determine whether the well barrier element (109AQ2) has insufficient height to provide permanent well integrity for permanently and fluidly isolating the portion of primary cementation (101AQ2) of the well. An conventional straddle or axial slideable straddle member (2AQ4), bridging the annulus (110) production packer (40) bypass, can be usable to access the annuli (110, 111) through the bore made by the previous member (2AQ3), and potentially the sliding sleeve (123), to place cement above the well barrier element (109AQ2) within the annuli across the intermediate casing (92) cemented (101) shoe (98) and strata bore (99) to abandon the well primary cementation (101AQ2) using the circulatable fluid column (31C), circulated through the innermost bore (114), annuli (110, 111) and wellhead (85) outlets (97).

Abandonment of the next upper section may be performed using conventional severance or new technology comprising, e.g., a milling and shredding member (2AQ2) engaged with the motorized member (2AQ1) or other milling and/or shredding members (2AQ5) to remove the conduits (90, 91) and to place a permanent well barrier element across the strata bore (99) to seal primary cementation (101AQ3) of the well across the existing well barrier element (109AQ3) and casing (92), with logging of the primary barrier (109AQ3) occurring once the milling is complete and the intermediate casing (92) exposed, prior to placement of the barriers.

An upper well primary cementation (101AQ4) comprised of well components more difficult to mill, such as, e.g., a subsurface safety valve (74) with associated control line (79) and control line clamps within the production annulus (110), may be used and/or abandoned by first cutting the production tubing (2AQ6) with, e.g., a coiled string rotary cutter and, then, using a piston, to compress (2AQ7) or crush the well components for placement of a well barrier element (109AQ4) across the conductor (94) primary cement (101) and casing shoe (98) within the annuli (111, 112) through perforating gun penetrations or through a boring bit engagable conduit. Thereafter, pressure control (85, 86, 87, 88) is no longer needed, and the wellhead and upper end casing can be cut and removed from the well by conventional abrasive cutting (2AQ6) of any remaining conduits (94, 92), thus completing the rig-less abandonment. Given the relative depth of wells, being on average around 6,000 feet in depth, and the relatively short lengths associated with permanent well barrier elements, which are on average 100 to 500 feet, various embodiments (1, 12, 19, 42) may be tested between the various well barrier element placements without affecting the ultimate fluid isolation of the well, and wherein with each abandonment, further tools may be proven until the more efficient tools of the present invention are usable worldwide for a majority of wells.

Figure 38:
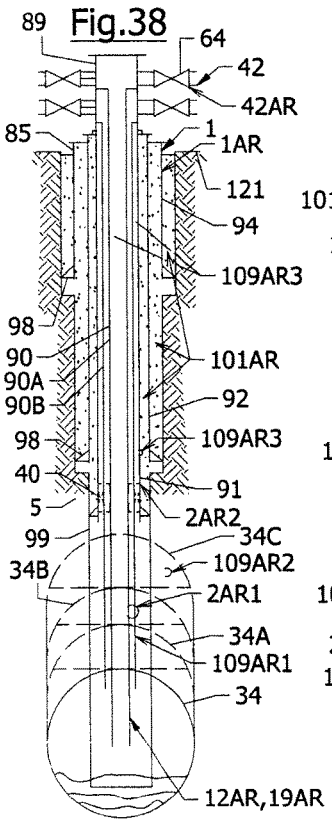

FIG. 38 is an elevation cross section view showing embodiments of a method (1, 19, 42) embodiment (1AR, 19AR, 42AR) for concentric cementation and cement bonding before and after said cementation and usable for benchmarking, developing, testing and improving new technology, usable with apparatus (12) embodiments (12AR) that can be usable with an associated placement tool (2AR) for placing technologies comprising, e.g., boring bit engagable conduit (2AR1) and axially slideable annular blockage bypass (2AR2) members, further usable for rig-less operations on a solution mining subterranean well. The Figure illustrates the use of a sealable boring bit engagable conduit (2AR1), to bridge across the annulus between inner (90A) and outer (90B) leaching strings, thus abandoning the cavern with some form of cementation (109AR1) comprising, e.g., a packable and sealable soil or debris, of the outer leaching string, and allowing fresh water to be applied to solution mining of a salt deposit (4) to expand (34A, 34B) the brine producible cavern (34), without using a drilling rig to first remove the inner leaching string (90A); and then, adjust the outer leaching string (90B) and subsequently replace the inner leaching string. After completing solution mining to form the storage product producible cavern (34C), using conventional technologies, the leaching strings (90A, 90B) can be removed and a production casing (90) can be engaged to the final cemented production casing (91) with a packer (40), and with a valve tree (89) and surface valves (64) installed at the upper end of the well, used for storage operations. Thereafter, cementation (109AR2) of the storage producible cavern (34C) can be used and/or abandoned in a rig-less operation by installing a axially slideable annular blockage bypass (2AR2) to flow around the packer (40) to circulate the cavern full of abandonment materials, e.g. solids debris, with the remaining cementation (109AR3) within the primary barriers (101AR) rig-lessly abandoned by circulating in a well barrier element, such as cement, using (2AR2), after which the wellhead (85) can be removed with abrasive cutting or other rig-less operations. A salt cavern may be fully emptied of hydrocarbons to remove risk and whereby benchmarking, developing, testing and improving new technology may take place without risk, until no further geologic space testing is possible or desired within the relatively shallow depths of salt caverns, after which final abandonment may occur with the proven new technology.

Figure 39:
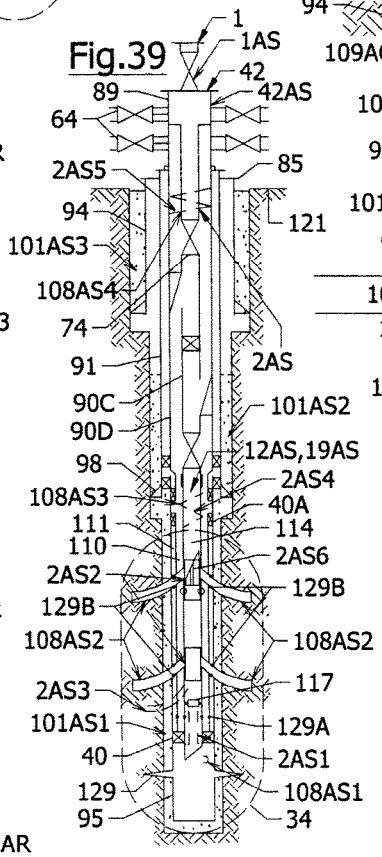

Referring now to FIG. 39, the Figure depicts an elevation view of subterranean slice through a well and strata showing embodiments of a method (1, 19, 42) embodiment (1AS, 19AS, 42AS) for benchmarking, developing, testing and improving new technology, usable with apparatus (12) embodiments (12AS) comprising a set of cementation placement tools (2) of axially slideable annular blockage bypass (2AS1) members, expandable circumferential engagable (2AS2) tubing patch members, rotatable guiding members (2AS6), boring bit engagable conduit (2AS3) members, and annular piston (2AS4, 2AS5) members, The method shown in FIG. 39 can be usable for rig-less operations on a manifold string well of the present inventor, with a dual (90C, 90D) producing string arrangement usable for under-balanced side-tracking operations.

Lower end penetrations (129A) and lateral passageway penetrations (129B) were placed using a bore selector, after which expandable circumferential engagable (2D2) members were placed across the lateral penetrations. Then, an axially slideable annular blockage bypass (2AS1) member can be placeable to abandon the lower portions (101AS1) of the penetrated (129) liner (95) to bypass lower production packer (40) and to circulate cement and displace cement with a wiper plug (117) through the inner bore (114) and annuli (110, 111), so as to abandon the previous side track portions (108AS2) of the well's primary barrier (101AS1), thus suspending final abandonment for a further side-track. A boring bit engagable conduit (2AS3) using, e.g., a flexible shaft and bit engagable with a fluid conduit is, then, usable to access, via a rotatable whipstock guiding member (2AS6), a different formation in the producible zone for production (34) above the cemented lower section and below the wiper plug (117), through the existing production conduit (90C) subsurface safety valves (74), valve tree (89) and production valves (64) engaged to the wellhead (85).

After cessation of production, the internal conduits (90C, 90D) may be severed and annular pistons (2AS4, 2AS5) can be usable to abandon the upper portions (108AS3) across the primary barrier (101D2) at the production casing (91) shoe (98) and upper portion (108AS4), across the primary barrier (101D3) of the conductor (94) casing, by compressing severed well equipment downward, and potentially aiding said compression with a jarring member. Thereafter, the upper portion of the wellhead (85), attached conduits and valve tree (89) may be removed with, e.g. rig-less abrasive cutting, to return the ground level (121) to its original condition.

Referring now to FIG. 40, the Figure illustrates an elevation view of a prior art pedal basket cement retainer (147) in various deployment stages (153-156), which is representative of most related slickline prior art dealing primarily with the securing of tools; and/or dumping, bailing or removing debris with a bailer; and/or placing small tools through a circular and relatively constant diameter well bore, albeit various nipple no-gos and planned restrictions or, for example, through the circular circumferences of a tubing tail pipe (90) and into the production liner or casing (91) of a significantly different diameter; as well as anchoring of tools (68) within the tubing (90), liner or casing (91).

Furthermore, while prior art or conventional cement retainer pedal baskets (147) are conventionally sizable to operate from, e.g., a 2⅜ inch outside diameter tubing to the inside diameter of a 9⅝ inch outside diameter casing, there are no apparatus or methods, other than those of the present inventor, suited for such expansion or the axial displacement of conduits laterally or vertically within a wellbore to provide concentric cementation and cement bond logging, both before and after cement placement, wherein concentric cementation within a wellbore requires either centralizing one conduit within another before placing cement or removing the one conduit from within another before cementing as illustrated herein.

In the illustrated example of a prior art deployment, the cement retainer (147) is first deployed (153) in a collapsed state to below, e.g., the tail pipe (90), shown as a dotted line, where the upper actuator (3, 150) is used to actuate the slips (149) and anchoring the retainer (147) to the casing (91), shown as a dotted line, in the second phase (154). The third phase of deployment (155) uses the second downhole actuating device (3, 151) to actuate the pedal (22) basket (148) within the casing (91), with an inner wall portion and outer wall portion shown as (5) and (4), respectively. The final phase of deployment (156) is to remove the upper actuator (151) and engagement shaft, leaving the central shaft (152) used to actuate the slips (149) and pedal (22) basket (148), via axially actuated shafts displaced along its length using a downhole actuator or drive tool (150, 151).

Numerous conventional actuators or drive tools are useable to perform these common actuation tasks within embodiments of the present invention, wherein the cited references provide various modifications to this conventional practice dating to the 1940's.

While prior art is not completely incapable of traversing substantially differing circumferences formed between the tubing (5, 90) and casing (4, 91) or open hole (158 of FIG. 41), it is important to emphasise that conventional technology presumes that the tubing and casing are not, e.g., clogged with debris or scale or crushed or collapsed, and wherein circular circumferences provide relatively low friction factors and whereby, e.g., a wireline entry guide is generally used at the lower end of a tailpipe (90) protruding within a casing (91) bore to aid traversing the differing diameters. Hence, while both the present invention and prior art are suited for a tail pipe, the present invention provides significant benefit by, for example, not requiring a wireline entry guide or circular circumferences, wherein the present invention also provides access or passage past debris within wellbore walls in addition to concentric cementation and cement bond logging that the prior art cannot provide.

FIGS. 41 and 41A show a diagrammatic elevation cross sectional view through a subterranean wellbore of a prior art coiled string deployable inflatable packer or bridge plug, and a chart showing the expansion capabilities of conventional inflatable packers and bridge plugs, respectively. As shown in the FIG. 41A chart, reproduced from the cited brochure of an industry leader in the art of inflatable technology, TAM International Inc., the deployment diameter of a conventional inflatable membrane packer is 3.75 inches if you wish to inflate the packer to engage the sides of a 9⅝" casing with an inside diameter of approximately 8.5 inches for the average North Sea wall thickness production casing. The deployment diameter of an element (labelled "el." in FIG. 41A) of 3.75 inches, may be acceptable for a 4½ inch outside diameter tubing weighing 12.6 pound per foot with a drift diameter of 3.833 inches, but it will not fit through heavier wall 4½ inch outside diameter tubing or smaller diameter API tubing and still engage or hold within the walls of said 9⅝" casing. Generally, this is not a significant issue because the primary purpose, as demonstrated by the chart, is to hold differential pressure, wherein said 3.75 inch deployment diameter inflatable packer is capable of holding between 3,000 and 4,000 pounds per square inch or between 206.9 and 275.8 bar differential pressure. An inflatable packer capable of passing through the 2.165 inch drift diameter of API 2.875 inch outside diameter tubing weighing 8.44 pound per foot could have a deployment diameter of 2.125 inches, with a maximum expandable conduit circumference engagement diameter of between 6 inches and 7 inches according to said leading manufacturer's chart.

Accordingly, as shown in FIGS. 41 and 41A, if a conventional inflatable packer (157) is capable of being deployed on as string (8) through the 2.165 inside drift diameter of 2⅞ inch outside diameter tubing (90), into an 8.5 inch inside diameter casing (91) cemented (101) within an open strata bore (158), generally sized to a minimum of 12¼inch inside diameter, and referred to as "open hole," then said conventional packer is not capable of either engaging the casing or the open hole with the slip segments (160) secured to its membrane (159), at its maximum inflation.

Referring now to FIGS. 42 and 43, the Figures depict a diagrammatic elevation cross section along a horizontal well bore (10), with line A-A associated with the FIG. 43 cross section through line A-A of FIG. 42, transverse to the well bore axis. The Figures illustrate the embodiments (1A, 19A, 2A, 42A) of methods (1, 19, 42) and apparatus (12) embodiments (12A) using a placement tool (2) embodiment (2A) for concentric cement placement and bonding measurement and for accessing or passage through dissimilar contiguous passageway walls (9), using a tool string (8) embodiment (8A) and downhole drive tool (3) that can comprise an inflatable membrane that is usable as a drive piston, which are usable when, e.g., removal of debris is not necessary. Additionally, open hole surrounding bore (10) of the well depicts a portion of a well below casing and the innermost deployment bore (9).

Traversing and/or plugging a horizontal well bore (10) without debris removal may be necessary during, e.g., abandonment operations to provide concentric cementation within a surrounding bore (10) by supporting a cement-like settable sealing material and preventing the heavier cement-like fluid channeling on the lower end of the horizontal bore, while lighter downhole fluid channels along the upper portion of the wellbore and, contaminates the cement-like material to weaken it, thus preventing its setting and/or sealing for said abandonment.

Accordingly, upper (83A) and lower (83B) transducing transponder coupling tools (83) may form part of the tool string (8) and, e.g., a subsequent tool string to place coupling tool (83A) on the tubing (9) or casing, wherein a signal (84) passed through the strata (84A) between the transducer sensors (83) is usable to determine if the cement has bonded to the open hole and casing, or to the tubing (10A) surrounding bore (10). If the cement has not bonded and a fluid passageway or leak exists, the signal passed between the two transducers (83) will differ from a signal passed through solid cement and strata, wherein using the methods of the present invention for benchmarking and testing with conventionally lower cost wireline responses for the strata in question, may be developed and improved so as to improve cement bond logging through repeated data collection in similarly aged and stacked well bore stratigraphy and lithology.

The tool string (8) may be traversed through a pilotable passage between wall portions (4) of open hole (4A) dissimilar to another open hole (5A) wall portion (5), further complicated by debris (76) therein forming, in amalgamation with the innermost bore (9A), and the dissimilar contiguous passageway walls (9A) of a well bore (10). The tool string embodiment (8A) may comprise, e.g., slickline, electric line, coiled tubing or jointed pipe with, e.g., a lower end coiled string compatible connector (17), to minimise the number of different off-the-shelf tools required to engage to the drive tool (3) circumferentially adaptable placement tool (2A), comprising a plurality of shaft segments (6). Shaft segment embodiments (6AI-6A3) may comprise an encompassing shaft (6AI) with rotor (6A2) and stator (6A3) shafts that can be usable as a momentum vibrator (73) and positive displacement valve (11) embodiments (73A and 11A, respectively) with orifices (28) for fluid intake (32) and exhaust (33) from the vibrator and valve, with a spring-like joint (23) embodiment (23A) interoperable with an axial displacement member (7) embodiment (7A), comprising a downhole drive tool (3) embodiment (3A) and further comprising an inflatable membrane (15) embodiment (15A).

The tool string (8A) may be urged, using surface applied fluid pressure (31) against the drive tool (3), through the substantially differing diameters of the open hole (9A) from, e.g., a near vertical to near horizontal inclination using differential pressure across drive tool (3A) member embodiments (118A, 35A) of a packer (118) or bridge plug (35), when urged to a desired disposition along the wellbore (10), wherein a fluid passageway (24) embodiment (24A) formed by the positive displacement valve (90A) cavity between, e.g., a helical rotor (6A2) and stator (6A3) is fluidly routed between the left and right orifices (28) to use the difference between surface (31) and bottom hole pressure (32) to actuate the positive displacement valve (11A), which is fluidly exhausted (33) past the packer with axial movement of the string (8A).

The passageway (A111) may also be selectively and fluidly connected via the placement tool (2A) to provide both axial placement and fluid communication past the piston, via, e.g., a pressure activated valve, to fill and deplete the fluid filled deformable material membrane (15) for selectively exhausting the fluid to collapse said membrane (15A), when piloting a restricted effective diameter of the dissimilar contiguous passageway walls (9A), and to intake fluid to expand said membrane when said effective diameter increases, using said positive displacement valve interoperability between the differential pressures of applied surface pressure (31) and bottom hole pressure (32) across the packer (118).

FIG. 44 depicts a diagrammatic elevation view of a prior art boring bit (13) and the flexibility of its combined flexible and rigid shaft (36), which can be usable within any present embodiment as a downhole drive tool (3) and/or hole finder. Various other flexible shaft arrangements, described in application publication GB2484166A of the present inventor, can be combinable with the method and apparatus of the present invention.

Referring now to FIGS. 45 and 46, the Figures illustrate a diagrammatic elevation view of a slice along the axis and a diagrammatic plan cross sectional view transverse to the axis along two subterranean wellbore's (10) dissimilar contiguous passageway walls (9E, 9F1, 9F2), respectively. The Figures show method (19) embodiments (19E, 19F, 19G) and apparatus (12) embodiments (12A) with placement tool (2) embodiments (2E, 2F, 2G) usable with tool string (8) embodiments (8E, 8F, 8G) and a downhole drive tool (3), which can be usable to access or provide passage through, e.g., collapsed wellbore walls resulting from strata movement (38) and/or wall portions with scale debris from production so as to first measure cement bonding and, then, provide concentric cementation and cement bonding before and after placement.

A string (8), comprising a coiled string, but usable with, e.g., jointed pipe or jointed shaft strings, forms part of the tool string (8) comprising circumferential boring or expandable wedging (37) downhole drive tools (3E-3G), which can comprise any mechanical cutting tool (13), e.g. a rotary drill bit for metal and/or rock, wedging downhole drive tool (37) or axial displacement wedge, engagable with a placement tool (2E-2G) that can comprise a plurality of shafts (6) and an axial displacement member (7). A flexible shaft (36, 6E1) can be usable, when oriented by an axial displacement member (7), to selectively pilot between wall portions (4E and 5E, 4G and 5G, 4F1-4F3 and 5F1, 4F4-4F6 and 5F2, 4F7-4F9 and 5F3) of substantially differing effective diameters, thus forming dissimilar contiguous passageway walls (9), within a well bore (10). An arrangement of a plurality of shafts (6), comprising a flexible shaft (6E1), may be rotated or extended and retracted within or through encompassing housing shafts (6E2, 6E3) with an intermediate flexible (75) knuckle or ball joint (75E) that can be selectively alignable with an axial displacement member (7, 7E) to pilot and traverse a tortuous path through, e.g., a collapsed subterranean wellbore. A series of various proximally axially contiguous pilotable passages (4F1-4F3, 4F4-4F6, 4F7-4F9) may be accessed and deformed to a larger effective diameter to provide passage wall portions (5F1, 5F2, 5F3, respectively) to allow a still larger deformation of a wall portion (4F) to a wall portion (5F) to provide an enlarged passageway for tool passage using boring (13, 3F) and/or wedging (37, 3G) downhole drive tools (3) and/or axial displacement members (7) of a placement tool (2).

FIGS. 47 and 48 depict diagrammatic isometric views of wellbore (10) walls (9) before and after being deformed by subterranean strata movement (38), respectively, while FIG. 49 shows a diagrammatic isometric view of a prior art approach to gaining access or passage to the FIG. 48 well, which has resulted in a side-track of the subterranean well bore (10) due to its dissimilar contiguous passageway walls (9). The wellbore (10) walls (9) comprising, e.g., casing (9B2) and production tubing (9B1) are deformed by moving strata forces (38) forming substantially differing circumferences (4B, 5B) that cause the tubing to become conventionally unusable and effectively debris (76) within the wellbore.

Side-tracking of a damaged portion of a wellbore without first abandoning the lower section of a wellbore (10), which is fluidly connected with a reservoir, is particularly risky, because once the side-track has occurred, it is virtually impossible to re-enter the original dissimilar contiguous passageway since an axially deployed string always favours the axially aligned side-track; however fluid from the reservoir is free to follow through any passageway not restricted by fluid capillary friction. Hence, the reservoir cannot be effectively abandoned because the heavier and more viscous kill weight mud and/or cement like fluids cannot be injected through the same pore or passageway spaces and/or become contaminated from percolation of buoyant lighter and more fluid reservoir gases and liquids axially upward.

Killing of an intermediately collapsed wellbore is difficult because reservoir fluid may continue to percolate through various permeable pore spaces or strata fractures that are not fillable with kill weight fluid, typically referred to as kill weight mud due to its composition and consistency. Hence, it may not be possible to kill the well with heavy mud to allow replacement of the surface valve tree with a blowout preventer. Accordingly, conventionally high risk snubbing and stripping operations may be necessary when a well cannot be killed effectively and conventional hydraulic workover units, drilling rig may be needed.

The boring capabilities of conventional and prior art boring arrangements (39), e.g. coiled tubing arrangements and/or rotary cable tools of present inventor (GB2471760), without the piloting capabilities of a placement tool (2), may be unsuited for accessing and providing a passageway to allow abandonment of the damaged well, because of their propensity to deflect off of the substantially differing effective circumferences of deformed wall portions (4, 5) and side-track the well, thus losing access to the wells lower fluid reservoir fluid connection.

Referring now to FIGS. 50 to 52, the Figures show diagrammatic isometric views of the wellbore (10) walls (9) of FIG. 48 and illustrate method (19) embodiments (19B, 19C, 19D) and apparatus (12) embodiments (12B, 12C, 12D) with associated placement tool (2) embodiments (2B, 2C, 2D), which can be usable with a tool string (8) embodiments (8B, 8C, 8D) and downhole drive tool (3) to provide access or passage through dissimilar contiguous passageway walls (9B1, 9B2), wherein flexible shaft arrangements can be used to gradually increase the effective diameter, and wherein progressing to more rigid shaft arrangements can be usable to proximally align the upper end of the wellbore with the lower end so as to install an intermediate conduit, e.g. an expanded flexible metal pipe encompassing shaft (15D) about an expander downhole drive tool (3D1) at the lower end of an expander shaft (6D), to provide a more pilotable passageway for deployment strings to traverse and through which sensor transponders and/or conventionally logging tools may be placed to empirically measure cement bonding before cementation, and disposing a sensor transponder downhole or providing (211-220) of FIG. 15 to ensure cement bonding during or after cementation.

A tool (8B, 8C) string (8) can comprise, e.g. slickline or other coiled string, deploying a placement tool (2B, 2C) with a plurality of shafts (6) that can be usable with jointed (75B) linkage and (14B) bow spring and/or skated anti-rotation rotational anchoring of a motorized downhole drive tool (3B), engaged to a flexible rotatable shaft (6B2, 6C2) with a universal joint drive coupling (75B) and lower end mechanical cutter (13), e.g. a rotary boring bit, with an upper end, e.g., positive fluid displacement motor rotary cable tool of the present inventor, electric or coiled tubing motor, comprising a substantially rigid shaft (6B1, 6C1), which can be held substantially stationary by an axial displacement member (7B, 7C), comprising, e.g., 7T1 and 7T3 of FIGS. 72 to 80, 14AC-14AA of FIGS. 82 to 87 and 7AE1-7AE2 of FIGS. 96-102 and usable to further deform and provide access or passage through the dissimilar contiguous passageway walls through deformation of the wall portions (4B, 5B) of substantially differing circumferences. Various mechanical cutters (13), e.g. the boring cutter (13) of FIGS. 44 to 46; the abrasive lateral cutters (13AE) of FIGS. 96 to 103; a wedging (3D, 3C), explosive (3M1-3M3) and/or sculpting (18M1-18M3) downhole drive tool (3) oriented with a mechanical linkage (14C) according to the diameter of the tool assembly relative to the innermost passageway, or axial displacement members may be used and oriented with the tool string (8). Once assess or passage has been provided, it may be improved by, e.g., engaging a straddle conduit to reconnect the tubing (9B1) or expandable conduit (15D) using a placement tool (2D) to place and orient a wedging downhole drive tool (3D2), via an axial displacement tool (7D), to wedge the expandable conduit radially outward with an expander (3D1) and further deform debris from, e.g., boring to further improve access and passage through frictionally obstructive debris (76).

FIGS. 53 to 59 illustrate the proportions of a collapsed 6⅝" conduit with a 1 inch wall thickness made of very hard 125,000 psi yield strength material, which was described by a major producer who has a significant number of similarly damaged wells and has exhausted the obvious conventional practice and prior art in search of a solution. As shown, the wells are in fluid connection with a reservoir and are losing access to the lower end of a wellbore due to side-tracking as a major risk.

FIGS. 53, 54 and 55 illustrate a plan view where FIG. 54 depicts an elevation view with break lines, and FIG. 55 depicts an isometric view with the FIG. 54 break line portion of the subterranean well bore's (10) walls (9) removed, with dashed lines showing hidden surfaces. The Figures show a method (19) embodiment (19H) and apparatus (12) embodiments (12H) with a plurality of placement tool (2) embodiments (2H) that can be usable with a plurality of tool strings (8) embodiments (8H) and downhole drive tools (3) to provide access or passage through dissimilar contiguous passageway walls (9H), which can be usable with, e.g.,: tool strings deploying image logging downhole drive tools (3) usable to empirically measure, e.g., three dimensional space disposition, orientation, inclination, temperature, pressure and orientation of various walls, as well as look ahead with continuation imaging to determine a most likely axial orientation between wall portions (4H and 5H), necessary for the planning and selective configuration of a tool string embodiment for access and passage to the lower end of the well bore (10), below the substantially differing circumferential deformations and/or debris caused by strata movement (38).

Logging of the maximum force (38H1) plane and minimum force (38H2) plane of strata movement, as well as strata bonding to the collapsed conduit, and strata properties above and possibly below the moved strata, may be possible using an imaging logging downhole drive tool (3), with the string (8) oriented by a placement tool's (2H) plurality of shafts (6) and axial displacement member (7) engagement with various wall portions.

The plurality of tool strings (8), downhole drive tools (3H) and associated placement tools (2H) can comprise various coiled strings comprising, e.g., slickline, electric line or coiled tubing or jointed shafts or pipes used within the dissimilar passageway walls (9) for their various properties. These various properties can include: (1) the ability of coiled strings to be deployed and retrieved relatively quickly compared to jointed pipe to allow more runs in and out of the well bore (10); (2) the ability to more easily rig-up pressure control equipment above an existing valve tree, or Xmas tree, and wellhead as well as seal around a continuous coiled string using, e.g., a stuffing box or grease injector head compared to jointed pipe, snubbing and/or stripping operations; (3) the ability to quickly change logging tools and provide real-time image logging information using, e.g. electric line or memory data using, e.g. slickline compared to pulse communicating logging tools at the lower end of a jointed string; (4) the ability for logging information transmitted through the casing and using embodiments of the present invention; and (5) the associated ability to make a plurality of tool string runs into and out of the well with various tools, as wells as the ability to make smaller and more controllable deformations of damaged downhole well components, to reduce the risk of side-tracking a well when providing access and passage compared to the jointed pipe operations; whereby the advantage of jointed pipe is, e.g., its ability to more effectively rotate and mill damaged well components into small pieces, once the well can be killed and/or the reservoir fluid connection with surface or sensitive strata formations becomes controllable.

Additionally, the plurality of tool strings (8H) and associated deployments may include, e.g.: the above image logging downhole drive tool (3H) electric line deployment; followed by a slickline deployment of an explosive sculpting downhole drive tool (3H) similar to, e.g., (4I, 4J, 3Y and 3M1-3M3) wall portions and downhole drive tools of FIGS. 56-57 and 58 and FIGS. 62 and 70, respectively; followed by a slickline deployment of an abrasive milling downhole drive tool (3H) similar to, e.g., the fluid turbine downhole drive tool (3AE1-3AE2) of FIGS. 96 to 103; followed by slickline deployment of a wedging downhole drive tools (3H) similar to, e.g., wedging devices (3W, 3Z) of FIGS. 91 and 95, respectively; followed by a small diameter relatively flexible jointed pipe deployment using a conventional carbide encrusted milling downhole drive tools (3H) oriented with a placement tool (2H) usable to pilot the conventional mill into position; followed by a relatively flexible jointed pipe deployment of an expandable conduit downhole drive tool (3H) piloted through the dissimilar passageway walls (9) with a placement tool (2H). Thereafter, the conduit can be expanded to provide access and passage through frictionally obstructive debris (76) within, or at least a partially restricted circular or deformed circumference of, said dissimilar passageway walls (9).

Referring now to FIGS. 56 and 57, the Figures depict a plan view and the upper end of an elevation view above a break line, with dashed lines showing hidden surfaces, which illustrates a method (19) embodiment (19I) and apparatus (12) embodiment (12I) with placement tool (2) embodiment (2I), usable with a tool string (8) embodiment (8I) and downhole drive tool (3) to provide access or passage through dissimilar contiguous passageway walls (9I). Previous deformation of a wall portion (4) has resulted in a new wall portion (4I) providing an axially deeper dissimilar passageway wall (9I) formed by and/or usable with a downhole drive tool (3I) comprising, e.g., explosive sculpting downhole drive tool (18) embodiment (18I) using, e.g., oriented shape charge downhole drive tools (3, 3M1-3M3) of FIG. 62 or axially downward perforating downhole drive tool (20) embodiments (20J) of FIG. 58, oriented by a placement tool (2I) plurality of shafts (6) and an axial displacement member (7) to further deform the wall portions (4I, 51) and further provide access or passage through the dissimilar passageway walls (9).

Figures 60, 61, 62, 63, 64, 65:
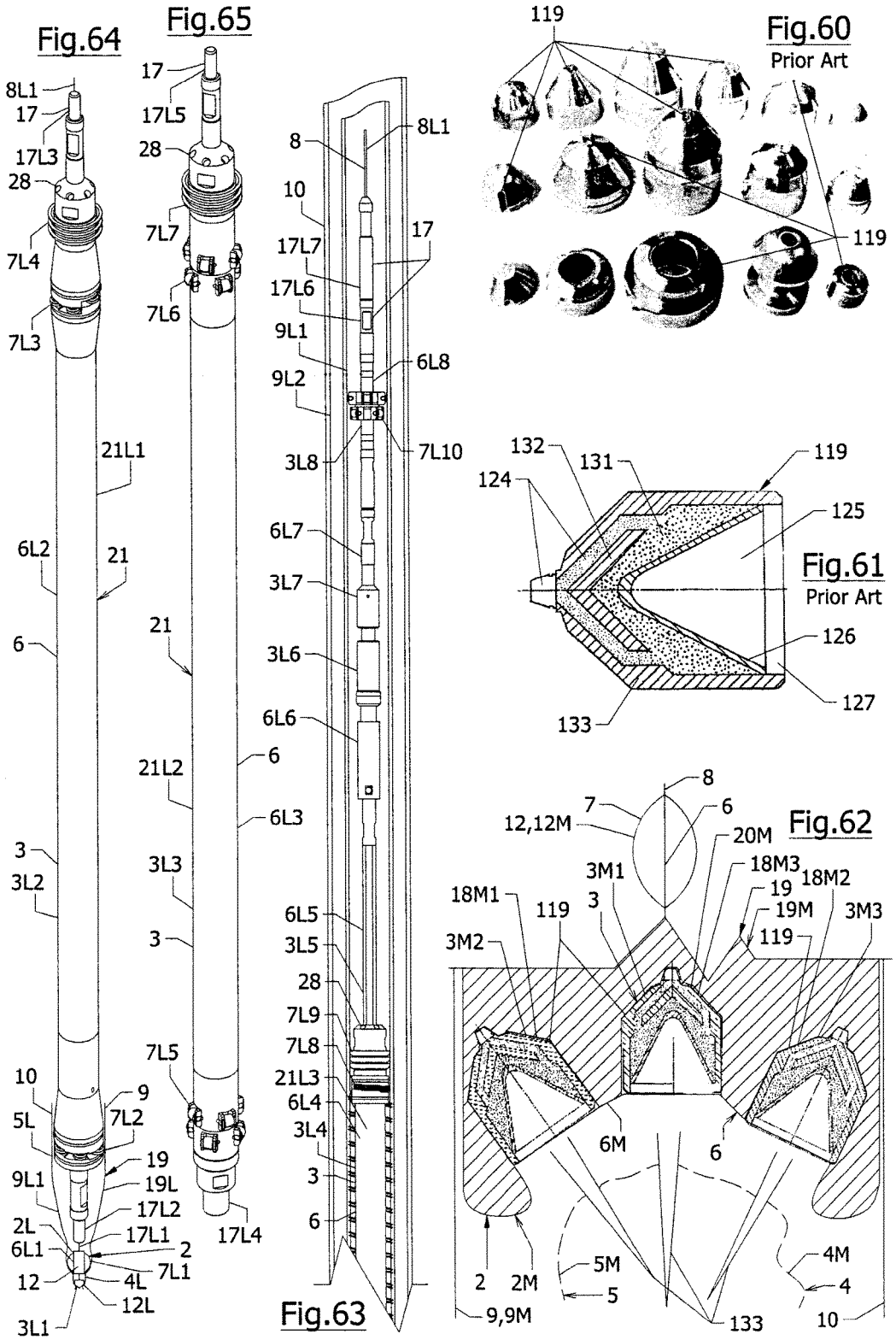
Fig.60 Prior Art
Fig.61 Prior Art

Alternatively, the downhole drive tool (3H) may comprise a boring bit with an upper-end motor (21), e.g., (21L1) and (21L2) with associated upper-end coiled string compatible connectors (17L1) and (17I2) of FIGS. 64 and 65, respectively, comprising said plurality of shafts (6). Perforations (20I) may be placed to allow fluid circulation if fluids cannot be injected into the reservoir through the well bore's dissimilar passageway walls (9). Sensor transponders and/or conventionally logging tools can be placed to empirically measure cement bonding before cementation and disposing a sensor transponder downhole or providing (211-220) of FIG. 15 to ensure cement bonding during or after cementation.

FIG. 58 shows a plan view, with dashed lines showing hidden surfaces, depicting a method (19) embodiment (19J) and apparatus (12) embodiment (12J) with placement tool (2) embodiment (2J), which can be usable with a tool string (8) and downhole drive tool (3) to provide access or passage through dissimilar contiguous passageway walls (9J). Axially explosive cutting perforation (20) downhole drive tools (20J) can be used to weaken a wall portion (4J) and to disturb supporting strata behind said wall portion to aid a wedging (37J) or boring downhole drive tool (3J) that is engaged to the circumferential apparatus (2J), which was deployed with a string (8) embodiment (8J), and to further deform said wall portion (4J) and provide access or passage through dissimilar passageway walls (9) to provide concentric cementation and cement bonding before and after said cementation, as described in various embodiments.

FIG. 59 illustrates a diagrammatic elevation view, with dashed lines showing the well bore prior to deformation, depicting a method (19) embodiment (19K) and apparatus (12) embodiment (12K) with placement tool (2) embodiment (2K), which can be usable with a tool string (8) embodiment (8K) and drive tool (3) to provide access or passage through dissimilar contiguous passageway walls (9K). This access or passage can be provided by, e.g., using a plurality of coiled string tool string (8) deployments (8K), using a plurality of explosive sculpting cutting downhole drive tools (18K), and/or perforating downhole drive tools (20K), and alternating deployment of image logging downhole drive tools (3K) operating sensors to measure deformation of the explosively deformed dissimilar passageway walls (9), including any wall portions (4K, 5K) as shown FIG. 59. Any shaped charges (119 of FIGS. 60 and 61) can be arranged according to the previous image log data in, e.g., the oriented arrangement (2M) of FIG. 62, to provide passage between the upper and lower ends of the wellbore (10) in selectively controllable tool string runs and method steps, whereby after gaining access to the lower end of the well bore, it may be, e.g., abandoned or suspended to allow repair of the dissimilar passageway walls (9) without a fluid connection to the reservoir, during said repair or abandonment.

Referring now to FIGS. 60 and 61, the Figures illustrate an isometric view and cross section along the explosive cutting axis of prior art shaped charge (119) technology, wherein any shape and size of shaped charge is available to provide selective control of explosive perforating and sculpting operations. Generally, a shaped charge is comprised of a liner (126), explosive (131) and case (128). The case (128) defines an interior volume in which the liner (126) is positioned, wherein the liner (126) defines an interior volume (125) and has an opening thereto. The opening is surrounded by a rim portion (127) of the liner (126), whereby the ignition system (124) ignites the explosive (48), which explodes in a pattern associated with the deflector (127), interior volume (125) and casing (128) shape to exit through the rim portion (127) in an explosive cutting force jet (133 of FIG. 23), that can be selectively controllable by the various components of the shaped charge (119), and which is usable within the present invention to perforate and/or sculpt wall portions (4, 5) in a controllable manner, according to the orientation of any shaped charge or other explosive and/or associated chemicals forming a chemical cutter that can be piloted through a deformed passageway of substantially differing circumferences along a wellbore's walls (9), using the present invention.

FIG. 62 shows a diagrammatic cross section view through the explosive cutting axis, with dashed lines showing the wellbore walls being further deformed by a method (19) embodiment (19M) and an apparatus (12) embodiment (12M) with a placement tool (2 embodiment (2M) usable with a tool string (8) embodiment (8M) and a downhole drive tool (3) to provide access or passage through dissimilar contiguous passageway walls (9M). Using image logging tool string empirical data, a placement tool's (2M) engagement and orientation with the dissimilar contiguous passageway (9M) wall portion can be arranged and carried out to provide a selective deployment and sculpting or perforating of a wall portion (4M) to form a larger wall portion (5M) proximally axially contiguous with the desired access and passage of tools using (18M1-18M3) shaped charges (119) or perforating (20M) shaped charges (119) oriented within the apparatus (2M) piloted by its shaft (6) and axial displacement member (7) at the lower end of the tool string (8). As explosives may form relatively sharp debris and/or sharp edges on deformed walls, various other embodiments can be usable to pilot the traversable dissimilar passageway to further deform explosive debris.

Additionally, the axial firing of explosives presents the problem of transmitting a fluid hammer effect axially within the wellbore, whereby the objective is generally to focus or funnel such a fluid hammer away from the surface and toward the walls being deformed. Various tool embodiments, e.g., 2X, 2Y, 2W and 2Z of FIGS. 81, 90, 91 and 94, are usable to absorb and/or focus/direct a fluid hammer effect associated with and similar to axially oriented explosive jets (133).

Referring now to FIGS. 63, 64 and 65 which depict rotary cable tools of the present inventor. FIG. 63 shows an elevation view of a slice through the well bore's (10) walls (9L1, 9L2) usable with the FIG. 64, which depicts an isometric view of an embodiment using a rotary cable tool motor and a reactive torque tractor. FIG. 65 shows an isometric view of a cable conveyable positive displacement fluid motor rotary cable tool, also usable with the embodiments (19L) of the methods (19) and the embodiments (12L) of the apparatus (12) shown in FIG. 64, with placement tool (2) embodiments (2L) comprising a tool string (8) embodiment (8L) for using a downhole drive tool (3) to access or to pass through dissimilar contiguous passageway walls (9L), wherein the various functions of (6L2-6L7, 7L2-7L10, 17L2-17L7 and 21L1-21L3) are further described by the present inventor in application publication GB2484166A.

Various elements of a tool string (8L1) may represent both members of a placement tool (2L) and a downhole drive tool, e.g., a plurality of shafts segments (6L2, 6L3, 6L4) may also comprise motor downhole drive tools (3L2, 3L3, 3L4, respectively). The shafts or motors may be those of the present inventor or, e.g., conventional electric or hydraulic downhole motor devices. Similarly, axial displacement members (7L2-7L10) may represent various coiled string compatible and pilotable members that extend from the axis of the tool string via a flexible hinge, e.g., the drive wheels of a reactive torque motor tractor (7L2-7L3, 7L9) can flexibly extend and retract from a shaft (6L2, 6L4, respectively) via the torque caused by rotation. Sealing cup seals (7L4, 7L7, 7L9) can flexibly expand and contract from between a shaft (6L2, 6L3, 6L4, respectively) to direct fluid through orifices (28) past the kelly (3L5), swivel (3L6), emergency disconnect (3L7) and anti-rotation (3L8) to a positive displacement fluid motor (21L1-21L3) device (3L2, 3L3, 3L4, respectively), and anti-rotation devices (7L5-7L6, 7L10) for motor devices (3L3, 3L4, respectively) can be flexibly hinged to shafts (6L3-6L4, 6L8, respectively).

Alternatively the motor downhole drive tools, for example (3L2, 3L3, 3L4), can comprise electric motors or pneumatic motors, which can be piloted through and/or used to deform restricted passageways via the methods (19L) and/or apparatus (2L) of the present invention. A downhole motor (21) device (3L2-3L4) or plurality of shaft segments (6L2-6L4) of a placement tool (2L) can be used to, e.g., rotate a shaft (6L1) and lower end boring bit downhole drive tool (3L1), which can be piloted by an axial displacement member (7L1).

Accordingly, while the present apparatus (2L) is preferred, the present method (19L) may use various other apparatuses assembled in an interoperable combination to form a tool string (8L) to, in use, traverse a pilotable passageway between, or to further deform a well bore's (10) lower end dissimilar contiguous passageway walls (9) formed by first wall portion (4L) and at least a second wall portion (5L) of substantially differing effective circumferences.

Figure 66:
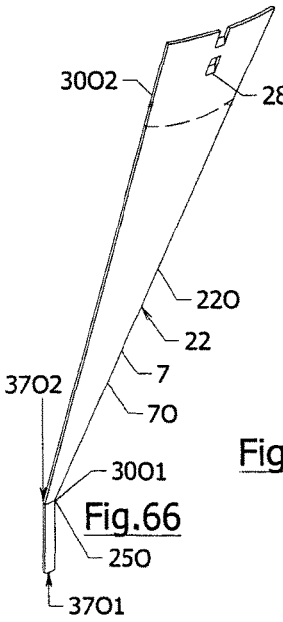
Figure 67:
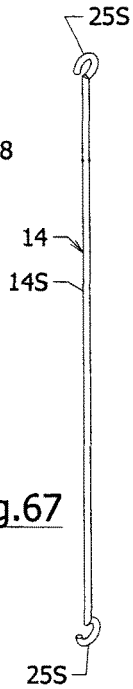

FIGS. 66 and 67 depict isometric views of an embodiment (22O) of a pedal (22) usable for a pedal basket and an embodiment (14S) of a mechanical linkage arm (14) that can be usable together with various other embodiments (e.g. 7O)

of an axial displacement member (7) of the present invention. The flexible hinge (25O, 25S) can be formed with, e.g., a deformable material (30O1) engagable to a shaft of a placement tool (2). The pedal (7O) can be deployed between, e.g., wedging shafts, wherein an engagement wedge shaft (37O1) can be forced against a wedging shaft (37O2) to deform the material (30O1) of the flexible hinge (25O). A sealing deformable material (30O2), e.g. elastomeric material or coatings, can be used and placed at the wall engagement to provide a seal to the well bore wall (9).

Figure 69:
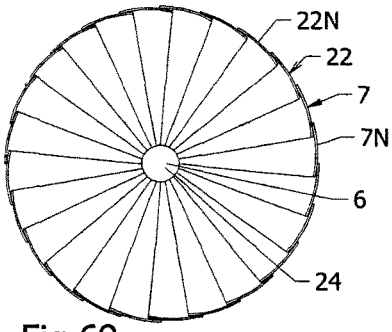
FIGS. 66 to 72 illustrate various parts of axial displacement member embodiments usable to form a placement tool of the present invention.
Figure 70:
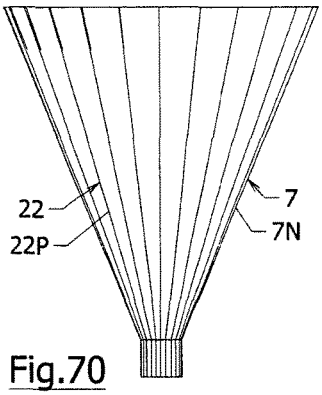
Figure 68:
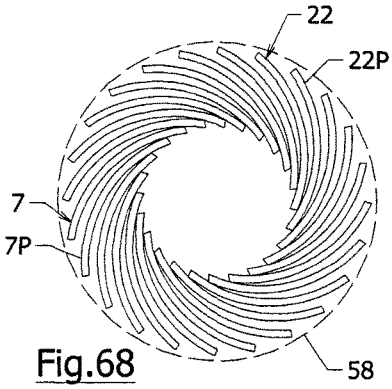

The pedal (7O) may be deployed in any arrangement, e.g. like that of FIGS. 68 to 70, to provide engagement with a well borewall (9), wherein an orifice (28) for a mechanical arm (14S) engagement may be used to extend and/or retract the pedal (70). The mechanical arm (14S) can be engaged to multiple axial displacement members (70) and/or member components, e.g. (7T) of FIG. 73, wherein the arm (14S) is connected between upper (22T1 of FIG. 73) and lower (22T2 of FIG. 73) pedals (70).

Referring now to FIG. 68 which shows a collapsed plan view of an embodiment (22P) usable with the FIGS. 69 and 70, which depict an expanded plan view and elevation view embodiment (22N, 22P) of a pedal basket (22), respectively, that can be usable with various other embodiments of an axial displacement member (7) of the present invention. Axial displacement member pedals (7P), e.g. (7O of FIG. 66), may be overlapped and deformed around a shaft to form a collapsed pedal basket (22P), which can be expanded by any means, e.g. by wedging shafts (37O1-37O2 of FIG. 66) or mechanical arms (14S of Figure A67) and/or a linkage with an inflatable membrane, to form an expanded pedal (7N) basket (22N). The pedal basket (22N) may focus, support and/or protect, e.g., an elastomeric funnel, bladder and/or fluid inflatable packer/bag or cement like material or, e.g., the forces of a fluid hammer axially transmitted through a well bore by, e.g., an explosive or hydraulic jar.

An axial displacement member (e.g. 2P/2N) can be interoperable with, e.g., shafts (6), passageways in shafts (24), springs, shock absorbers and any other downhole drive tool usable to automatically expand and collapse said axial pivot member so as to retain engagement with or pilot varying substantially differing circumferences as it is traversed through a well bore to, in use, pilot other engaged downhole drive tools (3), as shown, e.g., in FIGS. 73 to 82 embodiment (2T). Any material, e.g. carbide to abrade debris during passage or rotation and/or elastomers to seal against a wall portion during passage, can be engaged to a pedal (e.g. 22O of FIG. 66) to provide various downhole functions, wherein recovery of debris is not necessarily the objective, but possibly tool string deployment or displacement and associated intervention with wall portions necessary for piloting or further deforming of a passageway with the deployed tool string or another subsequent tool string.

Figure 72:
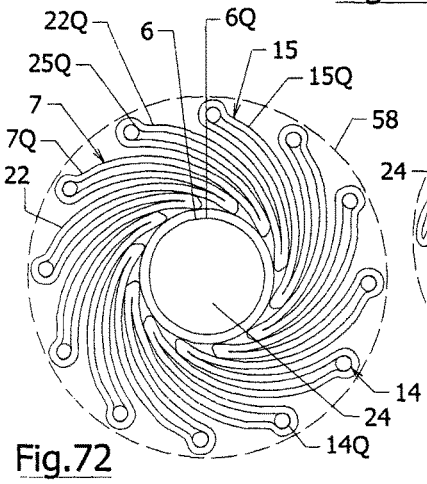
Figure 71:
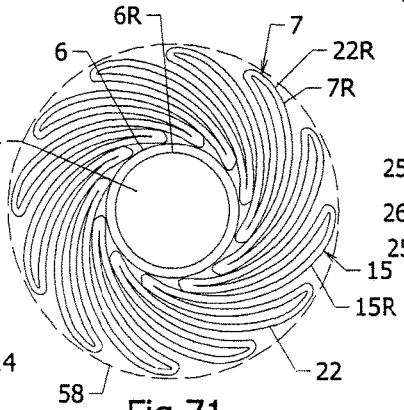

FIGS. 71 and 72 depict collapsed plan view slices across a plane transverse to the shafts axis, usable during, e.g., deployment and prior to expansion downhole or during retrieval of the axial displacement member (7) embodiments (7R, 7Q, respectively) and membrane (15) embodiments (15R, 15Q, respectively), which can be usable with various other embodiments of the present invention. Various combinations of axial displacement members, e.g., a pedal basket (22N of FIGS. 69 and 70) with the membranes (15R, 15Q), can be usable to form an axial displacement member, e.g. similar to (7T) of FIGS. 73 to 80. Mechanical arms (14Q) can be incorporated with hinges (25Q) engaged to a membrane (15Q) for support around the membrane's circumference to aid engagement with an irregular circumference of a wall portion (4, 5) and to aid urging the expansion or collapse of a membrane.

The folding of the membrane (15Q, 15R), which can be made of elastic material that can expand, provides increased enlargement capabilities compared to conventionally wrapping a single elastically expandable layer about a shaft. Shafts (6Q, 6R) may be solid or, as shown, may have an internal passage usable for an internal pass through shaft and/or fluid communication to operate a membrane (15Q, 15R), valve, motor, or other fluid device. An axial displacement member can have a deployment diameter (58) and associated circumference, which may be irregular as shown, and an effective diameter or circumference after expansions that may or may not (15A of FIG. 43) be proximally circular.

A membrane (15Q, 15R) can be arranged to form a bag or packer-like shape similar to (15A), (15T), (15U) of FIGS. 42, 73-80 and 95, respectively, or a conical shaped single continuous pedal basket (22Q, 22R), or a conical wrap similar to (22N) of FIGS. 69 and 70. The folding or overlapping of material or pedals can lessen with the axial distance from the plan view slices, as shown in FIGS. 68, 71 and 72, until a single layer without folding or overlap exists in a conical shape. For bag or packer shaped membranes, the progression from folding to single layer about the associated shaft occurs on both ends of the FIGS. 71 and 72 plan slice views. For conical shapes, similar to (22N) of FIGS. 69 and 70, the transition from folding or overlapping occurs on only one axial side of said plan view slices.

Accordingly, any form of cellular, envelope, bag or packer shapes may be formed to hold fluids within and to separate cells forming a packer or single cell forming a packer. Conical shapes may be formed to hold fluids or debris in one axial direction with significantly less fluid or debris holding capacity in the other.

Various membrane embodiments of the present invention need not be made of conventional inflatable elastomeric material, designed to hold a stationary position across a large differential pressure, but rather, in various instances, embodiments may be formed with relatively thin material capable of being folded. The present invention is capable of a larger expansion diameter to deployment diameter (58) ratio, compared to conventional apparatuses. For example (e.g.), a conventional 2.125 inch deployment diameter inflatable is capable of expanding to a 6.5 inch diameter, as shown in FIG. A41A, which results in a ratio of approximately 6.5/2.125=+/−3.1. The folded membranes (15R, 15Q), having a similar 2.125 inch deployment diameter, may be unfolded to a circumference equal to a diameter of 8.5 inches, hence the ratio before any expansion occurs is 8.5/2.125=4. With similar materials to those used in conventional inflatables, the expansion diameter to deployment diameter ratio will always be greater for the present invention, because the purpose of the present invention is different to that of a conventional inflatable, which is placed in an unsupported stationary position using slips against the wellbore to hold large differential pressures across the membrane. The present invention can traverse along the erratic axis of a wellbore, where a desirable function is to deform according to the circumferential shape of the wellbore. Conventional inflatables seek to cause friction with the wellbore, whereas the present invention can seek to place a lower differential pressure membrane across the wellbore and reduce frictional constraints to allow it to move through substantially differing circumferences using, e.g., fluid drive, engaged selective pressure valves and/or wheels to facilitate piloting of the tool string.

While radial folding is shown and explained relative to an expanded to deployment diameter ratio, folding may not be used in various embodiments while other embodiments may fold axially. A long axial length membrane, folded in two to, e.g. minimize the effective deployment diameter, may extend radially outward significantly beyond the deployment diameter, dependent upon the axial length of a fold. Hence, the expansion to deployment ratio capabilities, using folding, are capable of expanding from the conventional coiled string smallest deployment diameter to the inside diameter of the largest casing, simply for making the axial length of the membrane longer.

Indeed, the present invention differs significantly from much of the prior art where maintaining station with a pressure differential is the primary desired feature. The present invention can be usable for access and passage through a well bores walls, whereby differentiating interoperability with a wellbore, in comparison to existing methods, may be illustrated by, e.g., an ability to increase the efficiency of crushing pistons traversing a tortuous wellbore to deform tubing using differential pressure and the elements of a geologic time frame to abandon a wellbore. The present invention is able to focus more on crushing, with less focus on the frictional forces for a crushing piston passing through a wellbore. One of the various objectives of the present invention is to reduce friction and to improve movement, and, e.g., improve crushing above what might otherwise be expected through a tortuous passageway, by adding the interoperability of, e.g. skates or fluid lubrication from permeable membranes (27T of FIGS. 73 to 78), after which the expanded membrane (15Q, 15R) may be used to support cement, wherein the expanded membrane is supported by the debris that it has crushed. In instances where support is desired, e.g. when placing a settable cement like material to seal a well bore, the present invention may, e.g., be rested upon debris within the wellbore. Additionally interoperability may be added with inclusion of positive displacement valves (11A of FIG. 43) used within a shaft and membrane to fill said membrane and to further provide fluid lubrication (27T of FIGS. 73 to 78), while maintaining its expansion, and/or bleeding-off trapped pressure for passing through restrictions or trapped pressure resisting the crushing of well components, whereby bleeding off to reduce friction operates a momentum vibrator (12A of FIG. 43). As objects in motion tend to stay in motion, momentum vibrators may significantly increase the crushing ability of an embodiment.

Operability between, e.g., wheeled mechanical linkages or skates (7T1 and 7T3 or 26T1 and 26T2 of FIG. 73), membranes (15R, 15Q), pedal baskets (22P, 22N of FIGS. 68 to 70) and an associated plurality of shafts and/or other axial displacement members usable to pilot, orient, place, retrieve, dispose, initiate, connect and/or other provide functions associated with access or passage through a well bore using any type of connector, preferably a coiled string compatible connector, may simply be referred to as interoperability between a axial displacement member (7) circumferential adaptable apparatus (2) or placement tool (2), an associated downhole drive tools (3), and the associated tool string (8) when traversing substantially differing well bore circumferences.

Figure 73:
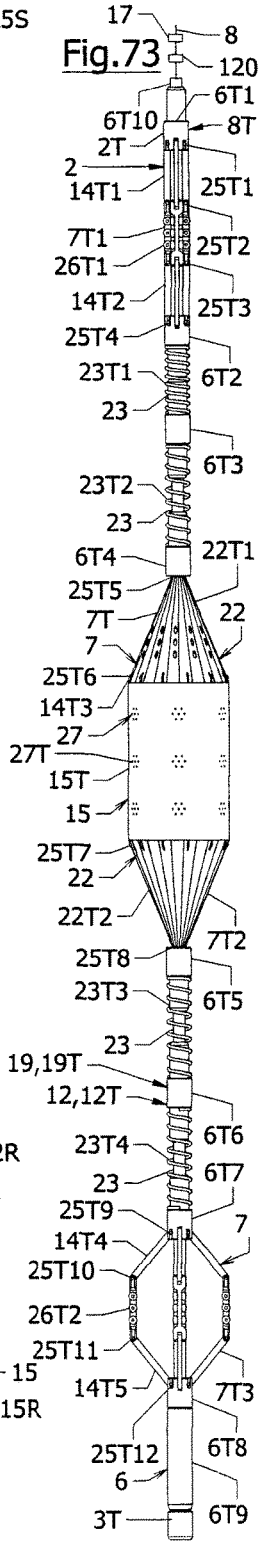
FIGS. 73 to 81 depict an embodiment of the present invention illustrating a substantial expanded to deployment diameter ratio for tool embodiments.

FIG. 73 shows an elevation view while FIGS. 74 to 81 show various other views of embodiments (19T) of a method (19) and embodiments (12T) of an apparatus (12) of the present inventor, with embodiments (2T) of placement tools (2) usable with a tool string (8) embodiment (8T) and downhole drive tool (3).

The tool string may be deployed before or after actuation of springs (23T1-23T4) used to store energy within the tool string, which may occur at surface or within a well bore. Any downhole actuator device (120), e.g. an electric mechanism, timer mechanism, slickline pump, hydrostatic pressure actuator or small explosive charge actuator between the coiled string compatible connector (17) and placement tool (2T), at the lower end of the string (8), can be usable to actuate the tool string (8T) by axially compressing shafts (6T1-6T9) disposed about and along a central shaft (6T10), against said springs (23T1-23T4), to selectively trap energy within the apparatus (2T) for axial displacement member (7T1-7T3) expansion. Any form of slips or other positional device may be used to retain the selective axial combined length of shafts (6T1-6T9) and springs (23T1-23T4) to store energy along the central shaft (6T10), associated with the level of stored energy usable for initiating expansion and resisting collapse of the axial displacement members (7T1-7T3).

Interoperability between a plurality of shafts (6T1-6T10), with intermediate springs (23T1-23T4) operable between upper (26T1) and lower (26T3) skates, and use of an intermediate axial displacement packer (7T2) to pilot between the substantially differing circumferences of the, e.g., 2⅞ inch outside diameter, 8.6 pounds per foot production tubing with an inside drift diameter of 2.165 inches within a casing bore (5T) of, e.g., 8.535 inches inside diameter of an outside diameter of 9⅝ inch casing, associated with 53.5 pound per foot density, wherein the inside diameter and associated circumference of the casing (9T2) is deformed (4T). An embodiment (2T) of the apparatus can comprise, e.g., a 2.1 inch collapsed deployment diameter, to traverse the expandable packer (7T2) between the 2.165 inch and 8.535 inch diameters, as well as the casing deformities by using the skates (7T1, 7T3 or 26T1, 26T2) to pilot the packer (7T2), with string tension and/or pressure applied (31) to the packer from the tubing against any pressure underneath the packer. The apparatus (2T) deployed with, e.g., the coiled string connector at its upper end and/or pressure applied through the tubing to the upper end of the packer (7T2), carries a downhole drive tool (3T) at is lower end for access and passage through the substantially differing circumferences (19T).

The lower end downhole drive tool (3T) may be any usable downhole device that is deployable with a shaft (6T9) connector and/or upper end coiled string connector, for example (e.g.) a perforating or explosive sculpting charge, logging tool, actuating tool or motor, boring bit or abrasive device, or a wedge. Various arrangements may be used, e.g., the central shaft (6T10) may rotate with bearings within encompassing housing shafts (6T1-6T9) to turn a boring bit (e.g. 3T) that can be operated with, e.g., a 1.68 inch outside diameter fluid motor above the apparatus (2T), held substantially stationary by the skates (26T1, 26T2) and also used to orient a hole finding device (e.g. 3T) and lower end boring bit. If a rotary cable tool positive displace hydraulic motor of the present inventor is used, the packer (7T2) can be used to route circulated fluids upward through the annulus after exiting the lower end of the 2⅞ inch tubing.

Interoperability may be enhanced with orifices (28) permeable membranes (27T) portions and/or valves (11, 11T1, 11T2) that can be operable with the primary membrane (15T) to allow fluid to be pumped into and exhausted from the well or to allow the membrane to lubricate the traversing engagement between the axial displacement member (7T2) and the dissimilar passageway walls (9T1, 9T2, 4T, 5T). The upper (22T1) and lower (22T2) end pedal baskets may be used to flexibly protect the membrane when traversing through the wellbore (10). The primary membrane (15T) and associated pedal baskets (22T1, 22T2) may be further reinforced by hinged arms (14T3) about their engagement circumference, wherein fluid pressure against the membrane, axial movement of the internal shaft (6T10), and/or wedging of the upper inverted pedal basket (22T1) against, e.g., the 2⅞" tubing or wall portion (4T) may be used to wedge and/or inflate or deflate the membrane (15T).

The apparatus (2T) and lower end downhole drive tool (3T) may be deployed and retrieved with a coiled or jointed pipe string, but the apparatus (2T) and lower end downhole drive tool (3T) may also be dropped from a string or surface to, e.g., use fluid pressure above the packer (7T2), with a wedging device (3T) comprising, e.g. another pedal basket or other expandable device, suitable for urging or wedging at the lower end, to, in use, attempt to push and deform walls and/or debris radially outward and/or axially downward independently of a string connection. Thereafter, the tools (2T, 3T) could be retrieved with a coiled string via a fishing neck. The present invention provides significant benefits by centralizing the tool string to improve the probability of fishing the dropped tool string.

Figures 74, 75, 76, 77, 77A, 78, 79, 80, 81:
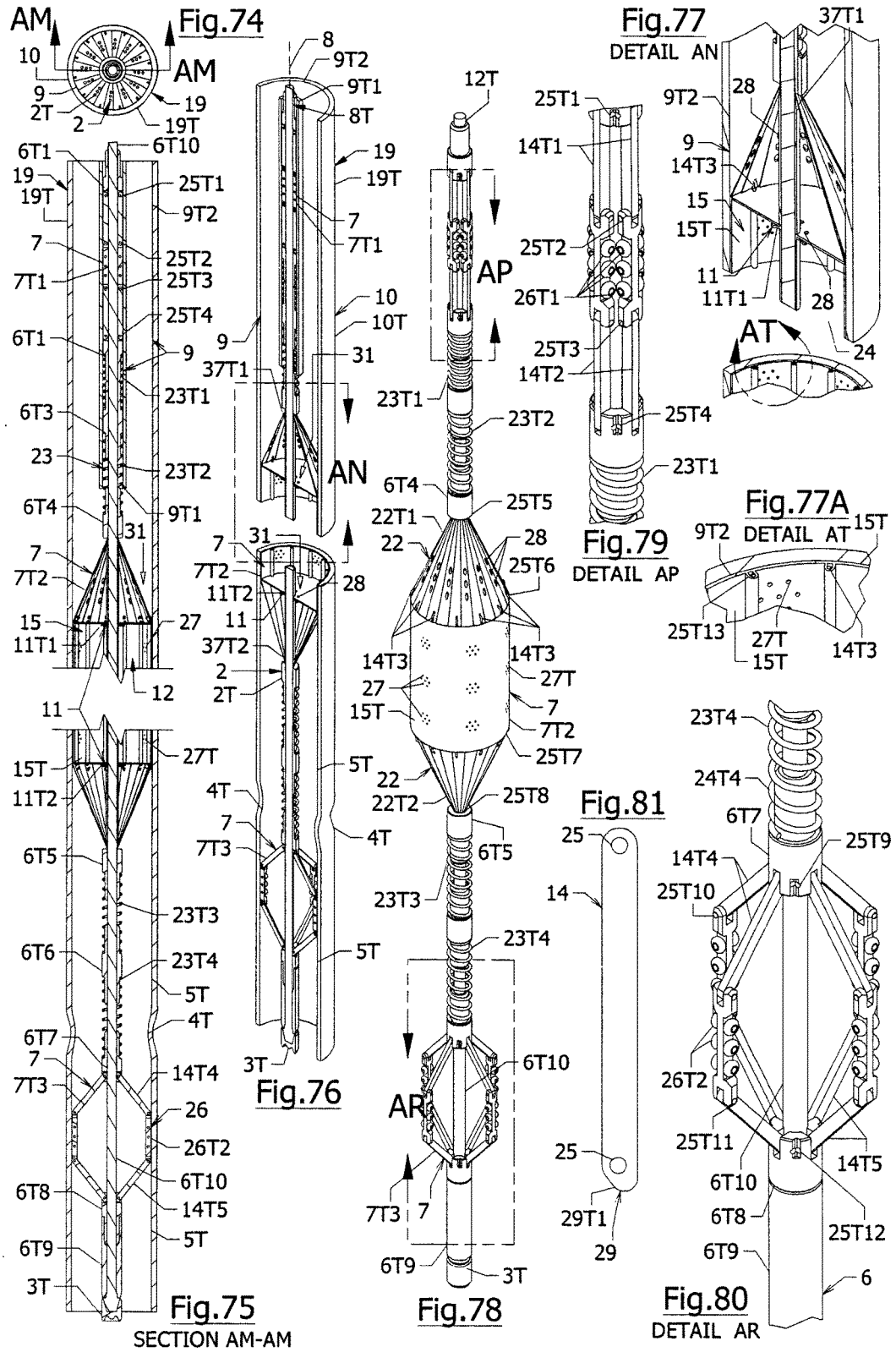

Referring now to FIGS. 74, 75 and 76, the Figures show a plan view with line AM-AM and an elevation cross section view along line AN-AN with break lines showing removed portions associated with FIG. 76, which depicts an isometric view of FIG. 75 with portions removed, where detail line AT is associated with FIG. 77. FIGS. 74, 75 and 76 illustrate methods (19T) and an embodiment (12T) of an apparatus (12), with placement tools (2T) usable with a tool string (8) and downhole drive tool (3) for accessing or passing through a wellbore's (10) dissimilar contiguous passageway walls (9T1, 9T2, 4T, 5T). The placement tool (2T) is shown with its lower end having passed a damaged wall (4T) and large diameter change of, e.g. a 2⅞ inch tail pipe (9T1) axially centralized within a casing (9T2) by, e.g., a production packer.

Alternatively, the tubing could be laying on the low side of an inclined or horizontal bore, e.g. see FIG. 42, whereby the spring (23T4) activated lower skate (7T3) may lift and pilot the tool string over the deformation (4T) until the springs cause the packer (7T2) to further pilot and orient the tool string towards the proximal axis of the wellbore until the tool string exits the tubing and both skates (7T1, 7T3) and packer (7T2), assisted by springs, string tension and fluid that is axially pumped within the wellbore to pilot the entire assembly within the proximal centre of the wellbore. The coiled string interacts with the tubing to lift the tubing and/or to form a catenary curve with the trailing string as the tool string traverses through the wellbore, past the deformation (4T) to the well's lower end.

FIGS. 77 and 77A show magnified detail views within the detail line AN of FIG. 76 and the detail line AT of FIG. 77, respectively, of the embodiments (19T, 12T, 2T) of FIG. 74. The upper end pedal basket (22T1) has orifices (28) to allow fluid pressure from surface to enter the membrane (15T) through the upper one-way valve (11T1), usable with, e.g., shaft mounted springs, to fluidly inflate the membrane (15T) and to pump fluids through permeable pores (27T shown in FIG. 78) in the membrane (15T) to lubricate its circumferential connection with the wellbore when pumping and traversing through various circumferences within, thus allowing it to inflate and deflate according to the restriction, yet retain the function of a sealed compression piston or movable packer.

Deforming around restrictions and debris when piloting and traversing through the wellbore is aided by mechanical linkages (14T13) and hinge (25T3) engagements to individual pedals of the basket (22T1 shown in FIG. 78). For various embodiments a momentum vibrator (73A of FIG. 42) or positive displacement valve (11A of FIG. 42) can be added to the arrangement to further enhance interoperability between the tools and the dissimilar passageway walls by controlling fluid pressure with the membrane (15T) and/or increasing lubrication about its circumference. In various other embodiments, e.g. one similar to (19X) and (2X) of FIG. 82, a small diameter fluid motor, which are conventionally available in, e.g., 1.68 inch outside diameter plurality of shaft arrangements, that may be incorporated with or at an end of the membrane (15T) to power, e.g., a reactive torque tractor to move the tool string along the dissimilar passageway walls using, e.g. the gripping and/or cutting wheel of the skate (26T1, 26T2) arrangements shown in FIGS. 78 to 80.

Referring now to FIGS. 78, 79 and 80, the Figures show an isometric view of FIG. 73 with detail lines AR and AP and magnified detail views within lines AR and AP of FIG. 78, respectively, illustrating the embodiments (19T, 12T, 2T) of FIG. 73. The axial length of mechanical linkages (14T1 and 14T2, 14T4 and 14T5) may be varied between the shaft connection and hinged (25T2 and 25T3, 25T10 and 25T11, respectively) connection to the skates (26T1, 26T2, respectively) to accommodate varying diameter ranges and, where sufficient space exists, within a placement tool (2) independent springs can be engaged to each skate to selectively pilot the tool string. A series of springs surrounding the central shaft can be individually engaged to each skate or smaller diameter springs, placeable within the radial distances between, e.g., a central shaft and encompassing or surrounding shaft.

A deformable packer and wedging axial displacement member (7T2) is formable with an upper pedal basket (22T1) flexibly hinged (25T5, 25T6) to a shaft (6T4) and mechanical linkage (14T3) supporting and flexibly hinged (25T13) to the upper end of a deformable membrane (15T), engagable with the wall portions (9T1, 9T2). Permeable pores (27, 27T) can allow fluid lubrication of the engagement when traversing the dissimilar contiguous passageway (9T, 9T1, 9T2). The membrane's (15T) lower end can be flexibly hinged (25T7) with a mechanical linkage (14T3) to the lower end pedal basket (22T2), flexibly hinged (25T8) to the shaft (6T5).

Upper and lower springs (23T2, 23T3) can act against associated upper and lower wedge (37T1, 37T2) shafts, encompassing the central shaft (6T10), to urge the expansion of the upper and lower pedal baskets (22T1, 22T2) to initiate a fluid filling of the membrane (15T) through the one-way valve (11T1) and orifices (28) in the upper inverted basket (22T1). Pores (27T) in the membrane may be of a one-way flow variety using, e.g., the flap and orifice (28) example valve (11), as shown, or open to allow initial filling of the membrane (15T). After initial spring actuated expansion and fluid filling of the membrane (15T, further fluid filling can be possible by surface fluid injection (31) through the orifices (28) in the upper basket (22T1) and upper one-way valve (11T1), wherein fluid exiting the lower one-way valve (11T2) can act against the lower basket (22T2) to further expand the membrane (15T) by acting against and expanding the lower basket (22T2). An internal passageway (24T4) may be added to the shaft to facilitate filling from any lower point along the shaft, wherein a swivel joint (6T8) may be used to allow rotation of the central shaft for any displacement valve and/or momentum vibrator using the internal passageway (24T4) and membrane (15T).

Collapse of the axial pivot member (7T2) can be accomplished by, e.g., stopping injection of fluid (31) and tensioning the string to pull the upper basket (22T1) into the lower end of the tubing (9T1) so as to compress the springs and force fluid from the membrane (15T). Fluid may be expelled from the membrane through the pores (27T) and between pedals as the lower basket (22T2) is collapsed. If fluid filling from the lower end is not a concern, orifices can be used instead of a one-way valve (11T2).

Any variation of wheel(s) can be engaged to a skate (26) or an axial displacement member (7) to, e.g., reduce friction, pilot the tool, prevent rotation of a shaft, and/or cut a wellbore's walls (9), for example (26AA, 26AB, 26AC) of FIGS. 83 to 88. As the type and diameter of the wheels will affect the placement tool (2T) deployment diameter, as shown in FIG. 79, the purpose and associated shape of the wheels should be considered, wherein selective adjustment of a mechanical arm (14) length and an actuator, e.g. spring force, may be matched to the wheel and purpose.

FIG. 81 shows an elevation view of an embodiment (29T1) of a shaped (29) mechanical linkage arm (14) that can be usable with various embodiments including that of FIGS. 73 to 80, wherein a lower-end cam-like shape (29T1) can be used to support the arm against a central shaft (e.g. 6T10 of FIGS. 73 to 80). Interoperability between tools of the tool string (8T) may be enhanced by selectively placing shaped (29) linkages, like the cam embodiment (29T1), wherein by placing a cam shape, e.g., at the upper hinges (25T1, 25T4) or lower hinges (25T9, 25T12), tends to aid retraction of arms (14) with string/shaft tension and to aid extension with shaft compression. Placing the cam shape on the lower hinges (25T2, 25T5) tends to aid extension of the arms (14) with string/shaft tension and to aid retraction with shaft compression. The shape may also be used to limit expansion and retraction of the arms (14).

The apparatus (12T) may be selectively arranged to provide interoperability between a downhole signal drive and coupling tools, usable to couple the an associated transducer(s) to the surrounding bore (10) via the deformable membrane (15T) and/or skates (26T1 and/or 26T2) extension beyond the lower end of the wall portions (9T1, 9T2), thus forming a placement tool (2T) for the tool string (8T) and a coupler tool, which can be usable to transmit signals between conductance well bore elements to a surface system (183 of FIG. 18) or memory tool carried with the tool string (8T). The interoperability of the apparatus (12T) is usable to, for example, provide a cement bond logging tool usable to pilot an innermost bore (9) of differing diameters or frictionally resistant walls (4, 5) before and after compressing wellbore components axially downward to avoid the associated acoustic disturbances cause by the crushing of well components or the microannulus formed by lubrication (27T) of the membrane (15T). Alternatively, a conventional USIT logging tool can be incorporated with, e.g., the central shaft (6T) above the membrane (15T), wherein the apparatus (12T) is usable as a packer membrane during axial movement, a bridge plug supported by pedal basket support upon, e.g. debris below or selectively actuatable slips segments incorporated below the lower skates, wherein the USIT logging tool can be retrievable via electric wireline that can be used to actuate the tool and a fusable link or slick wireline with timer and battery drive tools and/or a memory tool or transmission of signal through the slickline string conductance well element.

As illustrated in the example tool string (8T), various embodiments of methods (19) and a placement tool (2) that can be interoperable with a drive tool (3) to form a string (8) apparatus (12) of the present invention, which can be combinable in a variety of ways to meet the needs of access and passage through damaged and/or restricted portions of a well bore. Various forms of pedal baskets, membranes, skates, valves, hinges, springs or any other downhole coiled string compatible mechanism oriented and arranged at surface and downhole can be usable to selectively pilot any suitable downhole drive tool (3T), selectively actuatable by any suitable actuation means.

FIGS. 82, 91 to 93 and 95 to 96 are diagrammatic illustrations of various methods of the present invention, wherein the associated apparatuses of each Figure may include any apparatus embodiment of the present invention in addition to the depicted apparatuses, wherein FIGS. 73-82, 91 to 93 and 95 to 103 may use sensor transponders of the present invention and/or conventionally logging tools placed to empirically measure cement bonding before cementation and disposing a sensor transponder downhole or providing (211-220) of FIG. 15 to ensure cement bonding during or after cementation.

Referring now to FIG. 82, the Figure depicts a diagrammatic elevation view, of a slice through a well bore (10), illustrating a method (19) embodiment (19X) and apparatus (12) embodiment (12X) with placement tool (2) embodiment (2X) usable with a tool string (8 embodiment (8X) and downhole drive tool (3X) for access or passage through a well bore's dissimilar contiguous passageway walls (9X) comprising wall portions (4X, 5X). The tool string (8X) is usable to, e.g. mill the dissimilar wall portion (4X) by placing any variation of cutting wheel arrangement, e.g. (26AC) and (26AB) of FIGS. 83-84 and FIGS. 85-86, respectively, and using a hydrodynamic fluid bearing milling motor described in GB2486591 of the present inventor to rotate the axial displacement member (7X2) comprising, e.g., carbide encrusted basket pedals with overlapping pedals arranged for the direction of rotation and operated by power fluid passing through the top inverted pedal basket orifices (28) to turn a rotating stator motor shaft (6X3) secured to the cutting carbide encrusted baskets (7X2) rotated about a central shaft (6X5) held substantially stationary by the axial displacement cutting skate members (7X1, 7X3).

As fluid is pumped (31) through the orifices (28) and between the rotatable stator shaft's (6X3) hydrodynamic surface and the central substantially stationary shaft (6X5), the power fluid (31) rotates the carbide baskets (7X2) to mill the dissimilar wall portion (4X) which may also be axially cut by the skates (7X1, 7X3) when the tool string (8X) is raised and lowered with string (8) tension. The shape of the opposing baskets, their flexible pedal nature and string tension when moving the rotating baskets across the dissimilar wall portion (4X) gradually grinds and/or smooth's the disfigured or restricted well bore (10) to allow passage of other tools and strings. The lower end downhole drive tool (3X) may, e.g., be a caliper tool used to measure the well bore's (10) walls (9).

The tool string (8X) is also useable with a conventional electric or fluid motor forming the shaft (6X3) instead of a hydrodynamic fluid bearing motor with a lower end rotary downhole drive tool (3X), wherein the upper and lower skate axial displacement members (7X1, 7X3) hold the upper wireline connector (6X1), central (6X2) and the conventional motor's housing (6X3) shafts substantially stationary, while the central shaft (6X5) and lower shaft (6X4) rotate the bit, brush, grinder, jetting tool (3X) using fluid funneled through the orifice (28) from the axial displacement member (7X2), or any other suitable rotary tool.

FIGS. 83 and 84, FIGS. 85 and 86, and FIGS. 87 and 88, illustrate mechanical linkage (14) embodiments (14AC, 14AB, 14AA, respectively) and coupler tool (83) embodiments (83AC, 83AB, 83AA, respectively) with wheeled (26) embodiments (26AC, 26AB 1 and 26AB2, 26AA, respectively) and hinged (25) embodiments (25AC1 and 25AC2, 25AB1 and 25AB2, 25AA1 and 25AA2, respectively) usable with various other embodiments of the present invention. Wheel skates (26) may be engaged to shafts (6X1-6X4 of FIG. 82), which may encompass or surround central shaft (6X5) which may be substantially stationary or rotatable during deployment, wherein tensioning and relaxing of tension within the shaft (6X5 of FIG. 82) extends and retracts the axial displacement members (7X1-7X3 of FIG. 82) by disposing the shafts (6X1-6X4 of FIG. 82) along the central shaft to urge expansion and retraction of the members. Various actuators may be used to both extend and retract the members by tensioning and removing tension from the central shaft (6X5 of FIG. 82). Skate (26) wheel configuration profiles, including the number and orientation of wheels and skates, are usable to cut and/or couple (83AA-83AC) and/or function as an anti-rotation device to prevent axial rotation of a connected shaft. Depending upon the application, a variety of axial cutting wheel configures may be used to deform a well bore wall through a relatively low frictional cutting action, wherein repeated axial movement of the tool string (8) within the well bore tends to progressively weaken and/or shred the affected wall portion and/or further couple the skate (26) to a conductance wellbore element for the transmission of a logging signal during, e.g., the crushing or compression of well components for subsequent cementation and/or formation of a geologic testing space.

The shape of the wheeled components and associated linkage arms for extension and retraction are generally configurable to fit within the minimum diameters of a well bore, wherein a single skate may be used with the deployment to urge shaft engagement with the well bore, or two skates may be used to cause helical turning about, e.g. a ball joint shaft or other anti-rotation mechanism, or three or more skates may be used to provide, e.g., anti-rotation and/or centralization of the tool string and/or an inner conduit and/or coupling of a logging signal, wherein the cutting profile may be adapted for the degree of coupling desired.

Any embodiment of the present invention may use bearings, races, greases or other friction reducing devices to, e.g., improve hinged connections (25), rotating connections, radially disposed connections, axially disposed connections, and/or any other configuration of wheeled (26) mechanical linkages to provide, e.g., anti-rotation, centralization and/or coupling of a tool string to a conductance well bore element.

Referring now to FIGS. 89 and 90, the Figures depict a diagrammatic isometric view of a prior art shot gun and a diagrammatic isometric view of apparatus for explosively crushing downhole well bore components, respectively, of the present inventor as described in GB2486591, whereby the present invention provides significant improvement over the explosive deformation of downhole conduit walls by providing pilotable tool strings embodiments with shock absorbing and focusing capabilities. Similar to a prior art shot gun (135) which uses an explosive chamber (136) to propel objects from a barrel (137), a well bore's (10) walls (9) may be used as a barrel from which an explosive arrangement (139) may be used to axially propel at least part of various wall portions (4, 5) using an apparatus similar to a shotgun shell wad (140) with a pressure relief orifice (141). Axial displacement pedal baskets are similar to a shotgun shell wad for propelling and/or wedging open of wall portions (4, 5), wherein an inverted pedal basket is usable to absorb the axial fluid hammer effect of using explosives within a well bore as well as focusing an explosive fluid hammer in a particular axial direction like a shaped charge (119 of FIG. 61).

FIGS. 91 and 92 show diagrammatic elevation views of slices through a wellbore (10), illustrating method (19) embodiments (19Y, 19W, respectively) and apparatus (12) embodiments (12Y, 12W, respectively) with placement tool (2) embodiments (2Y, 2W, respectively) usable with a tool string (8) embodiment (8Y, 8W, respectively) and downhole drive tool (3) comprising an explosive (3Y, 3W) for cutting, sculpting and/or wedging open a dissimilar passageway wall portion (4Y, 4W) to provide access or passage through a well bore's dissimilar contiguous passageway walls (9Y, 9W), wherein an axial displacement conical members (7Y), e.g. a pedal basket or cone wrap, is used to act against the axially above fluid column to limit lifting of the tool string (8Y) when an explosive (3Y) is fired and inverted axial displacement conical components (7Y3, 7W1-7W2), e.g. pedal baskets or conical wraps, used to focus a lower end fired explosive (3Y, 3W) from the shafts (6Y5, 6W4) axially downward to act on the frictional innermost bore walls (4Y, 4W) protruding radially inward from the larger diameter (5Y, 5W) innermost passageway (9, 9Y, 9W).

Slips engaged to the axial displacement members (7Y2, 7W3) can engage the tools strings (8Y, 8W) to the wellbore walls; hence, they may function as a bridge plug (35Y1, 35Y2) during firing of the explosives. For tool string (8Y) the opposing conical axial displacement members (7Y1, 7Y3) secured to shafts (6Y3, 6Y4) can be mechanically linked to extend the slips to reduce the probability of upward moment of the tools string (8Y) and avoid application of a fluid hammer effect to well equipment above the tool string or bird nesting of, e.g., a slickline string, wherein axial tension on the string to a shaft (6Y1) passing through a housing shaft (6Y2) and the upper conical funnel member (7Y1) may be used to release both the slips (7Y2) and lower conical funnel member (7Y3) and retract the upper conical funnel member (7Y1) with, e.g., retraction of an extending wedge (37T1 and 37T2 of FIGS. 74 to 80).

Upward movement of the tool string (8W) can be limited by, e.g., placing slip like profiles on the pedals of the inverted conical pedal basket or surface of the conical membrane that are expanded by the fluid hammer associated with igniting the explosive (3W) to engage the conical forms (7W1, 7W2) and associated securing slips to the well bore (10) walls (9), wherein orifices (28) are provided to release excessive explosive pressures that may damage the axial displacement members (7W1, 7W2). Initially the lower slips may be set and the cones expanded with upward axial movement of the central shaft (6W1), wherein after firing of the explosive charge (3W), the conical funnel slip members (7W1, 7W2) may be retracted by tensioning upon the surrounding shaft (6W2) engaged via a flexible hinge to the members (7W1, 7W2) and associated shaft (6W3) to release the lower slips member (7W3).

Additionally, to remove the possibility of creating a birds nest of wire with, e.g., a slickline or electric line tool strings (8Y, 8W), the apparatuses (2Y, 2W) may be deployed with the deployment strings (8) detached and a timer used for firing the explosives (3Y) charges, 3W), after which a retrieval string may be deployed to engage the upper end shaft and/or connection to pull the shock absorbing and focusing apparatuses (2Y, 2W). Removing the deployment string also allows placement of, e.g., an inflatable packer or packer embodiment of the present invention above the apparatuses (2Y, 2W) to provide a backstop or secondary assurance that they will not be propelled uphole by an explosion downhole.

To provide passage through the restricted wall portion (4Y), an explosive device (3Y) can be usable to cut or sculpt the wall with, e.g. (19H, 19I, 19J) and (19M) of FIGS. 53-58 and FIG. 62, to provide additional space between the restricted circumferential walls. The method (19W) may use a conical axial displacement member (7W4) to wedge the deformation and/or debris wall portion (4W) open to create more space between the restricted circumferential walls for access or passage, wherein the conical funnel wedge (7W4) is separable from the tool string (8W) to move axially downward and focus the explosion caused fluid hammer radially outward as the cone expands. A fishing engagement may be provided with the detachable wedge or it may be speared for retrieval. Alternatively it may be explosively perforated, milled and/or pushed downhole or destroyed. Additionally, method (19W) may follow method (19Y) and be followed by method (19Y) or any other method embodiment to cut, sculpt and/or wedge open a wall portion, debris and/or debris from cutting, sculpting or wedging wall portions radially outward to form an larger effective pass through diameter.

Referring now to FIG. 93, the Figure illustrates a diagrammatic elevation view of a slice through a well bore (10) method (19) embodiment (19V) with apparatus (12) embodiment (12V) with placement tool (2) embodiment (2V), and FIG. 94, which shows an isometric view of a logging tool embodiment (19AD) sensor/transmitter (186) coupling tool (83) embodiment (83AD) in a shock absorbing housing mechanical linkage (14) embodiment (14AD) using springs (23AD) to provide shock absorbing cushion to movements from, e.g., explosive fluid hammers, wherein the embodiments are usable for providing a logging well bore image to provide empirical measurement data for access or passage through a well bore's dissimilar contiguous passageway walls (9V) during various operations including passage and cutting or explosive operations that may cause significant shock or vibration.

A tool string (8) embodiment (8V) can use various mechanical arm deployed axial displacement members (7V1-7V3), wherein a logging (186) coupling (83AD) and downhole drive tool (3V) may be engaged to an expandable pivotal component (7V2) to axially place the sliding transducer (186) skate mechanical linkage (14AD) to provide, e.g., inclination logging information associated with tool string (8V) data collection transmitted through sonic pulses within, e.g., the casing wall, where it may be collected from the wellhead in a similar manner described by the present inventor in GB2483675. An axial displacement member can be usable to place the transmitter sensor on the casing while piloting a tool string (8V) through the well bores walls. As the axis within dissimilar passageway walls (9) may be erratic, the tool string (8V) may have a ball joint, knuckle joint or flexible joint (6V) to provide inclination logging data between upper (6V3) and lower (6V4) shafts, as well as piloting of the tool string around restrictions or through wall portion enlargements (4V).

Data may be transmitted through electric line or fluid pulses within the fluid column within the well bore (10) in various embodiments. Data transmittal is, however, complicated during slickline rotary cable tool positive fluid displacement motor operations, wherein transmittal through the wellbore's walls (9) provides an alternative, since slickline has not electrical core and upward pulses with small diameter wireline tools are more difficult.

Accordingly, a logging downhole tool (3V, 3AD) formed with, e.g., a mechanical linkage (14AD) can be engaged to arms (14V), via flexible hinged connections (25AD1, 25AD2), and deployed via, e.g., tool string weight, string tension, springs and/or hydraulic actuator interoperability with shafts (6V3), (6V7) and (6V8) to maintain contact with the wellbore walls (9V) to, e.g., provide anti-rotation functionality and perform logging operations to, in use, collect/transmit data through a sensor/transponder (186), which can collect or transmit data through the wellbore walls (9V), more or less on a continuous basis via battery power supplemented by a fluid turbine electrical generation tool within a tool string. For example, the circumferential adaptable logging apparatus (2V) can be combined with the boring apparatus (19X of FIG. 82) to allow continual monitoring of slickline boring data, such as stick slip and vibrational information that could limit the life of the tool string (8X, 8V).

Alternatively, axial displacement member (7V1) can be a combined anti-rotation conical funnel for directing fluids shaft (6V7) comprising, e.g., a batter with supplemental fluid turbine generator with fluid continuing through shaft (6V8) and (6V3), which can comprise, e.g., logging apparatus connected with the sensor (3V1), connected via a directional control joint (75V) to a fluid motor shaft (6V4) driving shaft (6V5) and through anti-rotation skates (7V3) to a rotary bit stick/slip inhibitor shaft (6V6) for turning a rotary bit (3V2). The efficiency of the vibration of the entire tool string (8V), as well as directional control, can be monitored continuously from the surface wellhead through pulses sent through the casing via a transmitter's (186) engagement with the casing (9V).

FIG. 95 depicts a diagrammatic elevation view of a slice through a well bore (10), illustrating a method (19) embodiment (19U) and apparatus (12) embodiment (12U) with placement tool (2) embodiment (2U) usable with a tool string (8) embodiment (8U) and downhole drive tool (3) embodiment (3U1) for access or passage through a wellbore's dissimilar contiguous passageway walls (9U), and including portions of the walls (4U, 5U). The movement of fluid filled single cell or multi-cell membrane balloons, bags or packers may be subject to significant frictional forces across substantially differing circumferences as the membrane conforms to the dissimilar walls (9U) and/or debris (76).

A membrane (7U1) can be usable as a packer (118U) and/or bridge plug (35U) and may be inflated in various conventional ways similar to those used to fill inflatable packers, which can include, e.g., a slickline pump to axially displace, orient and align the assembly. Once filled, a fluid filled membrane may be traversed through dissimilar walls (9U) using a hole finder comprising, e.g., a tapered bull nose (3U2) engaged to a shaft (6U5) with a flexible skate (7U2), allowing fluctuations between fully expanded and less than fully expanded to facilitate angular variation (142) of the shaft (6U5) and bullnose (3U2) from the proximal axis of the passageway (9U). The inflated membrane can, e.g., be pushed with surface fluid pressure (31) and vibrated through the passageway, using a momentum vibrator (73) embodiment (73U). Alternatively, the method (1U) of providing a logging tool carried by the membrane and hydraulic pressure can be applicable, wherein after movement progressed through pressure and vibration stops, a logging signal may be passed through, e.g., the fluid column and/or surrounding bore (10).

The upper valve (11U1) may be omitted to allow higher fluid differential pressure to follow its own chosen path, or to allow higher differential pressure trapped below to dominate with (11U1) placed as shown above upper orifice (28) in shaft (6U1) or to allow higher differential pressure from above to dominate with the one-way valve (11U1), placed immediately above lower orifice (28) in shaft (6U4). The fluid passing between the upper, lower and intermediate (28 in shaft 6U1) orifices can operate the positive displacement fluid relief valve (11U2) and momentum vibrator (73U) comprising, e.g., a helical rotor shaft (6U2) and stator shaft (6U3). Interoperability between the membrane (15U), valves (11U1 and/or 11U2) and momentum valve (73U) allow higher pressure to move to lower pressures, for example, pressure from orifice (28) in shaft (6U4) may fill the membrane through the intermediate orifice (28) in shaft (6U1) or exit the upper orifice (28) in shaft (6U1) above valve (11U1).

If pressure from above (31) overpressures the membrane (15U) by either forcing it downward against a restraining force, or by filling it if the valve (11U1) is absent, fluid pressure may exit the membrane (15U) and exit below or above the membrane. Any transfer of fluid due to a differential pressure difference can operate the momentum vibrator to cause vibration and angular variation (142) to vibrate the membrane and shaft, while increasing and decreasing the membrane internal pressure to cause it to move in the desired direction (31).

Vibration of a piston packer is especially useful in the crushing of conduits and other well equipment downhole, as described in patent GB2471760B and priority patent application GB2484166A of the present inventor, wherein the downhole drive tool (3U) may be, e.g., a connector to the conduit being crushed.

Accordingly, the present invention provides significant benefit over GB2471760B and GB2484166A by providing a means of reducing the resistance to crushing through, e.g., vibration and piloting of a packer used as a piston to crush downhole well components through dissimilar piston passageway's walls of substantially differing circumference, thereby improving the ability to enable or provide cap rock restoration using the method (19) and apparatus (2) embodiments of the present invention.

Figures 96, 97, 98, 99, 100, 101, 102, 103, 104:
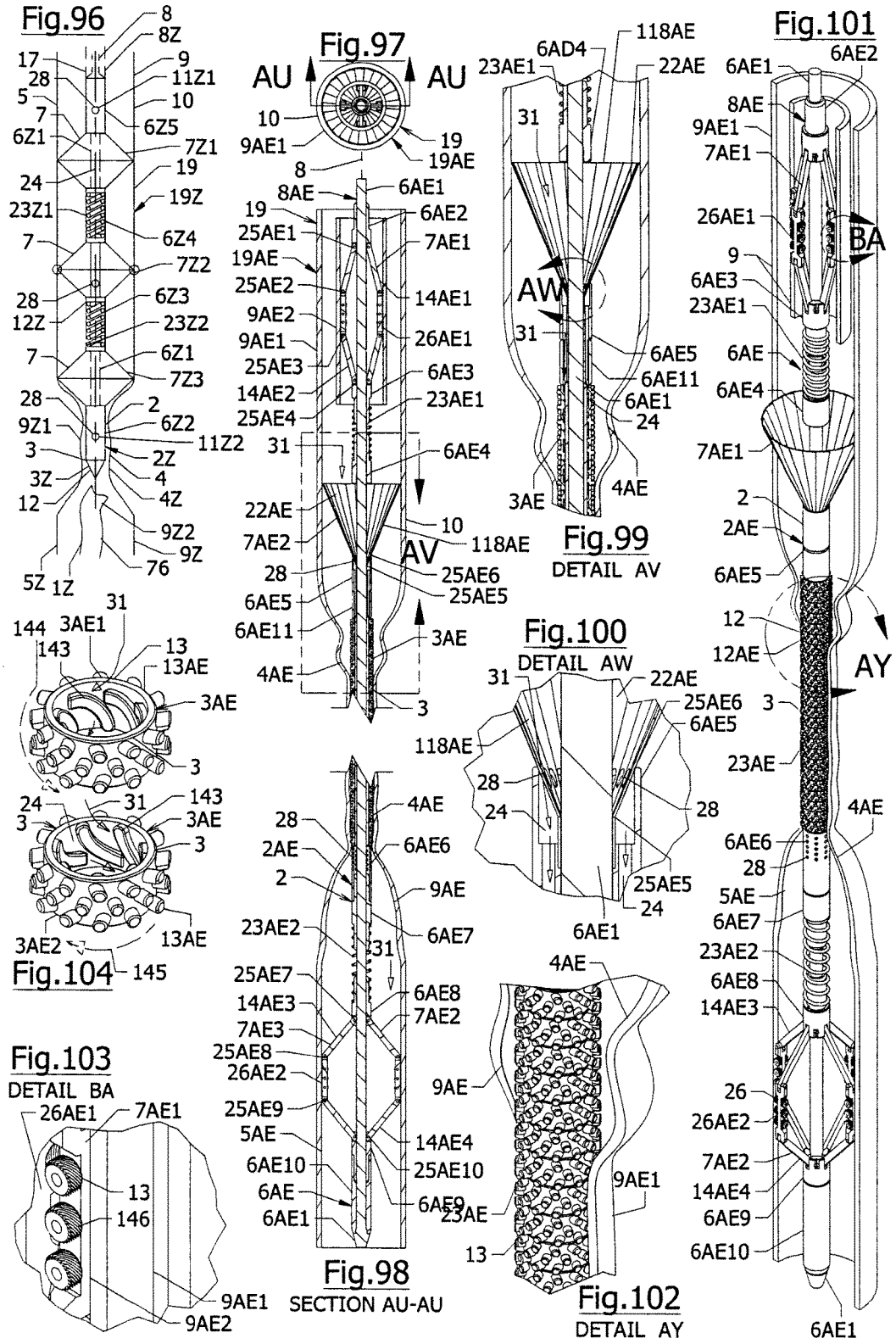
FIGS. 97 to 104 show a tool embodiment of the present invention usable for access or passage through subterranean well bore dissimilar contiguous passageway walls as a hydrodynamic fluid bearing cutting tool string.

FIG. 96 depicts a diagrammatic elevation view of a slice through a wellbore (10), illustrating an embodiment (19Z) of a method (19) and an embodiment (12Z) of an apparatus (12) with a placement tool (2) embodiment (2Z) usable with a tool string (8) embodiment (8Z) and downhole drive tool (3Z) for access or passage through a wellbore's dissimilar contiguous passageway walls (9Z1). A restriction (4Z) can prevent passage of a prior art crushing piston, unsuited for piloting the substantially differing circumferences of the wellbore's (10) walls (9Z1), and the apparatus (2Z) with lower end hole finder (3Z) rigid or flexible bullnose suited to crushing tubing (9Z2) debris (76) within the casing (9Z1).

The placement tool uses offsetting conical axial displacement members (7Z1, 7Z3) to form two pistons with an intermediate skate stabilizer (7Z2) and intermediate spring like devices (23Z1, 23Z2) usable to transfer energy between the pistons as the apparatus (2Z) passes through the restriction (4Z), wherein the crushing force associated with the larger diameter of the passage (9Z1) is maintained. Maintenance of the pressure against the larger diameter and associated force associated with the area of the larger circumference as the tool passes through the smaller diameter is maintained is provided by a passageway (24) through shafts which opens the nearest orifice (28) when a axial displacement piston member is collapsed and closes the orifice when the piston expands.

Collapsing the lower piston (7Z3) against the restriction (4Z) opens the lower orifice (28) valve (11Z2) and bleeds off any trapped pressure between the pistons through the intermediate orifice that remains open and the upper pistons area controls the force applied. As the lower piston exits the restriction (4Z) into the larger internal diameter (5Z) and expands, the lower orifice (28) closes and crushing continues until the upper piston (7Z1) encounters the restriction and opens its valve (11Z1) to allow pressure against the lower piston to pull the apparatus (2Z) through the restriction (4Z).

Valves (e.g. 11Z1-11Z2) that selectively open and close according to the state of an expandable and collapsible axial displacement member (7) may be formed within the various embodiments of the present invention by the disposition of various shafts within the plurality of shafts used by an apparatus (2) for placing the string (8) or various tools carried by the deployment string through the innermost passageway. Spring like mechanisms (e.g. 23Z1, 23Z2) may be used to trap energy within an apparatus (e.g. 2Z) using their spring like their nature and the disposition of a plurality of shafts (e.g. 6Z1-6Z5) relative to the spring like mechanism, wherein energy may be placed within the shaft and spring like arrangement at surface or within a subterranean well bore using a downhole actuating device.

Axial and/or radial movement of a pivotal axial member (e.g. 7Z1-7Z3) may act against the plurality of shafts and spring like arrangement to, e.g., align orifices (e.g. 28 of FIG. 96) with a central fluid passageway through a central shaft (e.g. 6Z1) and form valves (e.g. 11Z1, 11Z2) to transmit fluid between pressure differentials through, about and between sealing axial displacement members (e.g. 7Z1, 7Z3) to, e.g., selectively apply pressure to the plurality of crushing pistons (7Z1, 7Z3) to maximize the crushing force against debris (76, 9Z2) by selectively applying a pressure differential across the largest area (1Z).

While the restriction shown (4Z) is substantial, it also represents frictionally obstructive resistance to crushing from, e.g., a relatively consistent well bore wall with regular internal gaps associated with, e.g., conventional buttress casing couplings, upon which a piston might catch hold of or lose its seal, thus reducing the crushing force. Providing pistons energised by spring like mechanisms (23Z1, 23Z2) with valves (11Z1, 11Z2, 11U1-11U2 of FIG. 95), momentum vibrators (73U of FIG. 95), flexible joints (75V of FIG. 93), skates (26T1-26T2 of FIGS. 73-80) and/or other embodiments arranged to expand, seal and contract selectively according to well bore walls (9Z1) provides significant benefit over prior art by maximizing the forces and compression of downhole debris (76, 9Z2) when forming spaces for placement of a settable sealing material.

Additionally, the ability to place fluids through a central passage within a shaft or between shafts provides both momentum vibrate during crushing and forms a motor to provide, e.g., a reactive torque tractor within shaft (6Z2) to aid crushing of, e.g., production tubing (9Z2) to form debris (76) upon which a settable sealing material can be placed to abandon a well, and wherein axial displacement member cutting wheel skates (26AC, 26AB, 26AA of FIGS. 83 to 88) and spring like mechanisms may be used with said pivotal tractor to aid crushing. The addition of vibration and/or the pull of a reactive torque tractor operated by, e.g., a positive displacement valve (11U2 of FIG. 93) may provide significant benefit to crushing when combined with differential pressure from the fluid column because, according to the laws of physics, objects that are at rest tend to stay at rest and objects in motion tend to stay in motion, hence providing a significant benefit over prior art.

Referring now to FIGS. 97 to 104, the Figures illustrate various views of embodiments (19AE) of a method (19) and embodiments (12AE) of an apparatus (12), with placement tool (2) embodiments (2AE) usable with a tool string (8) embodiment (8AE) and a downhole drive tool (3) for access or passage through a wellbore's dissimilar contiguous passageway walls (9AE1, 9AE2), wherein turbine blade (143) driven cutting (13AE) downhole drive tools (3AE) oriented with mechanical linkages (14AE1-14AE4) can be usable to deform through cutting, milling or abrading a deformed wall portion (4AE) with a substantially differing circumference form an adjacent wall portion (5AE).

A series of shafts (6AE2-6AE11) surround and encompass various lengths of a central shaft (6AE1) with intermediate axial displacement members (7AE1-7AE3) usable to operate the tool string (8AE) and downhole drive tools (3AE) comprising, e.g., cutting, brushing, milling or other abrasive outer circumference rings with offsetting turbine blade profiles (143) on the inside circumference of the rotating downhole drive tool (3AE) cutters (13), wherein fluid (31) pumped from surface through the dissimilar passageway walls (9AE) is funneled by a conical pedal basket (22AE) in between turbine profiles (143) and central shaft (6AE1) to rotate the cutting (13) tools and mill or abrade a wall portion (4AE) with a substantially differing circumference than adjoining wall portions (5AE) of the well bore's (10) dissimilar passageway walls (9AE1, 9AE2).

Upper (26AE1) and lower (26AE2) anti-rotational skates (26) are deployed via flexible hinge (25AE1-25AE10) engagement to associated shafts (6AE2-6AE3, 6AE8-6AE9) actuated with springs (23AE1, 23AE2) to substantially prevent rotation of the central shaft (6AE1) at shafts (6AE3, 6AE9) opposite sliding spring actuation shafts (6AE2, 6AE8), wherein said anti-rotation skates are usable across substantially differing circumferences. While opposing turbine blades (143) are shown between cutting ring (3AE1) and an adjacent cutting ring (3AE2) in FIG. 104 to illustrate the need to direct fluid (31) in one direction to turn a turbine blade shaped to direct fluid flow in a different direction, which is usable for various purposes, the torque and speed capability of the turbine blades may be increased significantly by fixing turbine blades to the central shaft held substantially stationary by anti-rotation skates (26) to direct fluid flow (31) necessary to rotate the cutting rings (3AE1. 3AE2) by fluid force exerted against their associated rotatable turbine blades, wherein the stalling of a single ring does not stop fluid flow past nor rotation of another ring. Additionally, to improve the anti-rotation properties of the tool string (8AE) the profiles place don the central shaft (6AE1) may be used to direct the rotation of one ring (6AE1) in an opposite rotational direction to another ring (6AE2), wherein the fluid profiles of the central shaft would occur through passageways of an intervening enlarged shaft portion acting as a thrust bearing between cutting rings (3AE1, 3AE2) or turbine profiles covered by an thrust bearing shaft (6AE11) between the cutting ring (3AE1, 3AE2) downhole tools (3) and/or shafts they may thrust against.

FIGS. 97 and 98 show a plan view with line AU-AU and an elevation slice through line AU-AU of FIG. 97 with detail line AV associated with FIG. 99, depicting method (19AE) and apparatus (2AE) within dissimilar contiguous passageway walls (9AE) with a break line illustrating a removed section, wherein other embodiments may be placed within the removed section, above and/or below the tool string (8AE). The fluid driven tool string (8AE) can be deployable and operable using, e.g., slickline which does have the capacity to circulate fluid, since it lacks a central fluid passageway, wherein fluid (31) may be pumped through the tubing (9AE2), e.g. 5½ inch outside diameter, within casing (9AE1), e.g. 9⅝ inch casing, and captured by a conical funnel (22AE) axial displacement member (7AE2) to operate a series of rotatable cutting profile downhole drive tools (3AE).

Fluid flow (31) through the upper end of the wellbore (10) walls (9AE1, 9AE2) will pass the non-sealing anti-rotation axial displacement member (7AE1) and be captured by the packer (118AE) sealing conical funnel (22AE) axial displacement member (7AE2) to exit orifices (28) at its lower end and to enter the space between the central shaft (6AE1) and the turbine blade (143) rotated cutting (13) rings (3AE1, 3AE2), or any other axial length or shape of rotatable downhole drive tool (3AE) with an internal circumferential turbine blade arrangement (143). Fluid can exit the orifices (28) in the lower end shaft (6AE6) to progress down the wellbore walls (5AE, 9AE2).

FIGS. 99 and 100 show magnified detail views within line AV of FIG. 98 and within line AW of FIG. 99, respectively, showing the fluid flow (31) through the conical funnel's (22AE) lower end orifices (28), between the thrust bearing flexible hinge shaft (6AE5) and central shaft (6AE1), which can connect to the turbine blade (143 of FIG. 104) passageway, between the turbine blade rotatable downhole tool (3AE) and the central shaft. Expansion of the conical funnel (22AE) comprises, e.g., placing a flexible hinge (25AE6) on the shaft (6AE5) axially above the adjacent shaft (6AE11) bearing any upward thrust from the rotatable rings (3AE) and engaging the funnel (22AE) flexible hinge (25AE5) to the central shaft (6AE1). Axially disposing the hinged (25AE6) shaft (6AE5) relative to the hinge (25AE5) on the central shaft (6AE1) can expand and collapse the funnel (22AE). Actuation of one shaft relative to the other may occur from various means, whereby a spring like mechanism, e.g. a spring operated expansion joint or hydraulic piston with trapped pressure, may be placed between the hinged shaft (6AE5) and thrust bearing shaft (6AE11). Tension on one of a possible plurality of shafts can collapse the funnel (22AE) when the tool string (8AE) is retrieved to surface for repair or replacement.

Referring now to FIGS. 101, 102 and 103, depicting an isometric cross section projection along line AV of FIG. 98, wherein the tool string (8AE) is unsliced by the cross section, with detail lines AY and BA associated with FIGS. 102 and 103, respectively, depicting magnified detail views within lines AY and BA of FIG. 101. As visually illustrated by FIG. 101, the present invention is pilotable through and usable to engage substantially differing circumferences on either side of a drastic frictionally obstructive restricted circular or deformed circumference of a well bore (10), whereby prior art is primarily concerned with reopening a restricted passageway, keeping an ever increasing circular diameter from the lower end of a well bore (10) to the upper end. FIG. 102 illustrates that the rotatable rings may comprise an rotatable downhole material used in conventional practice, such as brush bristles, carbide impregnated surfaces, polycrystalline inserts, hard metals, or knife like profiles arranged in radial, axial, helical or any other pattern corresponding to the direction of rotation, while FIG. 103 illustrates how low profile (146) cutting (13) or frictional surfaces may be placed on wheels to enhance the anti-rotation capabilities of a skate (26AE1).

Additionally, prior art does not exist for performing the tasks described herein. For example, a slickline string may be used to deploy the tool string (8AE) adapted by removing the fluid exhaust orifice shaft (6AE6), placing ports and a passageway through the central shaft (6AE1) to the lower end of the apparatus (2AE) to operate a fluid motor, replacing shaft (6AE10), to operate a rotary drill bit to first bore through the restriction (4AE) and then polish or brush it with the rotatable turbine rings (3AE), which may be arranged to allow counter rotation to offset the torque of the lower end motor to, in use, provide a significant improvement to rotary cable tool operations.

FIG. 104 shows isometric views of separated cutting surfaces (13) variation of a hydrodynamic fluid bearing shaft arrangement comprising a downhole drive tool of a cutting placement tool (2AE) embodiment associated with FIG. 102, illustrating how turbine blades (143) may be arranged to rotate one ring (3AE1) relative to another (3AE2) as fluid (31) passes past the turbine blades (143). Profiles to direct fluids in the appropriate direction to cause opposite rotation (144, 145) may be placed between the cutting rings (3AE1, 3AE2) or rotation of the cutting rings via their turbine blades (143) may occur as friction causes one rings rotation to direct fluid in a direction to rotate an adjacent ring in the same or opposite direction. As turbine blades are an art unto themselves, the present invention does not seek to define their rotation various other aspects of their blade shapes and positioning with the various arrangements that may occur, but rather specifies that any arrangement of turbine suitable for the shafts and apparatus in question, may be piloted and operated by the present invention.

As demonstrated by the description and drawings provided herein, any combination or permeation of the described components of apparatus embodiment (12) and associated placement tool embodiment (2) may be used with the various method embodiments (1, 19, 42), which are also applicable to place adaptations of conventional and prior art apparatus to provide concentric cementation and cement bonding before and after cementation despite any dissimilar contiguous passageways by urge access or passage through a subterranean well bore's (10) innermost bore (9) past any frictionally obstructive debris (76) within or at least a partially restricted circular or deformed circumferences (4, 5) thereof, during the operation, benchmarking, development, testing and improvement of proven and/or new technology.

Additionally, while various embodiments of the present invention have been described with emphasis, it should be understood that within the scope of the appended claims, the present invention might be practiced other than as specifically described herein.

Reference numerals have been incorporated in the claims purely to assist understanding during prosecution.

The invention claimed is:

1. A method of deploying and using at least one logging signal through existing conduits within a surrounding bore to empirically measure any existing concentric cementation and cement bonding before and after new cementation using an apparatus associated with a tool string to concentrically dispose an existing at least one inner conduit within said surrounding bore of a subterranean well, said method comprising the steps of:

conveying at least one selectively arrangable tool string comprising at least one selectively actuatable downhole drive tool, at least one downhole placement tool having at least one shaft and an axial displacement member extendable and retractable from said at least one shaft, and at least one cutting or displacing tool comprising at least one of a cutting blade, a cutting wheel, a spike, or a boring bit;

actuating said at least one selectively actuatable downhole drive tool to operate said at least one downhole placement tool to place said at least one cutting or displacing tool within said at least one inner conduit;

actuating said at least one cutting or displacing tool to cut or displace said at least one inner conduit proximally concentrically within said surrounding bore, thereby forming a cut or space in said at least one inner conduit;

circulating fluid between said at least one inner conduit and said surrounding bore for cleaning and bonding cement thereto after said new cementation; and transmitting at least one logging signal through said cut or space to measure about said surrounding bore before said new cementation; and determining said existing concentric cementation and said cement bonding before and after said new cementation.

2. The method according to claim 1, further comprising the step of selectively arranging said at least one selectively arrangable tool string to use at least one downhole logging tool, at least one surface system disposed at an upper end of a well, or combinations thereof, to transmit said at least one logging signal, receive said at least one logging signal, store said at least one logging signal, or combinations thereof.

3. The method according to claim 2, further comprising the step of selectively arranging said at least one selectively arrangable tool string to use said at least one downhole placement tool to couple said at least one downhole logging tool comprising at least one coupling tool and an associated transducer to said surrounding bore to provide said at least one logging signal before said new cementation, after said new cementation, or combinations thereof.

4. The method according to claim 2, further comprising the step of deploying at least one unproven downhole apparatus scaled to a transverse dimension passable through an innermost bore of said at least one inner conduit to a usable geologic testing space within said surrounding bore above said bonded cementation and below a next cementation depth to, in use, collect logging signals in downhole memory, at least one surface system, or combinations thereof, transmitted from a downhole logging tool deployed with said unproven downhole apparatus, deployed within said surrounding bore, or combinations thereof, to obtain empirical measurements of operating parameters of said unproven downhole apparatus.

5. The method according to claim 4, further comprising the step of using said empirical measurements during a rig-less abandonment of an aging well to adapt and improve said at least one unproven downhole apparatus or reallocate operation of said at least one unproven downhole apparatus from an unproven to a proven operation within a proximally similarly aged geology of said aging well, another aging well, a new well, or a field of wells.

6. The method according to claim 4, further comprising the step of permanently disposing downhole at least a part of: said apparatus, said at least one selectively arrangable tool string, said at least one downhole logging tool, said at least one unproven downhole apparatus, or combinations thereof.

7. The method according to claim 1, further comprising the step of providing a well barrier element comprising a geologically persistent fluid isolating said existing concentric cementation by providing a cement-equivalent bonding across an axial length of conduits embedded in or filled within and embedded in said existing concentric cementation with a stand-off between said conduits and a support of said existing concentric cementation at a subterranean depth adjacent to impermeable strata capping rock above a producible zone.

8. An apparatus usable for urging an existing at least one inner conduit within at least one surrounding bore of a subterranean well to empirically measure any existing concentric cementation and cement bonding both before and after new cementation, said apparatus comprising: a selectively arrangable tool string pilotable through an innermost bore of differing diameters or frictionally resistant walls, wherein said selectively arrangable tool string comprises:

at least one selectively actuatable downhole drive tool;

at least one downhole placement tool operable by said at least one selectively actuatable downhole drive tool, wherein said at least one downhole placement tool comprises at least one shaft and an axial displacement member extendable and retractable from said at least one shaft; and at least one cutting or displacing tool comprising at least one of a cutting blade, a cutting wheel, a spike, or a boring bit, wherein said at least one cutting or displacing tool is placeable by said at least one downhole placement tool and usable to cut or displace said at least one inner conduit proximally and concentrically within said surrounding bore to enable fluid circulation between said innermost bore and said at least one surrounding bore for cleaning and bonding cement thereto after said new cementation, and to enable measurement about said surrounding bore before said new cementation using said cutting or displacing tool to transmit at least one logging signal through a cut or space formed by cutting or displacing said at least one conduit to determine said existing concentric cementation and said cement bonding before and after said new cementation.

9. The apparatus according to claim 8, wherein said selectively arrangable tool string is selectively arranged to permanently dispose downhole at least a part of said at least one cutting or displacing tool.

10. The apparatus according to claim 8, wherein said selectively arrangable tool string comprises at least one downhole logging tool and is selectively arranged to transmit said at least one logging signal through at least one signal conductance well element comprising said at least one selectively arrangeable tool string, said at least one inner conduit, a fluid column about said surrounding bore, existing cement around said surrounding bore, strata around said surrounding bore, or combinations thereof.

11. The apparatus according to claim 10, wherein said selectively arrangable tool string is selectively arranged to transmit said at least one logging signal, receive said at least one logging signal, store said at least one logging signal, or combinations thereof, using at least one downhole logging tool, at least one surface system, or combinations thereof.

12. The apparatus according to claim 11, wherein said at least one logging signal comprises at least one command signal, at least one data signal, or combinations thereof, usable to selectively operate said at least one selectively actuatable downhole drive tool, downhole memory, or said at least one downhole logging tool.

13. The apparatus according to claim 12, wherein said selectively arrangable tool string is selectively arranged to measure said cement bonding before said new cementation, after said new cementation, or combinations thereof, by measuring a response of said at least one logging signal to a transmission through said at least one signal conductance well element.

14. The apparatus according to claim 11, wherein said at least one selectively actuatable drive tool, said at least one downhole logging tool, said downhole memory, said at least one surface system, or combinations thereof, is usable to process said at least one logging signal to empirically measure a downhole environment or operations of tools therein.

15. The apparatus according to claim 10, wherein said at least one downhole logging tool comprises at least one downhole coupling tool selectively operable by said at least one selectively actuatable downhole drive tool and placeable by said at least one downhole placement tool to couple an associated transducer to said surrounding bore.

16. The apparatus according to claim 8, wherein said selectively arrangable tool string further comprises at least one downhole tool comprising at least one crystal, magnet, coil, tuning fork, firing head, piston, spring, motor, or combinations thereof, for converting mechanical energy, electrical energy, explosive energy, hydraulic energy, or combinations thereof, into an associated force.

17. The apparatus according to claim 16, wherein said at least one downhole tool absorbs energy from at least one signal conductance well element, converts energy from at least one signal conductance well element, or combinations thereof.

18. The apparatus according to claim 16, wherein said selectively arrangable tool string is selectively arranged to extend a pilotable passageway for said at least one downhole tool from said innermost bore by cutting or displacing said surrounding bore, debris within said surrounding bore, or combinations thereof.

19. The apparatus according to claim 18, wherein said selectively arrangable tool string is selectively arranged to pilot at least one pilotable downhole tool through a transverse dimension substantially smaller than a transverse extendable dimension of an axial displacement member from said at least one shaft.

20. The apparatus according to claim 19, wherein said at least one cutting or displacing tool further comprises said at least one pilotable downhole tool having said at least one of a cutting blade, a cutting wheel, a spike or a boring bit.

21. The apparatus according to claim 19, wherein said at least one cutting or displacing tool or an associated coupling tool further comprises said at least one pilotable downhole tool with at least one mechanic arm linkage, at least one wheeled mechanical linkage, or combinations thereof.

22. The apparatus according to claim 19, wherein said at least one cutting or displacing tool further comprises said at least one pilotable downhole tool with at least one displacement valve, a momentum vibrator, or combinations thereof.

23. The apparatus according to claim 19, wherein said at least one cutting or displacing tool or an associated coupling tool further comprises said at least one pilotable downhole tool with at least one of a packer, a bridge plug, a pedal basket, or a flexible membrane.

24. The apparatus according to claim 19, wherein said selectively arrangable tool string is selectively arranged to dispose said at least one shaft axially within a housing shaft to pivotally engage said axial displacement member about an engagement with said housing shaft to urge radial extension or retraction of said axial displacement member from said at least one shaft to radially dispose said at least one pilotable downhole tool.

25. The apparatus according to claim 24, wherein said engagement comprises a flexible member comprising a functionally shaped controllably deformable material, an axial slippable joint, a bendable joint, a spring, or combinations thereof, usable to selectively pivot said axial displacement member relative to said at least one shaft.

26. The apparatus according to claim 24, wherein said at least one shaft and said housing shaft comprise a plurality of movable shaft segments with at least one substantially rotating shaft segment, at least one substantially stationary shaft segment, a rotary connector shaft segment, or combinations thereof, usable to further operate said selectively arrangable tool string.

27. The apparatus according to claim 18, wherein said selectively arrangable tool string further comprises a hole finding device usable to locate an access or to pilot said innermost bore or said pilotable passageway through a dissimilar contiguous innermost bore.

28. The apparatus according to claim 8, wherein said selectively arrangable tool string further comprises at least one anti-rotation device, a dog, a slip, a shear pin, a mandrel, a connector, or combinations thereof, usable to at least temporarily fix at least two movable parts of said selectively arrangable tool string.

29. A method of urging at least one apparatus associated with a tool string to displace at least one inner conduit within at least one surrounding bore of a subterranean well to empirically measure any existing concentric cementation and cement bonding both before and after new cementation, said method comprising the steps of:

conveying at least one selectively arrangable tool string through an innermost bore of differing diameters or frictionally resistant walls, wherein said selectively arrangable tool string comprises at least one selectively actuatable downhole drive tool, at least one downhole placement tool with at least one shaft and an axial displacement member extendable and retractable from said at least one shaft, and at least one cutting or displacing tool comprising at least one of a cutting blade, a cutting wheel, a spike, or a boring bit;

actuating said at least one selectively actuatable downhole drive tool to operate said at least one downhole placement tool to place said at least one cutting or displacing tool within said at least one inner conduit;

using said at least one cutting or displacing tool to cut or displace said at least one inner conduit proximally concentrically within said at least one surrounding bore, thereby forming a cut or a space;

circulating fluid between said at least one inner conduit and said at least one surrounding bore for cleaning and bonding cement thereto after said new cementation; and transmitting at least one logging signal through said cut or through the space to measure about said at least one surrounding bore before said new cementation, wherein said signal is used to determine said existing concentric cementation and said cement bonding before and after said new cementation.

30. The method according to claim 29, further comprising the step of selectively arranging said at least one selectively arrangable tool string to permanently dispose downhole at least a part of said at least one cutting or displacing tool.

31. The method according to claim 29, further comprising the step of selectively arranging said at least one selectively arrangable tool string to transmit said at least one logging signal through at least one signal conductance well element comprising a deployment string, said at least one inner conduit, a fluid column about said at least one surrounding bore, existing cement around said at least one surrounding bore, strata around said at least one surrounding bore, or combinations thereof.

32. The method according to claim 31, further comprising the step of selectively arranging said at least one selectively arrangable tool string to absorb energy from said at least one signal conductance well element, convert energy from said at least one signal conductance well element, or combinations thereof.

33. The method according to claim 29, further comprising the step of selectively arranging said at least one selectively arrangable tool string to extend a pilotable passageway for accommodating at least one downhole tool from said at least one inner conduit by cutting or displacing said surrounding bore, debris within said surrounding bore, or combinations thereof.

34. The method according to claim 29, further comprising the step of selectively arranging said at least one selectively arrangable tool string to pilot at least one pilotable downhole tool through a transverse dimension substantially smaller than a transverse extendable dimension of the axial displacement member from said at least one shaft.

35. The method according to claim 29, wherein said at least one cutting or displacing tool or an associated coupling tool comprises a pilotable downhole tool with a packer, a bridge plug, a pedal basket, a flexible membrane, or combinations thereof.

36. The method according to claim 29, wherein said at least one cutting or displacing tool or an associated coupling tool comprises a pilotable downhole tool with at least one mechanic arm linkage, at least one wheeled mechanical linkage, or combinations thereof.

37. The method according to claim 29, wherein said at least one cutting or displacing tool comprises a pilotable downhole tool with at least one displacement valve, a momentum vibrator, or combinations thereof.

38. The method according to claim 37, wherein said at least one shaft and said housing shaft comprise at least one substantially rotating shaft segment, at least one substantially stationary shaft segment, at least one rotary connector shaft, or combinations thereof.

39. The method according to claim 29, further comprising the step of selectively arranging said at least one selectively arrangable tool string to dispose said at least one shaft axially within a housing shaft to pivotally engage said axial displacement member about an engagement with said housing shaft, to urge a radial extension or retraction of said axial displacement member from said at least one shaft to radially dispose at least one pilotable downhole tool.

40. The method according to claim 39, wherein said engagement comprises a flexible member comprising a functionally shaped controllably deformable material, an axial slippable joint, a bendable joint, a spring, or combinations thereof, and wherein the method further comprises pivoting said axial displacement member relative to said at least one shaft.

41. The method according to claim 29, further comprising the step of fixing at least two movable parts of said selectively arrangable tool string using at least one of an anti-rotation device, a dog, a slip, a shear pin, a mandrel, a connector, or combinations thereof.

42. The method according to claim 29, further comprising the step of using a hole finding device usable to locate an access or to pilot said at least one inner conduit through a dissimilar contiguous innermost bore.

* * * * *